US005498222A

United States Patent [19]

Hur

[11] Patent Number: 5,498,222

[45] Date of Patent: Mar. 12, 1996

[54] EXERCISE DEVICE

[76] Inventor: Young B. Hur, 615-34, Jayang-Dong, Seongdong-Ku, Seoul, Rep. of Korea

[21] Appl. No.: 20,323

[22] Filed: Feb. 19, 1993

[51] Int. Cl.[6] ..... A63B 21/008

[52] U.S. Cl. ..... 482/112; 482/142; 482/145; 482/130

[58] Field of Search ..... 482/96, 142, 145, 482/130, 72, 73, 111, 112, 137, 138

[56] References Cited

U.S. PATENT DOCUMENTS

| | | | |
|---|---|---|---|
| 4,240,627 | 12/1980 | Brentham | 482/138 |
| 4,762,317 | 8/1988 | Camfield et al. | 482/73 |
| 4,768,775 | 9/1988 | Marshall | 482/73 |
| 4,915,378 | 4/1990 | Abrahamian et al. | 482/145 |
| 4,928,957 | 5/1990 | Lanier et al. | 482/73 |

*Primary Examiner*—Richard J. Apley
*Assistant Examiner*—Lynne A. Reichard
*Attorney, Agent, or Firm*—Nawrocki, Rooney & Sivertson

[57] ABSTRACT

An exercise device for uniformly developing and conditioning the parts of the body. The device has a body support unit, an exercise loading unit, a leg support unit, a knee support unit, a reaction restraining unit and a back plate support unit and develops and conditions muscles by providing multidirectional exercises, i.e., upward, downward, frontward, backward, inward and outward exercises, for the upper and lower body. Particularly, this device easily efficiently provides a simple walking exercise of legs as well as a calf muscle exercise according to an ankle exercise, a thigh muscle exercise according to a knee exercise, an abdominal muscle exercise according to the thigh muscle exercise and etc. The exercise loading unit of this invention can be easily located at various positions corresponding to several kinds of exercises.

13 Claims, 63 Drawing Sheets

847'
805
847
851
815
814
825
824
849
823
822
826
828
804
806
801
816
838
843
844
837
833
836
853
845
813
831
812
846
834
811
830
832
803
835
842
848
820
841
840
802
827
850
821

EXERCISE DEVICE

BACKGROUND OF THE INVENTION

1. Field of the Invention

The present invention relates in general to exercise

More particularly, to an exercise device provided with an exercise loading unit. The exercise device is generally used for upward, downward, frontward, backward, leftward, rightward, inward and outward exercises. The device allows the user to selectively or compositely carry out the upward, downward, frontward, backward, leftward, rightward, inward and outward exercises, and develop and condition various parts of the body.

2. Description of the Prior Art

Known exercise devices generally use loading force generated by load means, such as a weight, a spring or a hydraulic cylinder. These devices provide individual exercises, thereby having a disadvantage in that they allow the user to develop and condition his body by only one of three directional exercises, i.e., frontward and backward exercise, leftward and rightward exercise and upward and backward exercise.

For example, a known weight lifting machine has an intrinsic use suitable for an upward exercise of arms; a known muscling machine has an intrinsic use suitable for an inward exercise of the leftward and rightward exercise; a known rowing machine has an intrinsic use suitable for a pulling exercise of arms; and a known running machine has an intrinsic use suitable for a downward exercise of legs.

In addition, there have been proposed several types of physiotherapy instruments, a kind of medical instrument. Like the aforementioned exercise devices, these physiotherapy instruments allow a unidirectional exercise. For example, repeated upward and downward exercise in the case of a known leg physiotherapy instrument.

As described above, such known exercise devices and physiotherapy instruments provide specified directional exercises. In this regard, it is required to prepare several exercise devices having specified uses when the user intends to develop and condition various parts of his body by all of the directional exercises. This inevitably causes difficulty in preparation of several exercise devices, resulting in remarkable capital investment in buying individual exercise devices and a real problem in locating the exercise devices in a room in an ordinary home.

Because of the problem, the user who intends to develop and condition various parts of his body inevitably uses a sports center or a health club which is equipped with several types of exercise devices.

Additionally, the known exercise devices only provide unidirectional exercises for developing and conditioning muscles of arms and legs, respectively. In this regard, known exercise devices have another problem in that the user must pay close attention to the directions of the exercises; otherwise, he will not uniformly develop and condition various parts of his body.

These problems have created an increasing demand for an integrated exercise device having several functions.

In the past, in order to achieve the aforementioned demand, there has been a design of an integrated exercise device, such as disclosed in Korean U.M. Publication Nos. 83-283, 84-877, 85-3022, 85-3206, 86-69 and 86-2201.

However, this known integrated exercise device is nothing but integration of known several exercise units having intrinsic directional exercises, or composition of the known exercise units such that it is allowed to carry out only a part of required exercises. Hence, this integrated exercise device has a problem in that it can not allow the user to uniformly develop and condition various parts of his body. Furthermore, this type of exercise device is provided with individual loading members for several exercise units, involving additional capital investment in manufacture thereof and causing inefficiency in its use.

SUMMARY OF THE INVENTION

In order to overcome the aforementioned problems, the present applicant provides a novel exercise device. The novel exercise device was developed in consideration of a fact that lower muscles below joints, such as ankle joints, knee joints, wrist joints and elbow joints, move in response to muscular motion of upper muscles above the joints in accordance with structural characteristics of human body.

It is an object of the present invention to provide an exercise device which provides multidirectional exercises in order to uniformly develop and condition various muscles, which are positioned above and below several joints of the body and generally move in multidirection. The device includes a common loading unit which has an independent or common use for several exercises suitable for various parts of the body.

It is another object of the present invention to provide an exercise device which allows the user to simply carry out an exercise for the upper body by employing his arms with no additional unit. Also, to easily efficiently carry out a simple walking exercise of legs, by employing a leg support unit, a knee support unit and an reaction restraining unit. Additionally, the device includes a calf muscle exercise according to an ankle exercise; a thigh muscle exercise according to a knee exercise; an abdominal muscle exercise according to the thigh muscle exercise.

It is a further object of the present invention to provide an exercise device which is able to be easily applied to conventional exercise, leisure, business, hairdressing and physiotherapy chairs, beds, and conventional exercise devices, thereby providing versatility.

In accordance with preferred embodiment of this invention, the aforementioned objects can be accomplished by providing an exercise device comprising a body support unit including a seat plate, a back plate and legs mounted on a lower part of the seat plate. The device further includes an exercise loading unit being mounted on a frame of the body support unit and including a lever, a load generator, a turning support hinge part, and a leg support unit mounted on a top part of the exercise loading unit.

In accordance with another embodiment of this invention, the exercise device further comprises a knee support unit detachably mounted on a front end or on a rear end of the exercise loading unit as required; a reaction restraining unit being adapted for preventing reaction which may be inflicted on the upper body of the user in exercising and being mounted on the body support unit as required; and, a back plate support unit being adapted for preventing unstable state of the seat plate even when an angle between the seat plate and the back plate of the body support unit increases above a predetermined angle. The back plate support unit being mounted on the body support unit.

BRIEF DESCRIPTION OF THE DRAWINGS

The above and other objects, features and other advantages of the present invention will be more clearly understood from the following detailed description taken in conjunction with the accompanying drawings, in which:

FIGS. 9 and 10 show an eighth embodiment of an exercise device of the present invention, respectively, in which:

FIG. 9 is a side view of the embodiment in downward exercise; and

FIG. 10 is a side view of the embodiment in upward exercise;

FIGS. 18 to 21 show a twelfth embodiment of an exercise device of this invention, respectively, in which:

FIG. 18 is a perspective view showing the appearance of the exercise device;

FIG. 19 is a partial perspective view showing an inner frame of the exercise device;

FIG. 20 is a side view of the exercise device showing its operation in upward exercise;

FIG. 21 is a side view of the exercise device showing its operation in downward exercise;

FIGS. 22 and 23 show another embodiment of an exercise loading unit of this invention, respectively, in which:

FIG. 22 is an exploded enlarged perspective view; and

FIG. 23 is a sectional view of the assembled exercise loading unit;

FIGS. 24 to 35 show thirteenth embodiment of an exercise device of this invention, respectively, in which:

FIG. 24 is a perspective view showing the appearance of the device;

FIG. 25 is a partial enlarged perspective view of a seesaw mechanism of the exercise device of FIG. 24;

FIGS. 26 and 27 are enlarged side views showing the operational relationship of the seesaw mechanism of FIG. 25; respectively;

FIG. 28 is an exploded enlarged perspective view of an exercise loading unit and a leg support unit of the device of FIG. 24;

FIG. 29 is a perspective view of the units of FIG. 28 after assembling;

FIG. 30 is a partial side view showing the operation of the leg support unit;

FIG. 31 is a partial sectional view of the leg support unit for showing a knob;

FIG. 32 is a sectioned view of a foothold of the leg support unit;

FIG. 33 is a sectioned view of a knee support unit when this unit is mounted on a top part of the lever;

FIG. 34 is an enlarged perspective view of the foothold of FIG. 32 in use; and FIG. 35 is a sectioned view of the foothold taken along the section line A—A of FIG. 34;

FIGS. 55 and 56 are plan views of the direction conversion link of FIG. 54 after assembling, respectively, in which:

FIG. 55 is a plan view in inward exercise; and

FIG. 56 is a plan view in outward exercise;

FIGS. 62 to 64 show another embodiment of an exercise loading unit of this invention, respectively, in which:

FIG. 62 is an exploded perspective view of the embodiment;

FIG. 63 is a perspective view showing the operation in downward and inward exercise; and FIG. 64 is a perspective view showing the operation in upward and outward exercise;

FIGS. 65 to 67 show another embodiment of an exercise loading unit of this invention, respectively, in which:

FIG. 65 is an exploded perspective view of the embodiment;

FIG. 66 is a perspective view showing the operation in downward and inward exercise; and FIG. 67 is a perspective view showing the operation in upward and outward exercise;

FIGS. 80 to 83 are perspective views showing the operations of the exercise device of this invention, respectively, in which:

FIG. 80 shows upward and downward exercise of ankles;

FIG. 81 shows frontward, upward and downward exercise of the leg as letting the knees be the points of action;

FIG. 82 shows upward and downward exercise using the knees and the thighs; and FIG. 83 shows upward and downward exercise and frontward and backward exercise of the lower body;

FIGS. 87 to 95 show another embodiment of a load generator of the exercise loading unit of this invention, respectively, in which:

FIG. 87 is a sectional view of the load generator;

FIGS. 87A and 87B are partially enlarged sectioned views of the load generator of FIG. 87;

FIG. 88 is a sectional view showing another operation of the load generator;

FIGS. 89 to 91 are sectional views taken along the section line I—I of FIG. 87, the section line II—II of FIG. 96 and the section line III—III of FIG. 98, respectively, in which:

FIG. 89 shows a minimum load state;

FIG. 90 shows a middle load state; and

FIG. 91 shows a stop position;

FIG. 92 is a partially broken perspective view of the load generator for showing an actuation lever;

FIGS. 93 to 95 are schematic views showing horizontal movements of the actuation rod in response to rotation of the actuation lever of FIG. 92, respectively;

FIGS. 96 and 97 are sectional views of another embodiment of a load generator of this invention, respectively, in which:

FIG. 96 shows a compression start; and

FIG. 97 shows a tension state;

DETAILED DESCRIPTION OF THE PREFERRED EMBODIMENTS

With reference to the accompanying drawings from the viewpoint of the technical structure of an exercise loading unit of an exercise device of this invention, FIGS. 1 to 36 show embodiments and their subassemblies suitable for upward and downward exercise. FIGS. 37 to 50 show embodiments and their subassemblies suitable for upward and downward exercise and frontward and backward exercise. FIGS. 51 to 61 show embodiments and their subassemblies suitable for inward and outward exercise in leftward and rightward direction. FIGS. 62 to 75 show embodiments and their subassemblies suitable for upward and downward exercise and inward and outward exercise by virtue of directional conversion. FIGS. 76 to 83 show embodiments and their subassemblies suitable for providing upward, downward, frontward, backward, inward and outward exercises selectively or simultaneously. FIGS. 84 to 101 show several embodiments of a load generator of the exercise loading unit of this invention.

First, several embodiments and their subassemblies suitable for providing upward and downward exercise will be described hereinbelow as referring to FIGS. 1 to 36.

Figure 1:
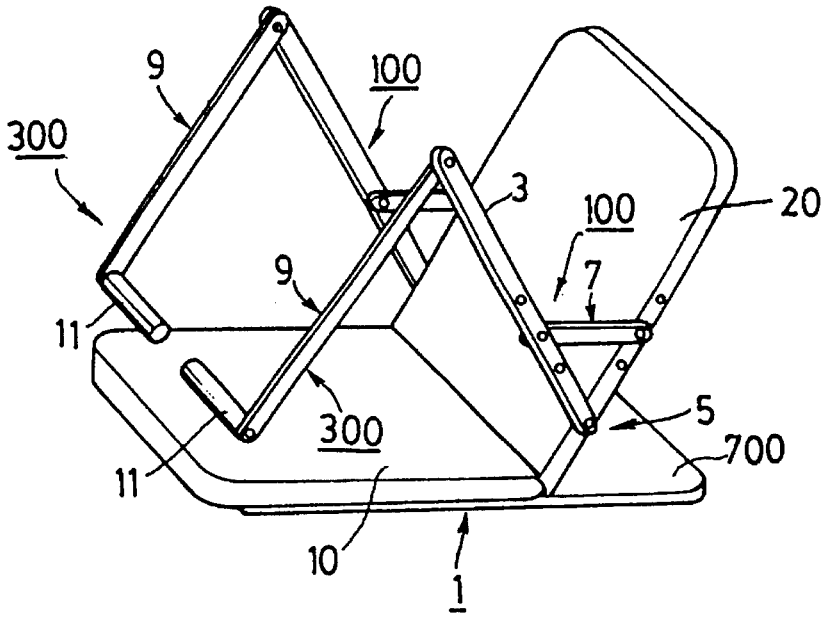
FIG. 1 is a perspective view of a primary or basic embodiment of an exercise device according to the present invention.
Figure 2:
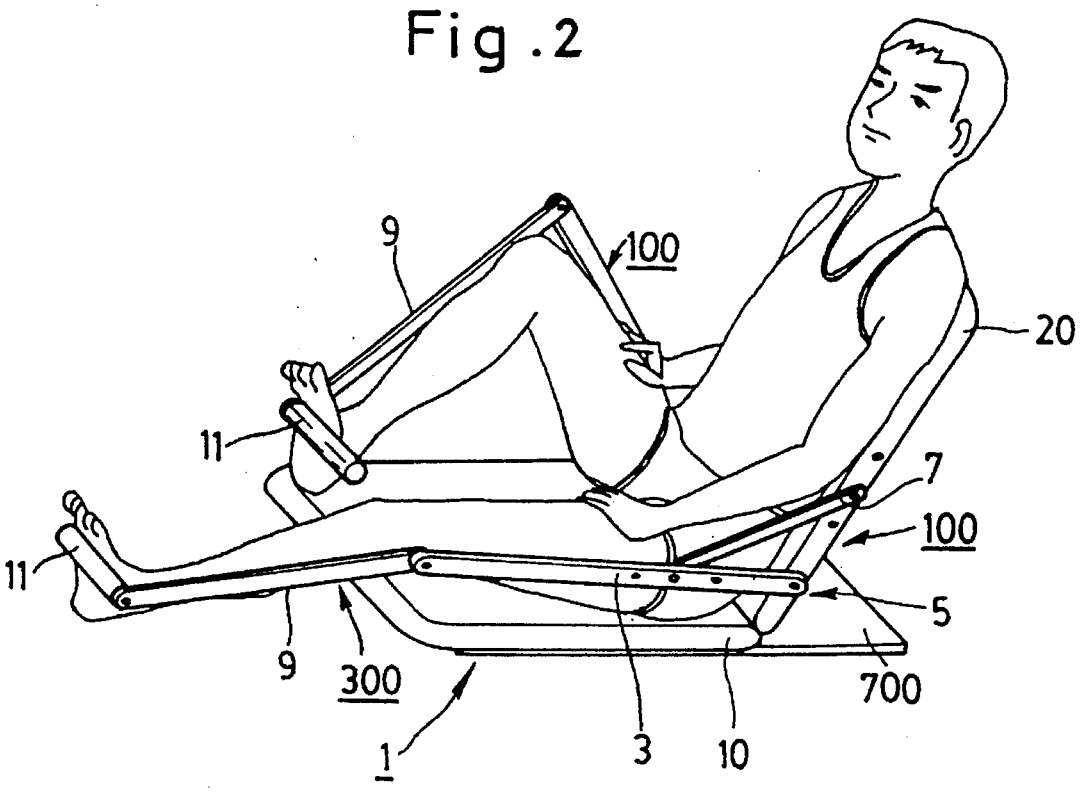
FIG. 2 is a perspective view showing an operation of the exercise device of FIG. 1.

Referring first to FIGS. 1 and 2 showing a primary or basic embodiment of an exercise device of this invention. This device includes a body support unit 1 for allowing the user to exercise sitting or lying thereon. This device further includes an exercise loading unit 100 and a leg support unit 300. The loading unit 100 comprises a pair of levers 3 for transmitting exercise loading to an inner frame of the body support unit 1, a pair of turning supports 5 each of which causes each lever 3 to be rotatable in order to correspond to the direction of the exercise and provided at an end of each lever 3, and a pair of load generators 7 mounted on the other ends of the levers 3. The leg support unit 300 comprises a pair of connection members 9 and a pair of footholds 11 and engages with the exercise loading unit 100.

Here, the load generator 7 of the loading unit 100 preferably comprises a bar-shaped member made of an elastic rubber as depicted in FIGS. 1 and 2. However, in accordance with another embodiment of this invention, this load generator 7 may comprise a hydraulic cylinder, a torsion bar, combination of a weight and a wire, or a spring which will be described again.

As shown in FIGS. 1 and 2, the loading unit 100 provides the turning support 5 at a rear end of the lever 3 and causes the front end of the lever 3 to move upward and downward. The load generator 7 is connected between a front part of the lever 3 and an upper part of the turning support 5.

Here, the front part of the lever 3 means a portion between the front end of the lever 3 and the turning support 5, while the upper part of the turning support 5 means a portion spaced apart from the turning support 5 by a predetermined distance.

In practical use of this device, the turning support 5 may be provided on a portion of a frame of a seat plate 10 or a back plate 20 of the body support unit 1. In addition, this turning support 5 may be provided by using an additional fixing member. In this case, the additional fixing member should be fixed to a predetermined position of, for example, the body support unit 1 as will be described below.

On the other hand, the leg support unit 300 is constructed in such a manner that its connection member 9 is rotatably connected to the front end of the lever 3 by using a hinge pin, and connected to the foothold 11 by using a shaft.

If required, the device of this invention may be provided with a back plate support member 700 at the rear part of the seat plate 10, in order to provide desired stability of the body support unit 1 in exercising.

In exercising by using this device, the user sits on the body support unit 1 and lays his feet on the footholds 11. At this state, the user throws the strength into his feet in order to stretch out his legs frontwards. Accordingly, the lever 3 turns about the turning support downwards causing the load generator 7 to be elongated and foothold 11 and the connection member 9 to advance frontwards. However, when the user releases the strength from the feet, all of the foothold 11, the connection member 9, the lever 3 and the load generator 7 returns to their initial positions as depicted in FIG. 1, thanking for the restoring force of the load generator 7. In this manner, the user can repeat stretching and retracting his legs as throwing and releasing the strength into and from his feet, thereby developing and conditioning his lower body.

Of course, it is possible to exercise the upper body as laying the hands on the levers 3 using no leg support unit 300 in order to carry out downward exercise.

Turning to FIGS. 3 to 8, the exercise device of this invention further includes a knee support unit 500 provided on the lever 3 of the loading unit 100, and reaction restraining members 600 provided on the body support unit 1. In these drawings, there are shown several embodiments of the body support unit 1, the exercise loading unit 100, the leg support unit 300 and the knee support unit 500.

Figure 3:
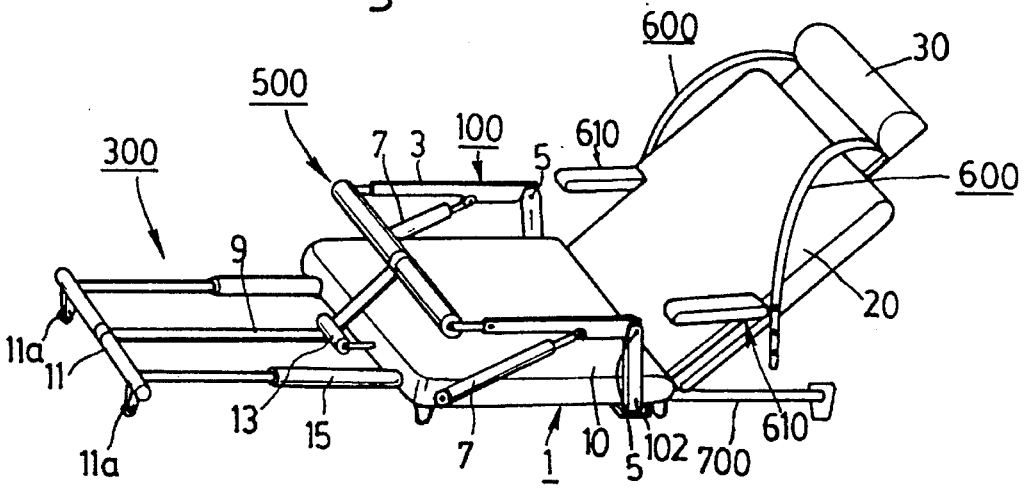
FIGS. 3 to 8 are perspective views showing second to seventh embodiments of an exercise device of the present invention, respectively.
Figure 4:
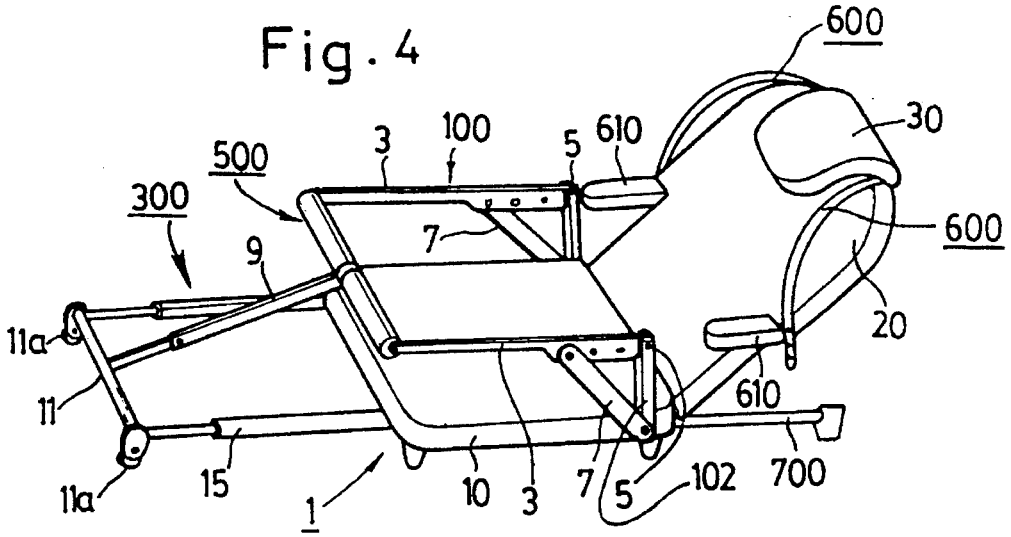
Figure 5:
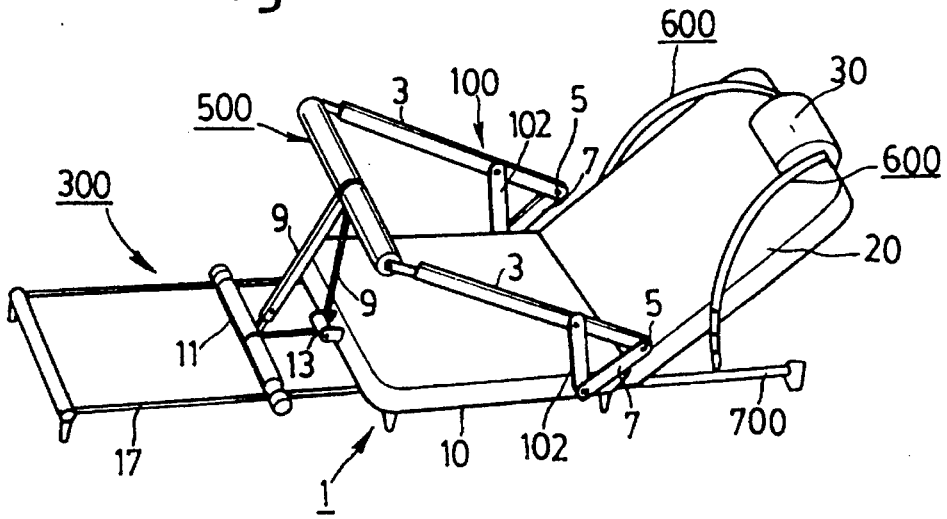
Figure 6:
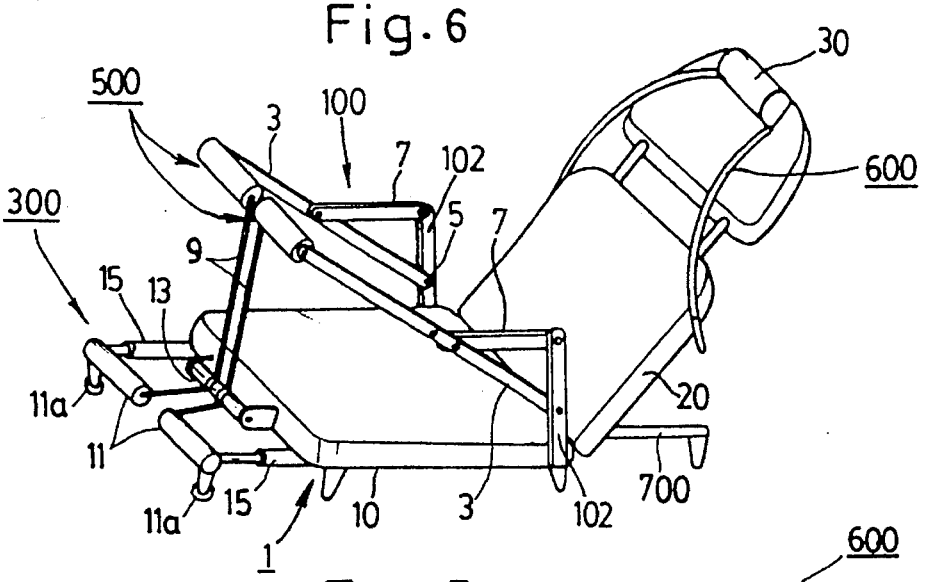
Figure 7:
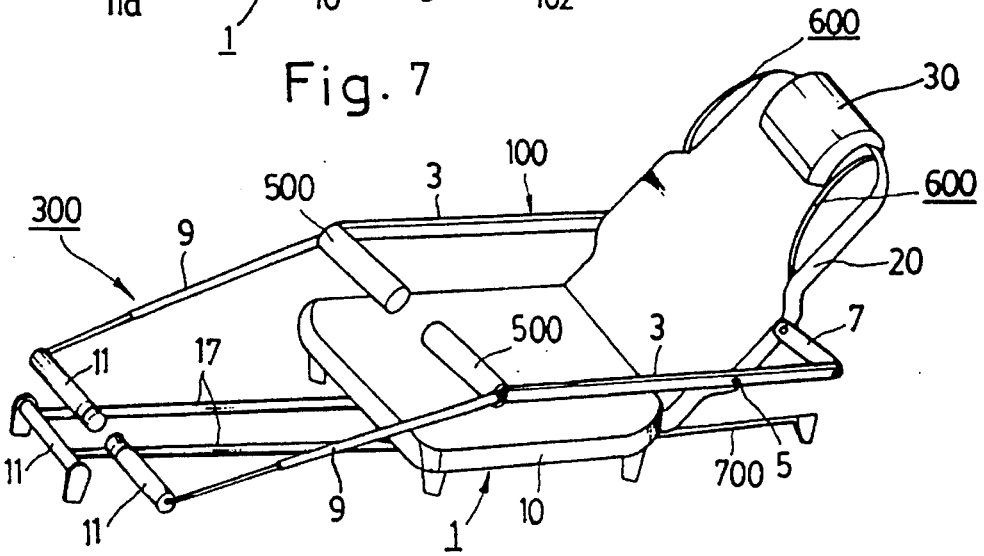
Figure 8:
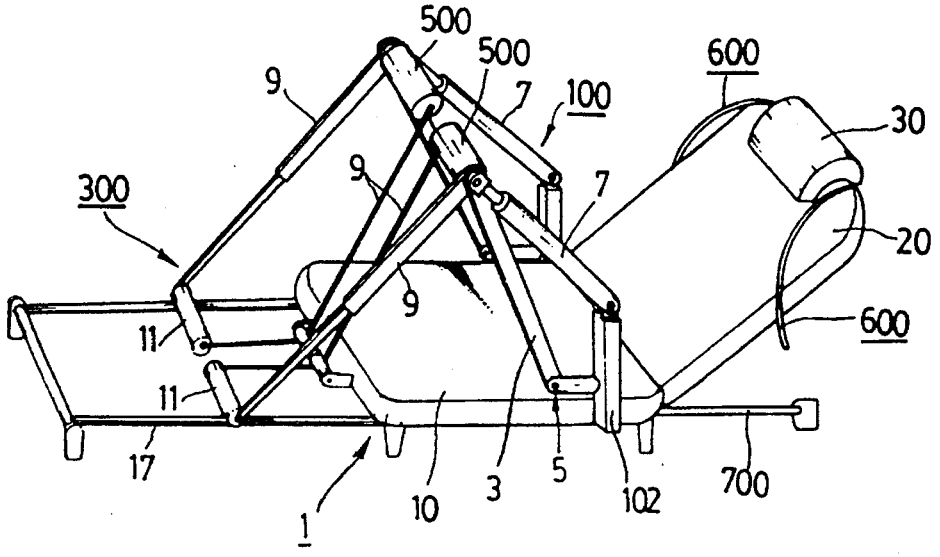

FIGS. 3 to 5 represent integrated types of leg support unit 300 and knee support unit 500, while FIGS. 6 to 8 represent separated types of units 300 and 500.

Body support unit 1 includes a head support or a pillow 30 provided on a top center of the back plate 20, and a pair of belt type reaction restraining members 600 provided on opposite sides of the pillow 30 in all of the embodiments depicted in FIGS. 3 to 8. The body support unit 1 of the embodiments shown in FIGS. 3 and 4 is additionally provided with a pair of auxiliary arm supports 610.

On the other hand, the exercise loading unit 100 of the embodiments of FIGS. 3 and 4 is provided with the turning support 5 at the rear end of the lever 3 and, as a result, causes the front end of the lever 3 to turn upwards and downwards about the turning support 5. The load generator 7 of these embodiments is mounted between a front portion of the turning support 5 of the lever 3 and a lower portion of the turning support 5. The turning support 5 is provided on the additional fixing member 102 on a side of the body support unit 1. An end of the load generator 7 is hinged to the lever 3 by employing a hinge pin, and the other end of the load generator 7 is hinged to a portion below the turning support 5. For example, the other end of the load generator 7 is hinged to the frame of the seat plate 10 of the body support unit 1 by employing a hinge pin, and achieves a link connection mechanism as depicted in FIG. 3. Alternatively, it is hinged to a lower part of the additional fixing member 102 by employing a hinge pin and achieves the link connection mechanism as depicted in FIG. 4.

In the embodiments of FIGS. 6 to 8, the exercise loading unit 100 is provided with the turning support 5 at the rear end of the lever 3 and, as a result, causes the front end of the lever 3 to turn upwards and downwards about the turning support 5. The load generator 7 of these embodiments is mounted between a front portion of the turning support 5 of the lever 3, and an upper portion of the turning support 5. The turning support 5 is provided on a middle portion of the additional fixing member 102, on a side of the body support unit 1. An end of the load generator 7 is hinged to the lever 3 by employing a hinge pin. The other end of the load generator 7 is hinged to an upper part of the fixing member 102 above the fixing member 102 by employing a hinge pin, and achieves a link connection mechanism. Particularly, in the embodiment of FIG. 8, the turning support 5 is provided on a front protrusion part of the fixing member 102.

In the embodiments of FIGS. 5 to 7, the exercise loading unit 100 is provided with the turning support 5 at the middle portion of the lever 3 and, as a result, causes the front end of the lever 3 to turn upwards and downwards about the turning support 5. Here, the load generator 7 of the embodiment of FIG. 5 is mounted between a rear end of the turning support 5 of the lever 3 and a lower portion of the turning support 5. The load generator 7 of the embodiment of FIG. 7 is mounted between a rear end of the turning support 5 of the lever 3 and an upper portion of the turning support 5. In the embodiment of FIG. 5, the turning support 5 is provided on an upper portion of the additional fixing member 102 on the body support unit 1. The load generator 7 is provided between the rear end of the lever 3 and the lower portion of the fixing member 102. On the other hand, in the embodiment of FIG. 7, the turning support 5 is provided on the inner frame of the back plate 20 of the body support unit 1 and the load generator 7 is provided between the rear end of the lever 3 and the inner frame of the back plate 20 above the turning support 5.

In the embodiments of FIGS. 3 to 6, the leg support unit 300 further includes the knee support unit 500 provided on the front end of the lever 3. The connection member 9 is connected between the knee support unit 500 and the foothold 11. This connection member 9 is constructed to be a belt type and connected between the members 11 and 500 through an idle roller 13 in the case of the embodiments of FIGS. 3 and 6. In the case of the embodiment of FIG. 4, this member 9 is a rod type member capable of adjusting its length. Additionally, this connection member 9 may be constructed in combination of the belt type and the rod type as depicted in FIG. 5.

In accordance with the embodiments of FIGS. 3, 4 and 6, the leg support unit 300 further includes a pair of extendable foothold supports 15 provided between the footholds 11 and the seat plate 10. Additionally, a pair of rollers 11*a* are provided under the footholds 11. As depicted in FIG. 5, an additional foothold support 17 may be provided on the front end of the seat plate 10 so as to allow the foothold 11 to slide thereon as guided thereby.

Also, as depicted in FIGS. 7 and 8, the knee support unit 500 may be provided on the front end of the lever 3 with the rod type connection member 9 provided between the front end of the lever 3 and the foothold 11. In the embodiment of FIG. 8, the belt type connection member 9 is also provided in addition to the rod type connection member 9 and, furthermore, the foothold support member 17 is provided on the front end of the seat plate 10 so as to allow the foothold 11 to slide thereon as guided thereby.

In addition, it is noted that the embodiments of FIGS. 3 to 8 include individual back plate 700 provided at the rear parts of the seat plates 10.

In this regard, the embodiments represented in FIGS. 3, 4 and 7 allows the user to carry out upward exercise by using them. The embodiments represented in FIGS. 5, 6 and 8 allow the user to carry out upward exercise by using them.

Figure 9:
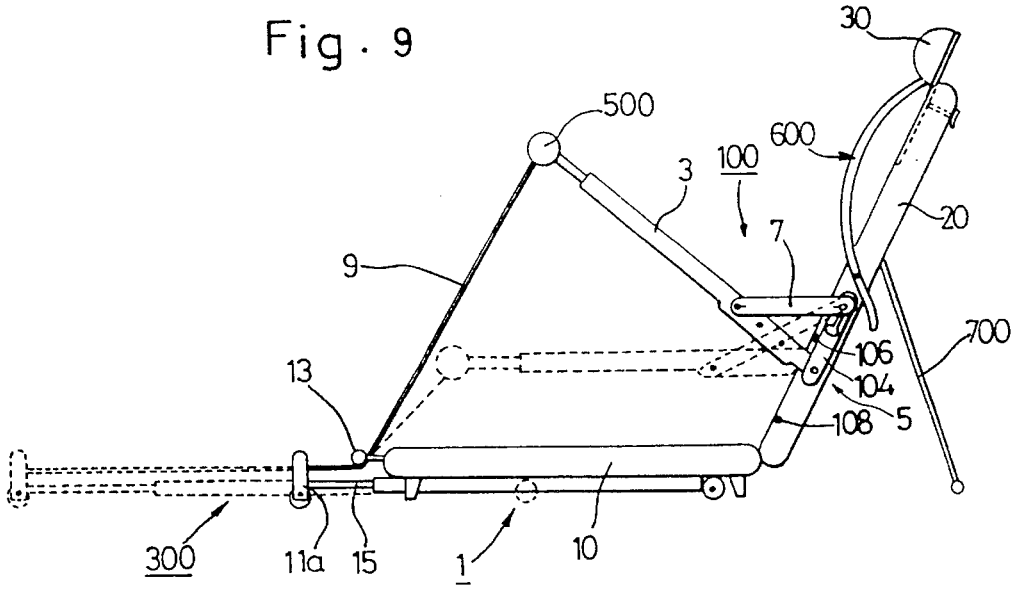
Figure 10:
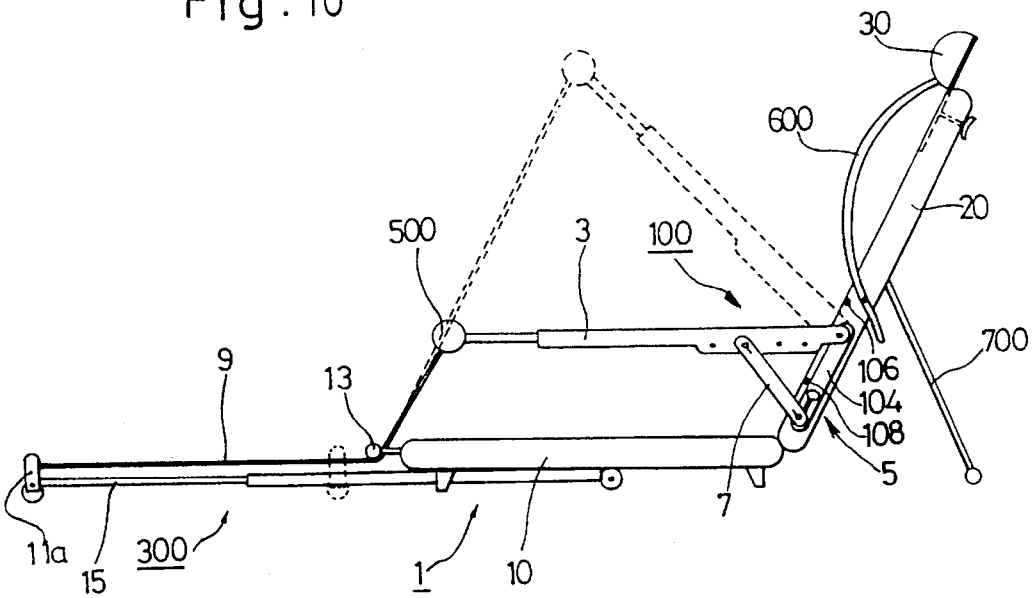

Referring next to FIGS. 9 and 10 showing another embodiment of this invention, the exercise device according to this embodiment has another embodiment of an exercise loading unit 100, and another embodiment of a back plate support member 700.

As shown in these drawings, the exercise loading unit 100 of this embodiment is constructed such that an end of a direction conversion link 104 is rotatably mounted on the turning support 5. The load generator 7 is provided between the front portion of the turning support 5 of the lever 3 and the other end of the direction conversion link 104. In addition, this embodiment further includes a pair of stopper pins 106 and 108 provided at front portions of the back plate 20 above and below the turning support 5, respectively. Thanking for such a construction, this embodiment allows the user to carry out the downward exercise when the direction conversion link 104 is located at the upper position and supported by the upper stopper pin 106 as depicted in FIG. 9. On the contrary, when the direction conversion link 104 is located at the lower position and supported by the lower stopper pin 108 as depicted in FIG. 10, this embodiment allows the user to carry out the upward exercise.

In this embodiment, the back plate support member 700 comprises a supporter provided on the back surface of the back plate 20 and supports the back plate 20 by the supporter.

Figure 11:
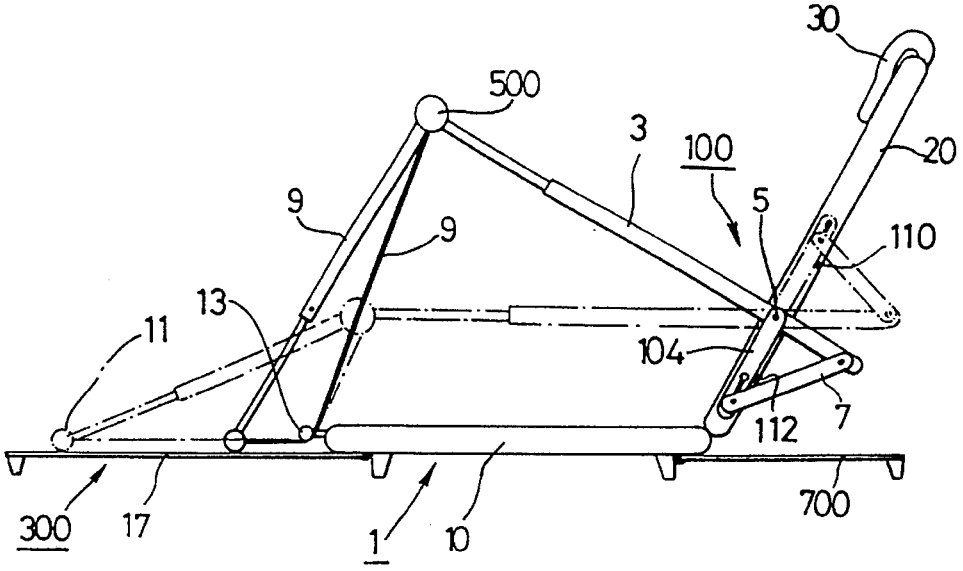
FIG. 11 is a side view of a ninth embodiment of an exercise device of the present invention in upward and downward exercise.
Figure 12:
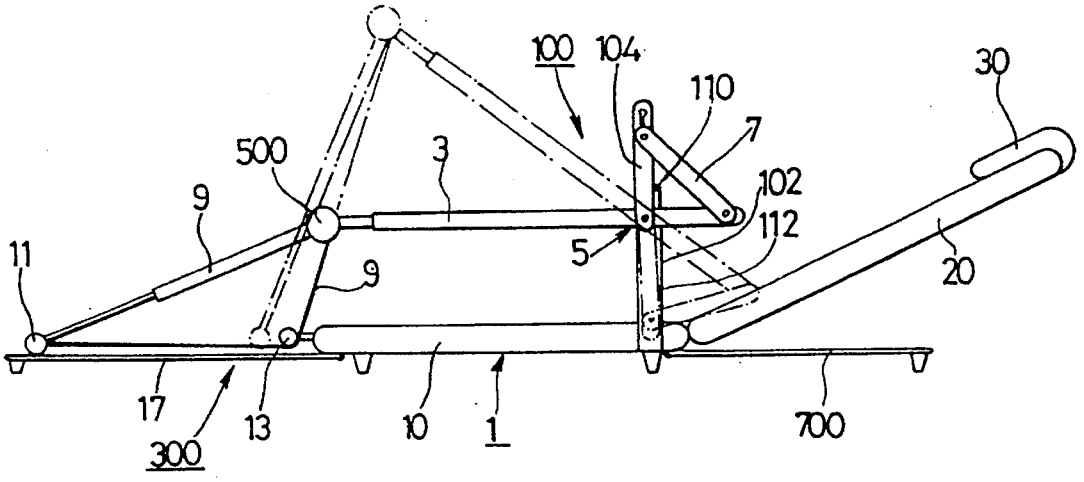
FIG. 12 is a view corresponding to FIG. 11, but showing a tenth embodiment of the present invention.

Referring next to FIGS. 11 and 12, the exercise loading unit 100 of this embodiment is constructed such that an end of the direction conversion link 104 is rotatably mounted on the turning support 5. The load generator 7 is provided between the front portion of the turning support 5 of the lever 3 and the other end of the direction conversion link 104. In addition, this embodiment further includes a pair of stopper pins 110 and 112 provided at rear portions of the back plate 20 above and below the turning support 5, respectively. Thanking for such a construction, this embodiment allows the user to carry out the downward exercise when the direction conversion link 104 is located at the lower position and supported by the lower stopper pin 112 as depicted at the solid line of FIG. 11 and at the phantom line of FIG. 12. On the contrary, when the direction conversion link 104 is located at the upper position and supported by the upper stopper pin 110, as depicted at the phantom line of FIG. 11 and at the solid line of FIG. 12, this embodiment allows the user to carry out the upward exercise.

At this time, the turning support 5 may be provided on the inner frame of the back plate 20 as depicted in FIG. 11 or may be provided on the additional fixing member 102 as depicted in FIG. 12.

Figure 13:
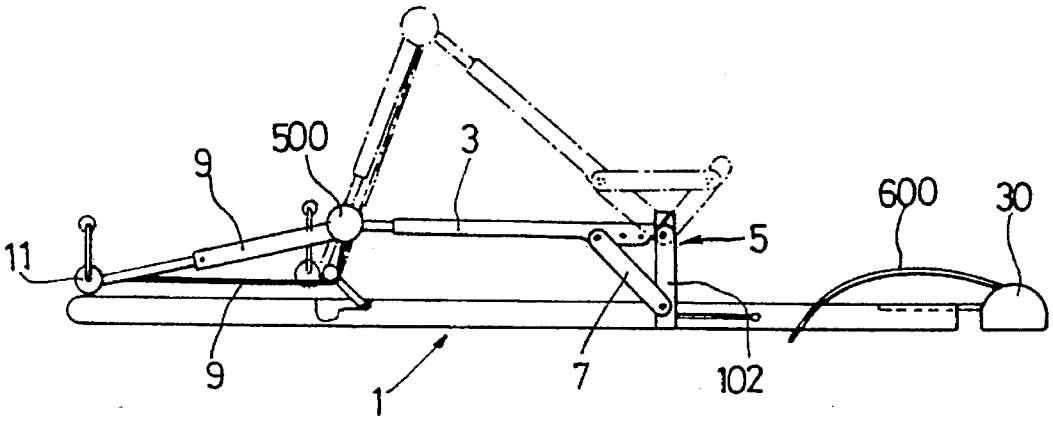
FIG. 13 is a view corresponding to FIG. 11, but showing an eleventh embodiment of the present invention.
Figure 14:
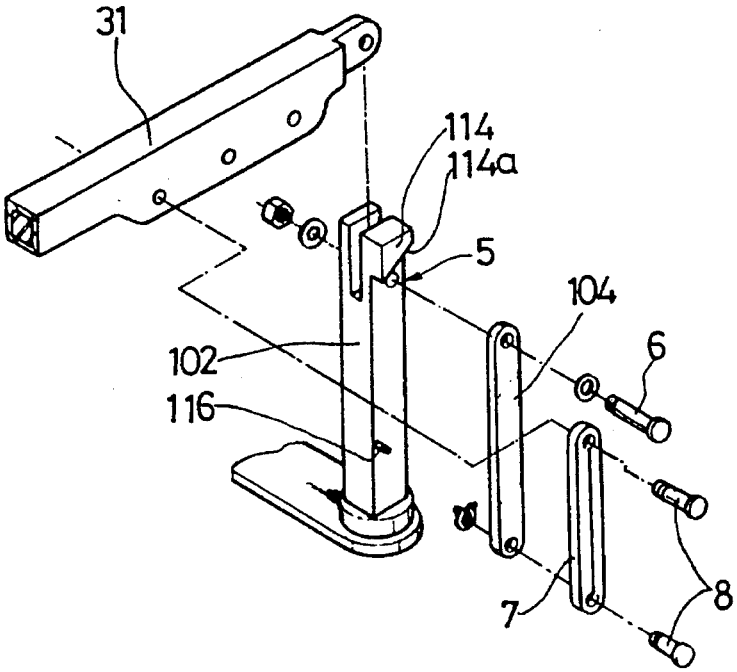
FIG. 14 is an exploded enlarged perspective view of an exercise loading unit of the embodiment of FIG. 13.

FIGS. 13 and 14 show another embodiment of an exercise device of this invention. As represented in these drawings, the body support unit 1 is constructed to be a mat type unit which allows the user to lie thereon. In this embodiment, all of the leg support unit 300, the knee support unit 500 and the reaction restraining members 600 are mounted in the same manner as described above. The exercise loading unit 100 of this embodiment is constructed such that the turning support 5 is provided on the additional fixing member 102 formed at the rear part of the lever 3. An end of the lever 3 is rotatably mounted on the turning support 5 by using a hinge pin 6. An end of the direction conversion link 104 is rotatably mounted on the turning support 5. In addition, the load generator 7 is connected between the front portion of the turning support 5 of the lever 3 and the other end of the direction conversion link 104 by using hinge pins 8. This embodiment further includes a fixing protrusion 114 which has an inclined surface 114*a* and provided above the turning support 5. In addition, a stopper pin 116 is provided on a front part below the turning support 5.

In this regard, this embodiment allows the user to carry out the upward exercise when the direction conversion link 104 is supported by the stopper pin 116 as depicted at the solid line of FIG. 13. On the contrary, when the direction conversion link 104 is supported by the inclined surface 114*a* of the fixing protrusion 114 as depicted at the phantom line of FIG. 13, this embodiment allows the user to carry out the downward exercise.

Figure 15:
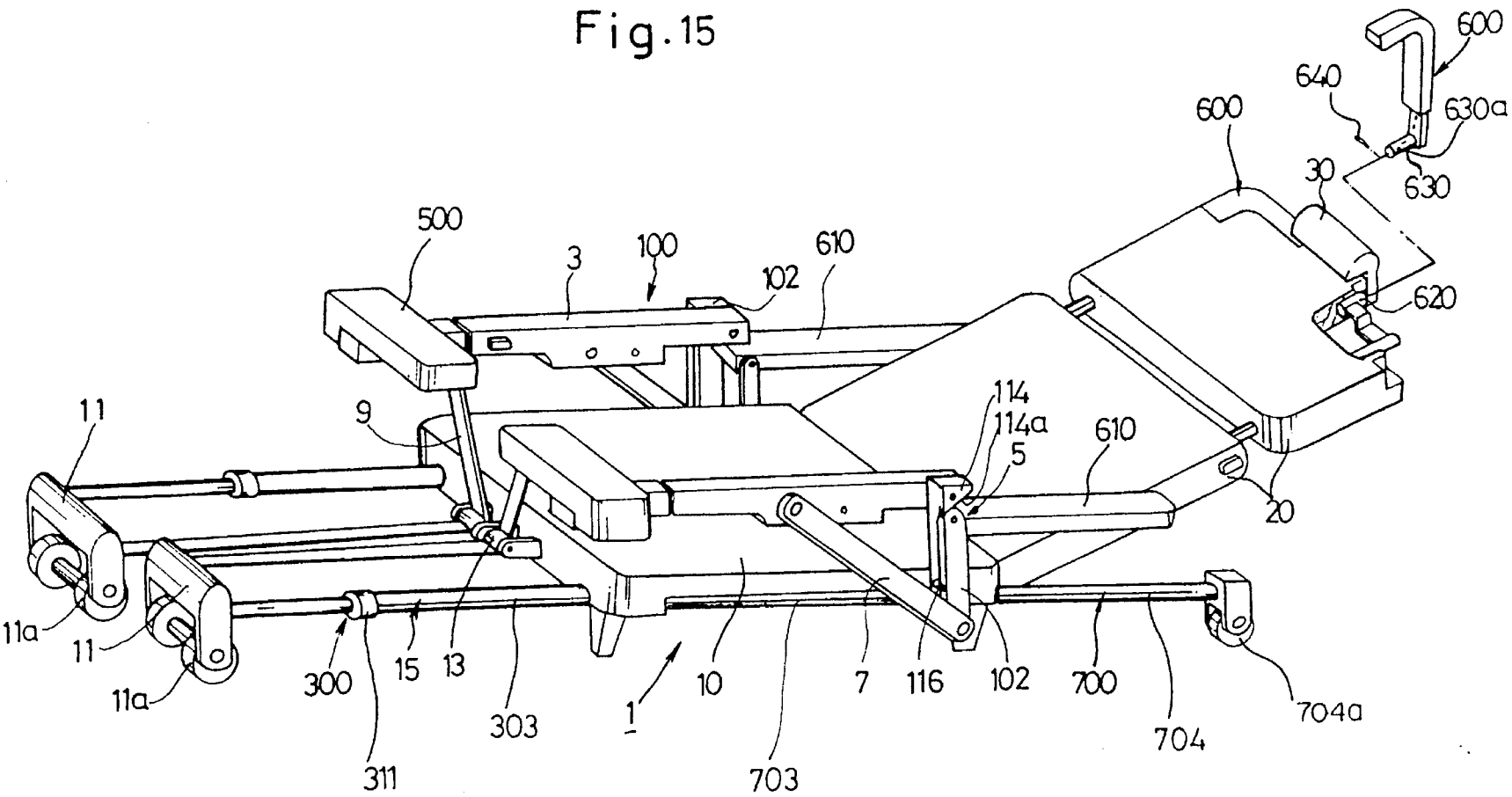
FIG. 15 is a perspective view of the exercise device of the present invention showing its appearance.
Figure 16:
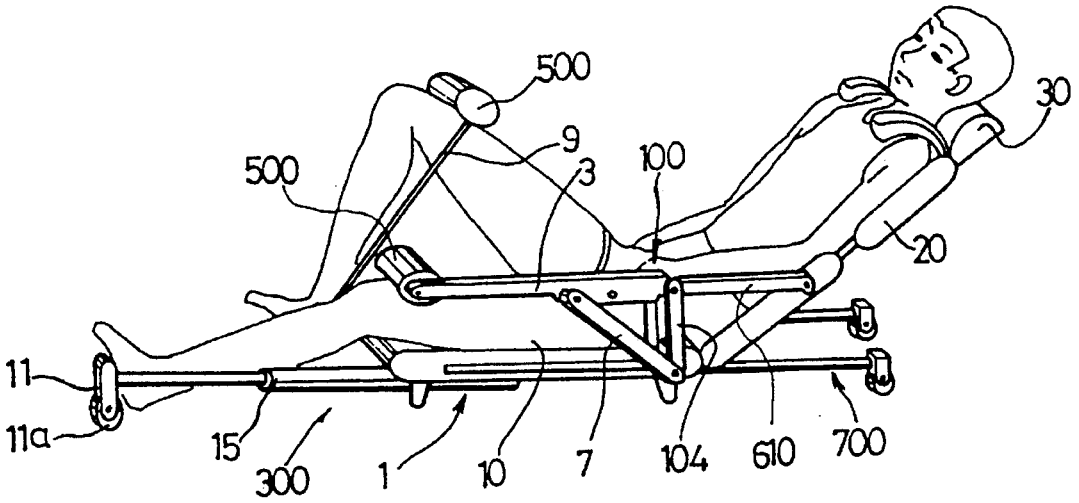
FIG. 16 is a perspective view of the exercise device of this invention showing its operation in upward exercise.
Figure 17:
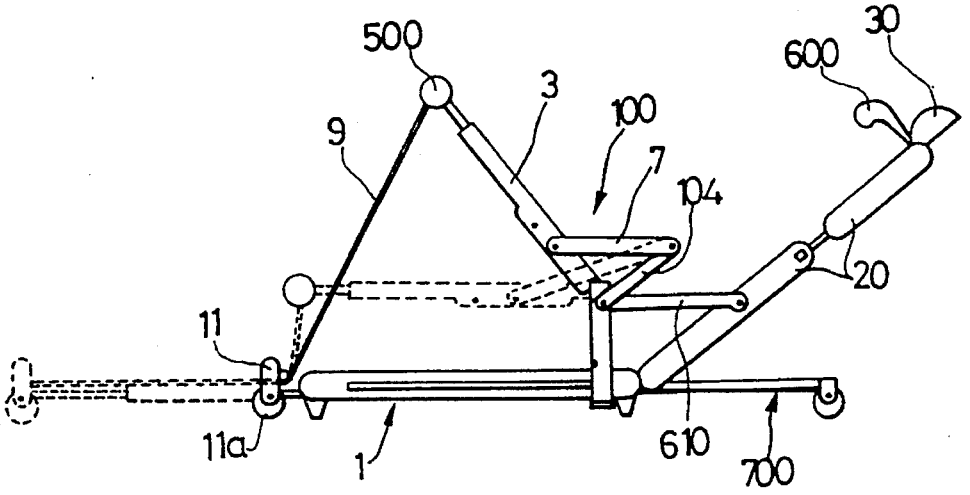
FIG. 17 is a side view of the exercise device of this invention showing its operation in downward exercise.
Figure 18:
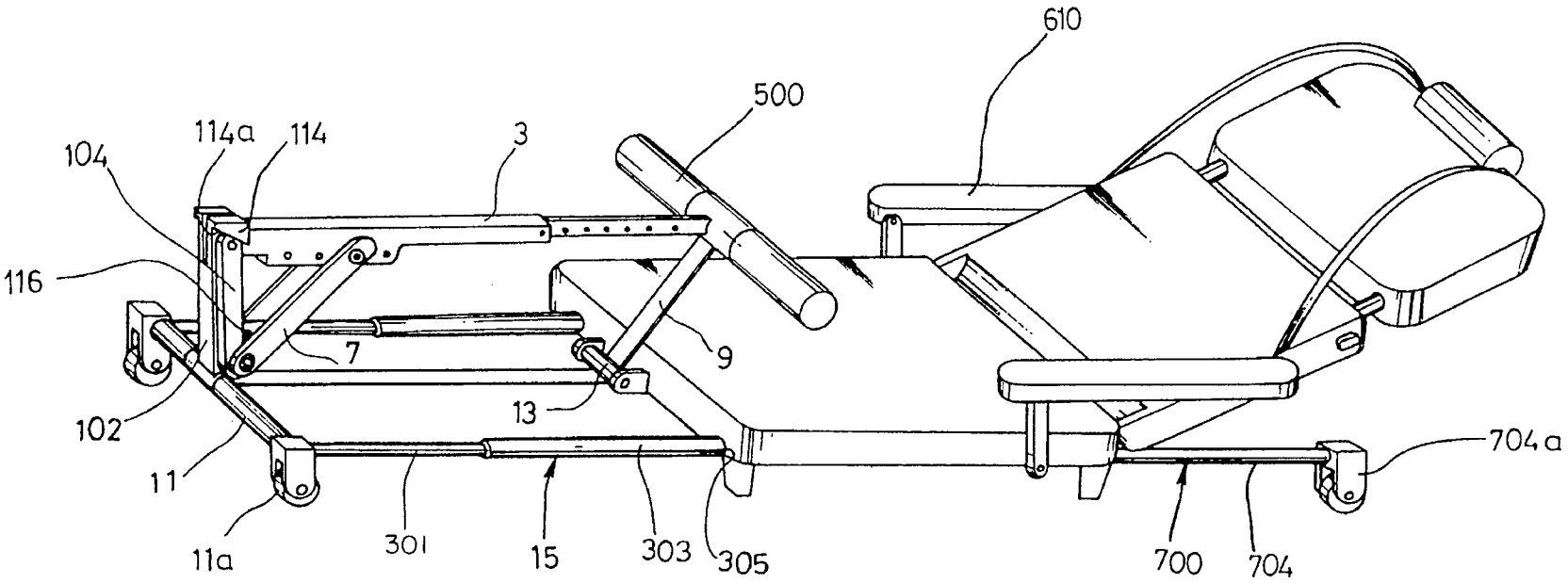
Figure 19:
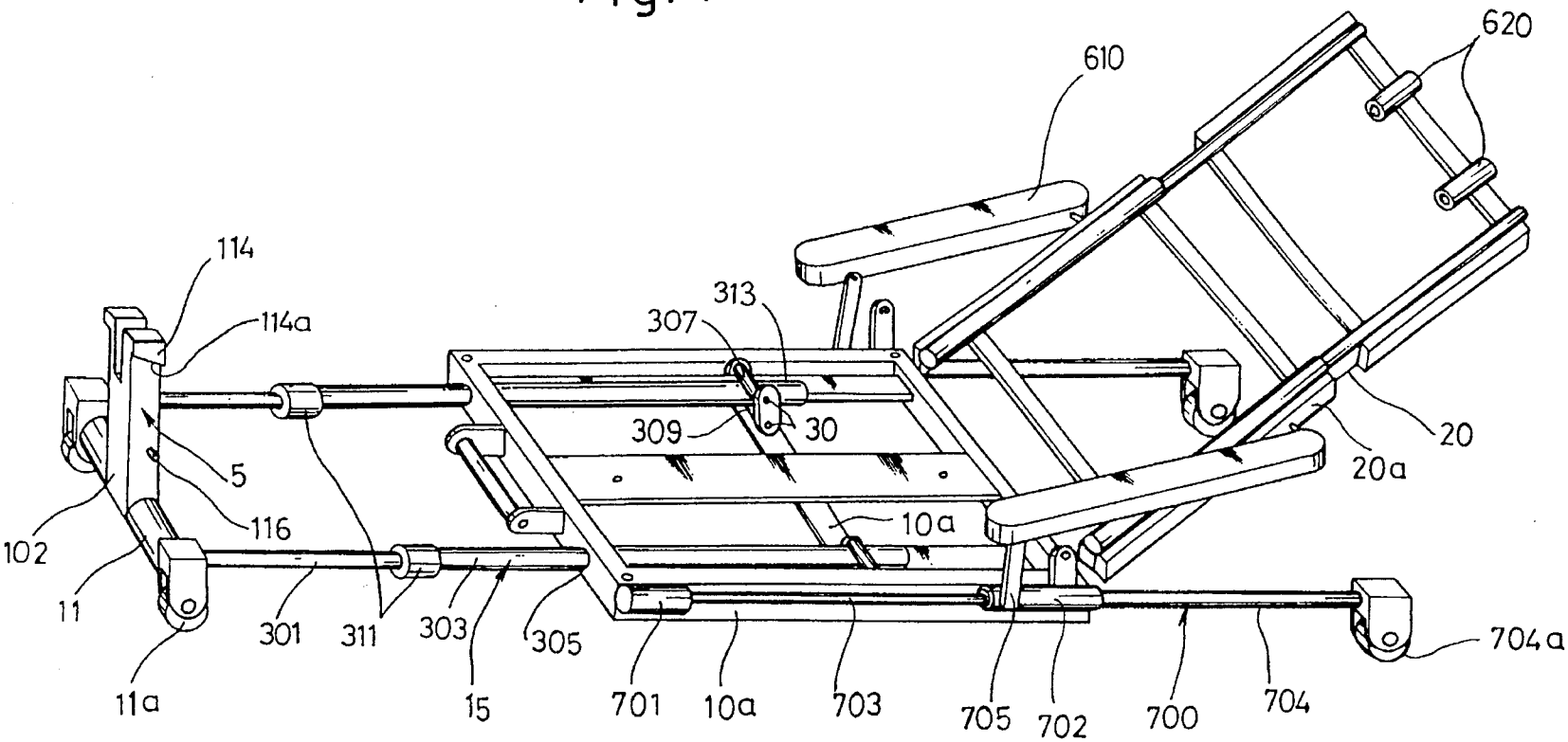

With reference to FIGS. 15 to 17, showing another embodiment of an exercise device of this invention, the body support unit 1 is constructed to be a conventional chair type unit comprising the seat plate 10, the back plate 20 and the pillow 30. This embodiment is provided with the auxiliary arm supports 610, the leg support unit 300 and the knee support unit 500 in the same manner as described in FIG. 6. In addition, the same exercise loading unit 100 as represented in FIGS. 13 and 14 and the same back plate support member 700 as represented in FIGS. 3 to 6 are provided for this embodiment.

However, the reaction restraining member 600 of this embodiment is constructed by providing a holder 620 at a portion of the inner frame of the back plate 20 near the pillow 30. This holder 620 is adapted for inserting a hanger type engagement protrusion 630 thereinto. This engagement protrusion 630 is provided with a pin hole 630*a* at its distal end for receiving a pin such that this pin 640 is rotatable in the holder 620.

Thanking for such a construction, this embodiment allows the user to carry out the upward exercise when the direction conversion link 104 is located at the lower position as depicted in FIG. 16. On the contrary, when the direction conversion link 104 is located at the upper position as depicted in FIG. 17, this embodiment allows the user to carry out the upward exercise. In this case, this embodiment allows independent upward and downward exercises by using both feet of the user.

Referring next to FIGS. 18 to 21 showing another embodiment of this invention, the body support unit 1 is constructed such that the seat plate 10 is conventionally hinged to the back plate 20, on which the pillow 30 is provided, in order to easily fold or open. In addition, the back plate 20 is provided with the belt type reaction restraining member 600. The back plate support member 700 is constructed by providing a fixing protrusion 701 and a guide pipe 702 at a side surface of the seat plate 10. This protrusion 701 is provided with a guide rod 703. Also, pipe type back plate support member 704 is provided with a roller 704*a* at its rear end and receives the guide rod 703 through the guide pipe 702. A link rod 705 is connected to the front end of the back plate support member 704 and hinged to an end of the auxiliary arm support 610 of which the other end is hinged to the side frame 20*a* of the back plate 20. In this regard, when the back plate 20 is folded with respect to the seat plate 10, the link rod 705 advances together with the auxiliary arm support 610. At this time, the back plate support member 704 advances as guided by the guide rod 703 at the inside thereof and guided by the guide pipe 702 at the outside thereof. On the contrary, when the back plate 20 is opened, the link rod 705 is retracted as depicted in the drawings and, as a result, forms a predetermined angle with respect to the seat plate 10. The back plate support member 704 is also retracted and supports the back plate 20.

In this embodiment, the leg support unit 300 has the same construction as depicted in FIG. 3. Otherwise stated, the belt type connection member 9 is connected between the foothold 11 and the knee support unit 500, and the extendable foothold supports 15 are provided between the footholds 11 and the seat plate 10. These foothold supports 15 are provided with rollers 11*a* at their front ends. However, there is a difference between this embodiment and the embodiment of FIGS. 3 in the fact that the knee support unit 500 of this embodiment is mounted on the rear part of the lever 3. Each of the extendable foothold supports 15 has a multi-stepped pipe structure comprising front and rear pipes 301 and 303. Here, the rear pipe 303 is received by a receiving hole 305, formed at the front end of the frame 10*a* of the seat plate 10, and positioned at its place as passing between the upper and lower guide rollers 307 and 309 provided in the receiving hole 305. At the front and rear ends, a pair of protruding stoppers 311 and 313 are provided, respectively, and be stopped by the receiving hole 305 and the upper and lower guide rollers 307 and 309 when the foothold supports 15 advance or retract.

On the other hand, the exercise loading unit 100 of this embodiment is constructed such that the turning support 5 is provided on the additional fixing member 102 formed above the foothold support 11 at the front part of the lever 3. An end of the lever 3 is rotatably mounted on the turning support 5 and an end of the direction conversion link 104 is rotatably mounted on the turning support 5. In addition, the load generator 7 is connected between the rear portion of the turning support 5 of the lever 3 and the other end of the direction conversion link 104. This embodiment further includes the fixing protrusion 114 which has the inclined surface 114*a* and provided above the turning support 5. In addition, the stopper pin 116 is provided on a rear part below the turning support 5.

Figure 20:
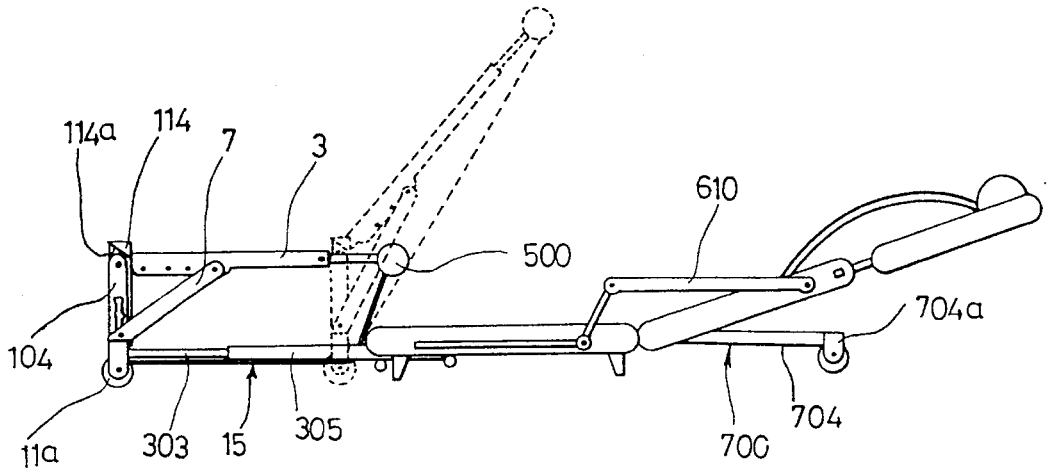
Figure 21:
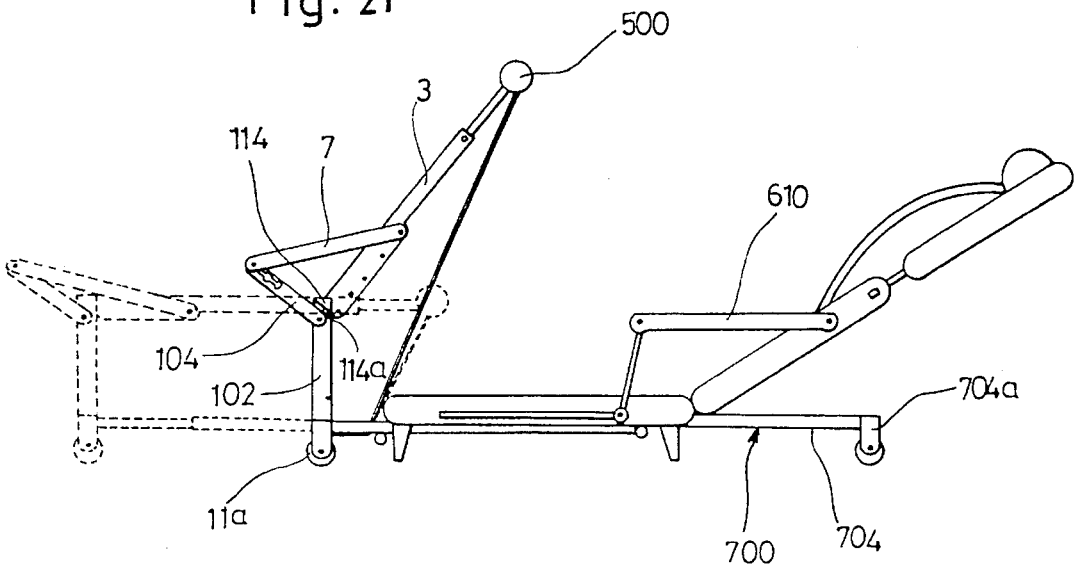

In this regard, this embodiment allows the upward exercise of the rear part of the lever 3, by the upward motion of the knee support unit 500 and the backward motion of the foothold 11, when the direction conversion link 104 is supported by the stopper pin 116 as depicted in FIG. 20. On the contrary, when the direction conversion link 104 is supported by the inclined surface 114*a* of the fixing protrusion 114 as depicted in FIG. 21, this embodiment allows the downward exercise of the rear part of the lever 3 by the frontward motion of the foothold 11.

Of course, the exercise loading unit 100 of the embodiment of FIGS. 18 to 21 can be applied to the other aforementioned embodiments.

Turning to 22 and 23 showing another embodiment of the exercise loading unit 100 of this invention. In this embodiment, the unit 100 comprises a so-called torsion bar type loading unit.

If described in detail, the loading unit 100 comprises an actuation rod 120, having a locking protrusion 118 at its rear end, provided at the rear part of the lever 3. In addition, the actuation rod 120 is received by the turning support 5 in order to allow the front end of the actuation rod 120 to turn upwards and downwards. At a side of the turning support 5, an elastic member 126 is provided between a stationary block 122 and a movable block 124. In addition, a stationary block 122 and the movable block 124 of a load generator 134, which are formed with through holes 128 and 130 and a locking through hole 132, respectively, are mounted at the side of the turning support 5. The actuation rod 120 is inserted into and engages with the load generator 134 such that the locking protrusion 118 of the rod 120 engages with the locking through hole 132 of the movable block 124 and the opposite end of the rod 120 is connected the rear end of the lever 3. In this state, when the front end of the lever 3 turns upwards and downwards about the turning support 5, the actuation rod 120 also turns together with the turning of the lever 3, and this causes the movable block 124 engaging with the locking protrusion 118 of the rod 120 to rotate at the same time. The rotation of the movable block 124 causes the elastic member 126 to be twisted and, as a result, it is possible to provide exercise loading force generated by the elastic member 126.

Figure 22:
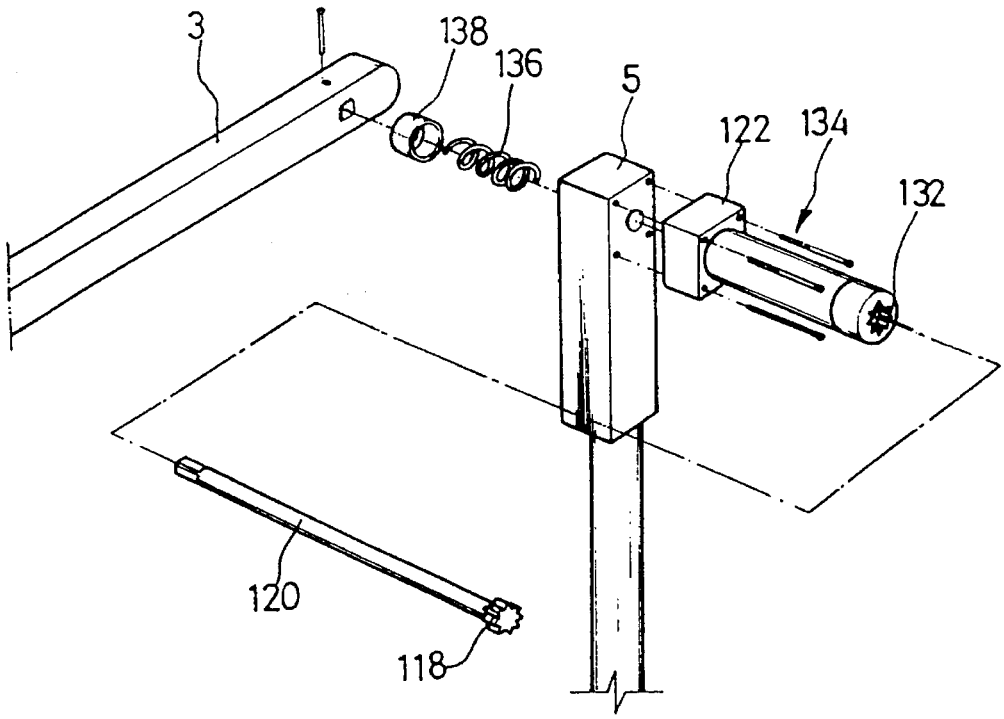
Figure 23:
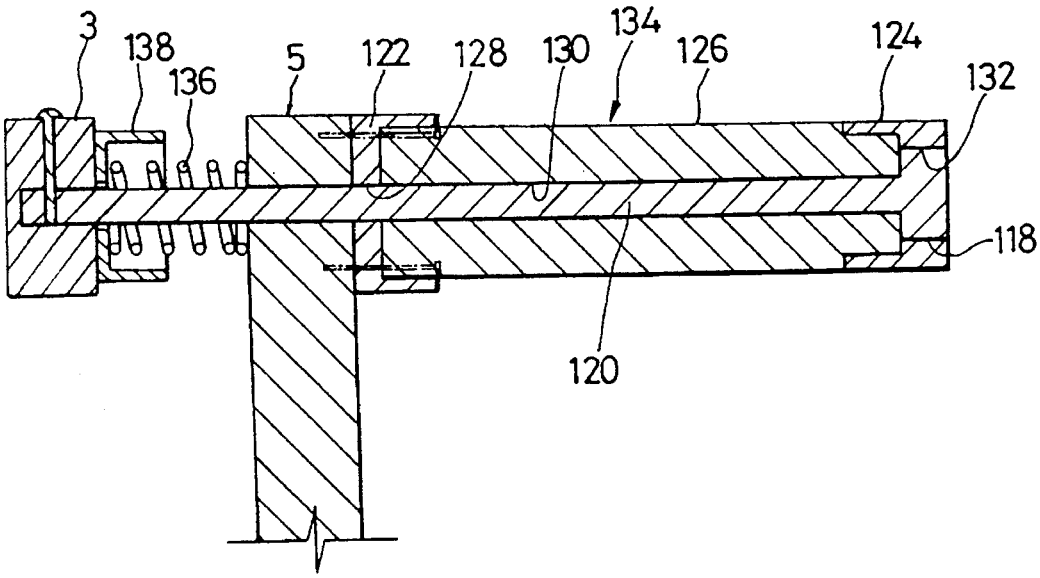
Figure 24:
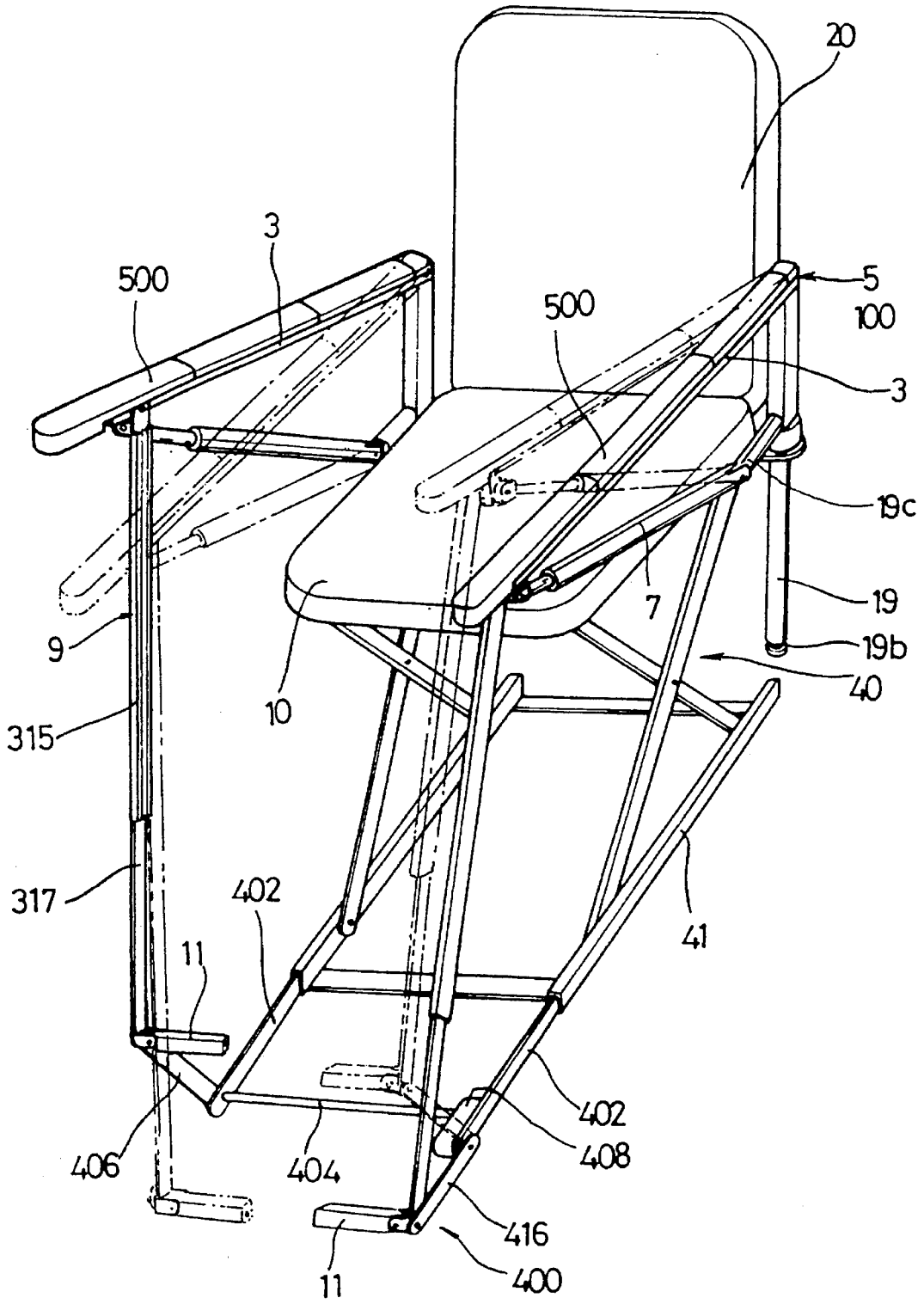

In addition, a spring 136 is provided between the lever 3 and the turning support 5. Here, the locking protrusion 118 of the rod 120 and the locking through hole 132 of the movable block 124 may be constructed to be star-shaped as depicted in FIG. 22 or to have other shape, respectively. The locking protrusion 118 and the locking through hole 132 easily engage with each other in the longitudinal direction and are stably locked to each other and, as a result, cause the actuation rod 120 to be locked to the movable block 124 in the rotational direction of the actuation rod 120. Here, when the lever 3 is forced toward the load generator 134, the locking protrusion 118 escapes from the locking through hole 132 of the movable block 124. Also, when the force applied to the lever 3 is released after the lever 3 is rotated at an angle together with the actuation rod 120, the actuation rod 120 is returned to its initial position, i.e., its engaging position, due to the restoring force of the spring 136. This makes the locking protrusion 118 of the rod 120 engage with the locking through hole 132 of the movable block 124. In this regard, it is possible to change the angular position of the lever 3. In the drawings, the reference numeral 138 denotes a spring.

Referring next to FIGS. 24 to 35 showing another embodiment of this invention, the exercise device of this invention can be applied to a conventional body support unit 1, comprising the seat plate 10, the back plate 20 and a seat plate leg unit 40.

If described in detail, the leg unit 40 is constructed such that an extendable rod 402 is received by the front end of the lower frame 41, a seesaw mechanism 400 is provided at the front end of the extendable rod 402. In addition, the exercise loading unit 100 is inserted into a fixing mount 200 provided at a lower part of the seat plate 10. The foothold 11 of the leg support unit 300 provided at the front end of the lever 3 is mounted to the seesaw mechanism 400. Particularly, in this embodiment, the knee support unit 500, position of which is changeable between two functions, i.e., an arm support function in the case of normal position and a knee support function in the case of exercise position, is provided above the lever 3.

As shown in FIGS. 24 to 27, the seesaw mechanism 400 is constructed such that its rotation shaft 404 passes through the extendable rod 402 to cause an end thereof to be connected to a connection link 406. The other end of the rotational shaft 404 is connected to an inner gear 410 in a gear box 408 fixed on the extendable rod 402. A segment gear 412 gearing with the inner gear 410 has a rotational shaft 414 which passes through the extendable rod 402 to be connected to a connection link 416. The connection of the foothold 11 to this seesaw mechanism 400 is achieved by inserting an end of a reciprocating actuator 339 of the foothold 11, which will be described below, into a mount hole provided at a side of the connection link 406.

The turning support 5 of the exercise loading unit 100 comprises a support rod 19 which has a middle stepped portion 19*a* and a lower locking annular groove 19*b*. This support rod 19 is received in an engagement hole 202 of the fixing mount 200. At a side of the fixing mount 200, a mounting hole 204 is provided for mounting a locking mechanism 212 in such a manner that a locking protrusion 206, a spring 208 and a headless bolt 210 are received in the mounting hole 204 in order. Thanking for such a construction, when the support rod 19 is raised, the locking protrusion 206 engages with the locking groove 19*b* of the support rod 19 and this allows the ascending position of the support rod 19 to be maintained.

The lever 3 of the exercise loading unit 100 comprises a hollow lever of which the front end detachably receives an auxiliary lever 50. The lever 3 is also provided with a plurality of through holes 52 and, as a result, this lever 3 is adjustable in its length by adjusting a control knob 60 provided thereto. In addition, an engagement protrusion 54 is provided at a side of the auxiliary lever 50 and a protrusion 56 having an engagement hole 56*a* is provided at a rear side of the lever 3.

In this embodiment, the leg support unit 300 comprises the connection member 9 and the foothold 11. Here, the connection member 9 includes a connection bar 315 and a length adjusting bar 317. The connection bar 315, which is provided with a plurality of length adjusting through holes 319, has an engagement hole 321 at an end thereof. The length adjusting bar 317 is provided with an adjusting knob 60 at an end thereof and a pair of engagement protrusions 323 at the other end thereof. This length adjusting bar 317 is slidably received in the connection bar 315 in order to allow the length of the connection member 9 to be adjustable. An end of the foothold 11 is rotatably inserted on the engagement protrusion 323. The connection bar 315 is connected to the engagement protrusion 54 of the auxiliary lever 50 through the engagement hole 321 of the bar 315. This connection state is maintained by a snap ring 325.

Figure 30:
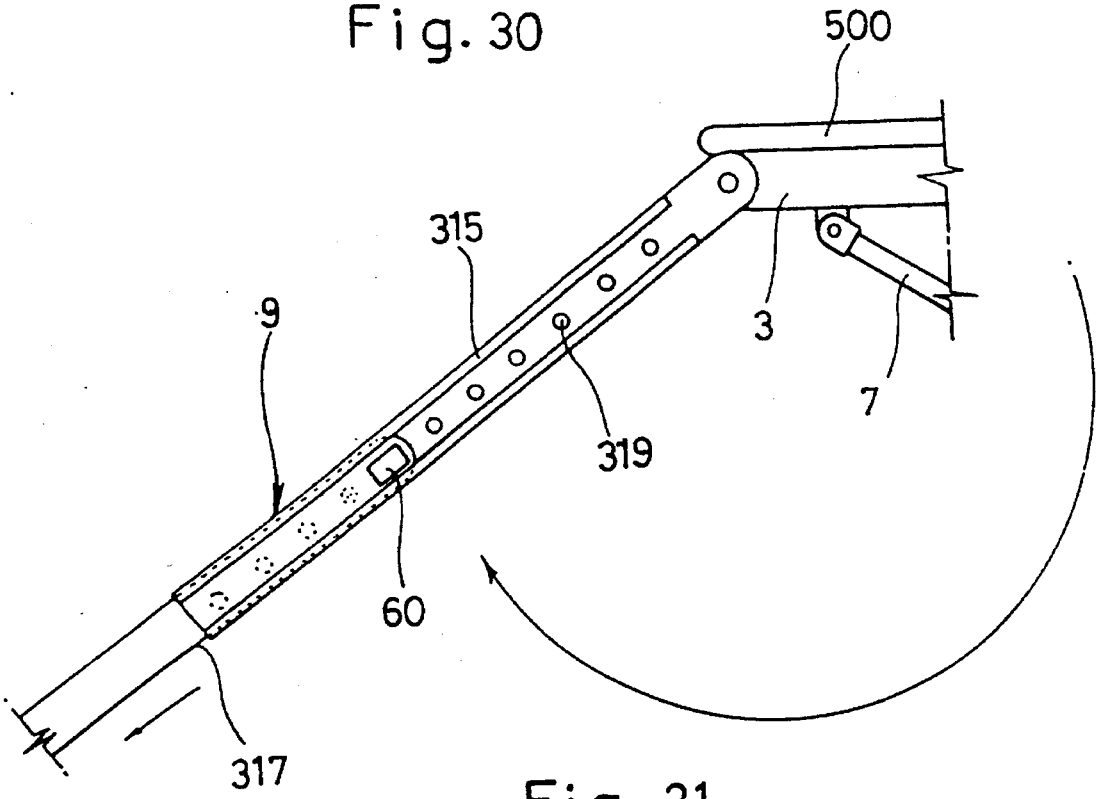
Figure 31:
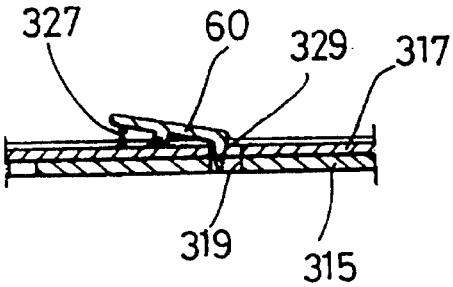

At this time, the adjusting knob 60 is provided at a side end of the length adjusting bar 317 as depicted in FIGS. 30 and 31. This knob 60 is provided with a spring 327 at an end thereof and an engagement protrusion 329 at the other end thereof. Thanking for such a construction, this engagement protrusion 329 engages with one of the length adjusting through holes 319 of the connection bar 315 in the case of normal state. However, when it is required to adjust the length of the connection member 9 by moving the length adjusting bar 317, the end of the adjusting knob 60 is forced to allow the engagement protrusion 329 to escape from the through hole 319. At this state, the length adjusting bar 317 is shifted to a desired position and, thereafter, the force applied to the end of the knob 60 is released in order to cause the engagement protrusion 329 to be inserted into one of the length adjusting through holes 319. This maintains the elongated position of the connection member 9. Here, the adjusting knob 60 of the lever 3 has the same construction as that of the aforementioned adjusting knob 60 of the length adjusting bar 317.

Figure 28:
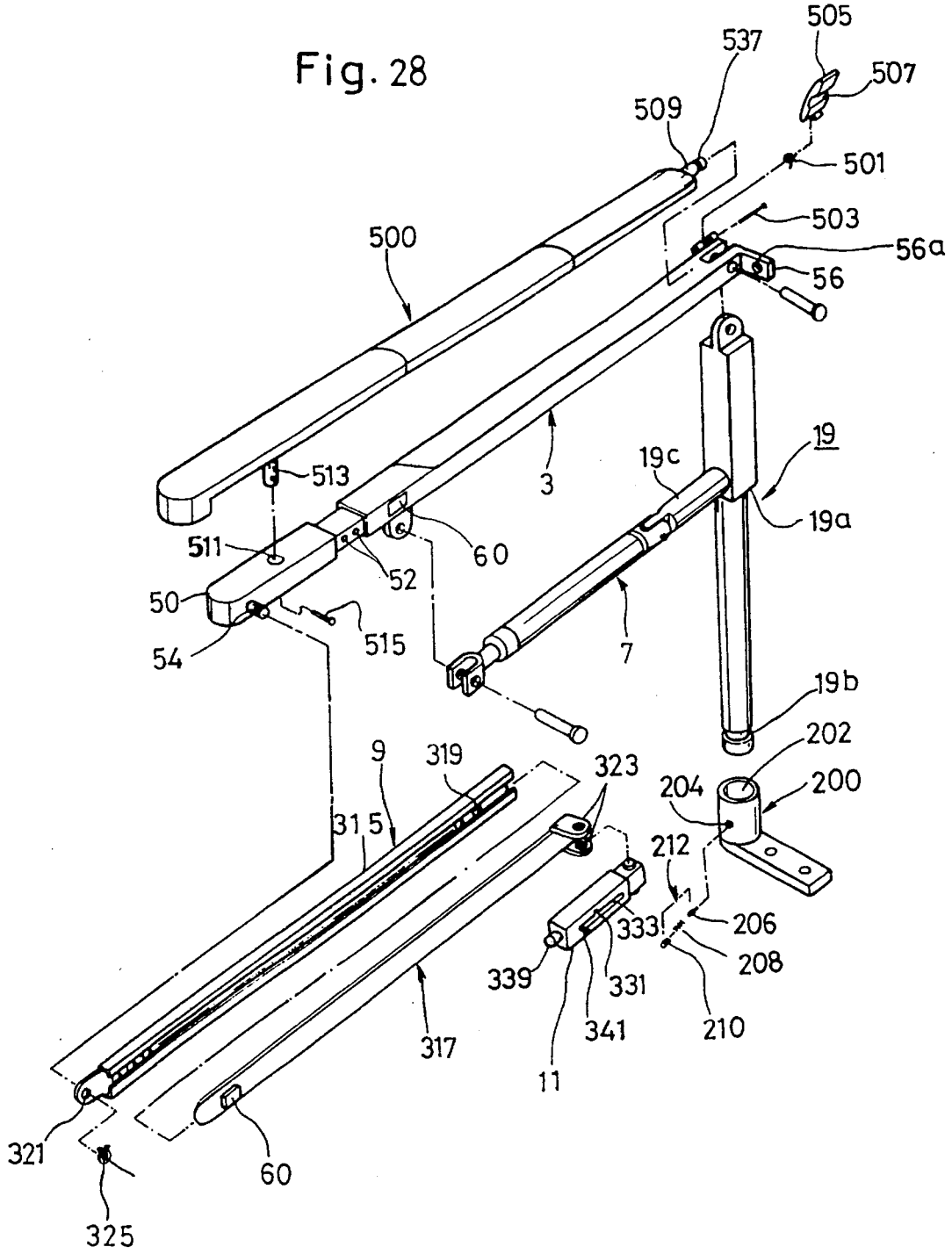
Figure 29:
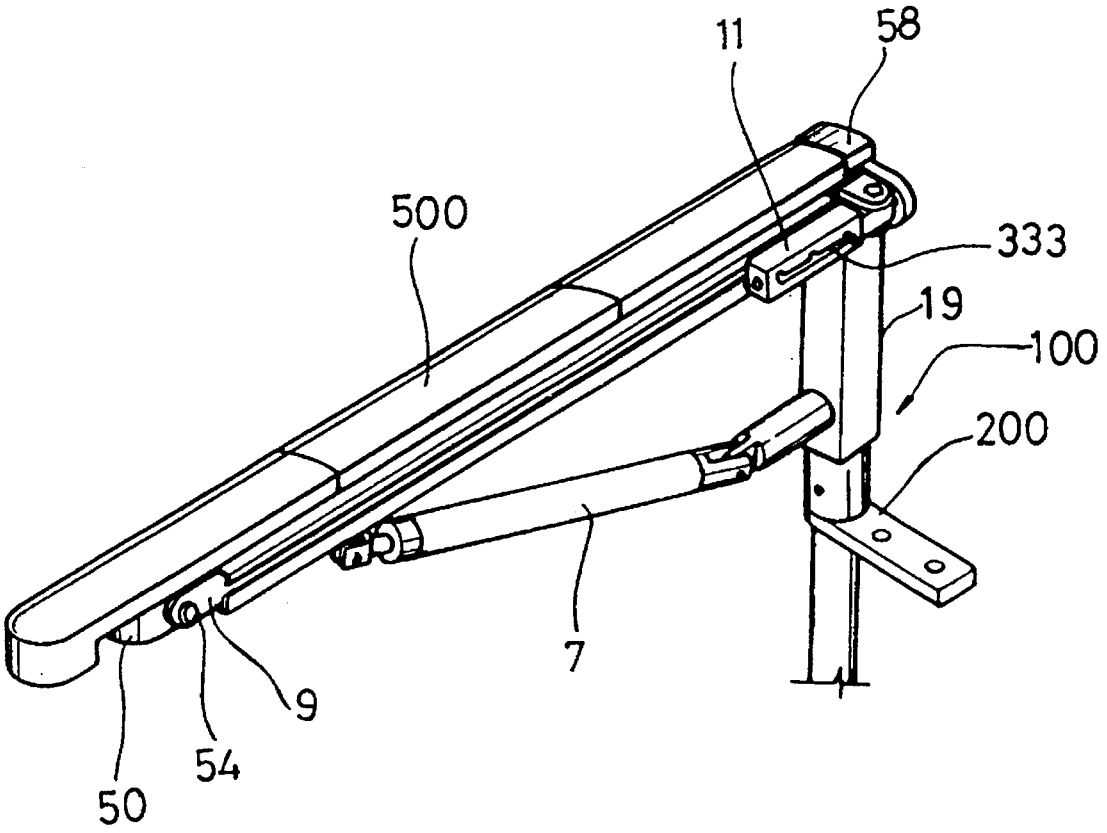
Figure 32:
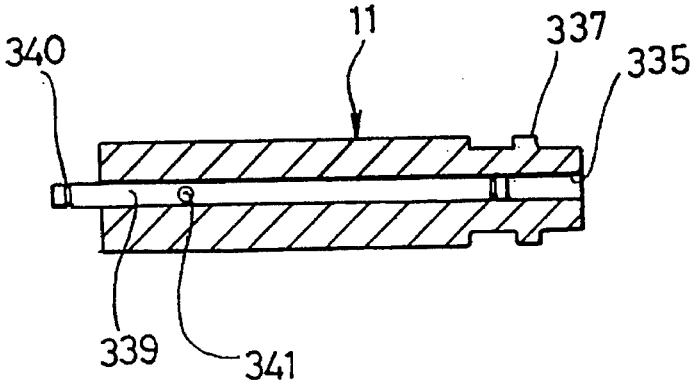
Figure 33:
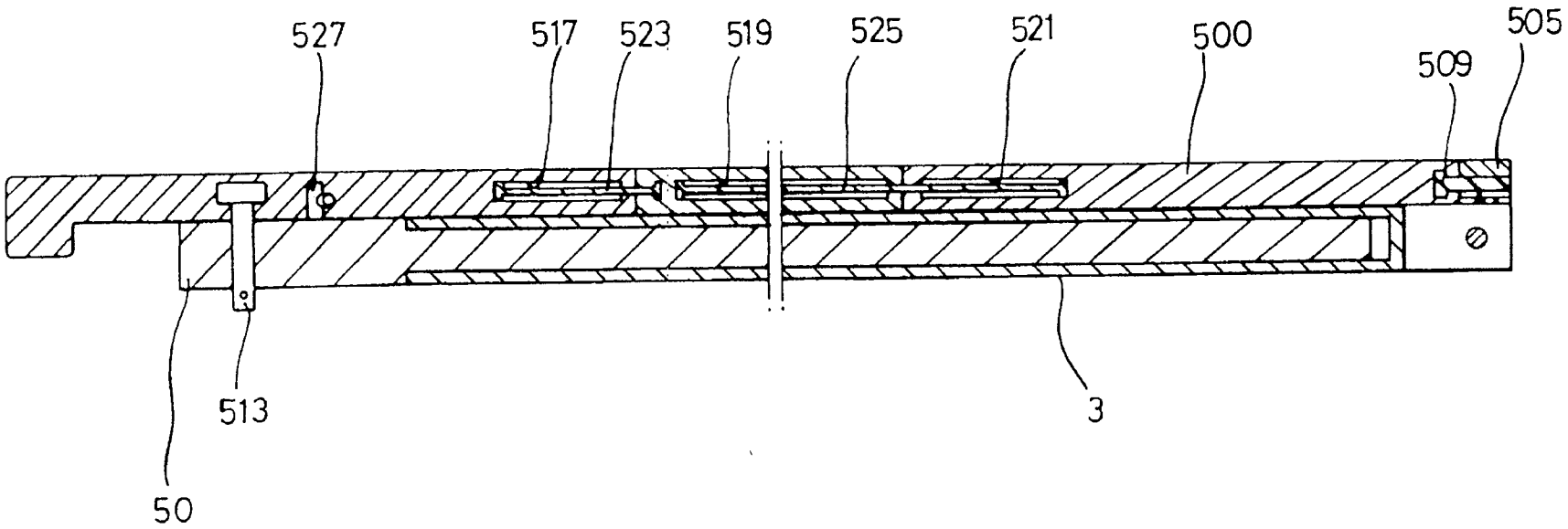
Figure 40:
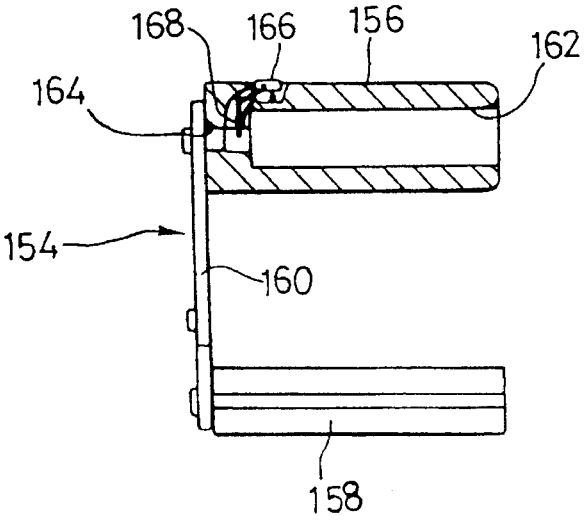
FIG. 40 is a sectional view of an ankle support of the leg support unit of FIG. 39.

As depicted in FIGS. 28, 29 and 32, the foothold 11 is formed with a longitudinal groove 333 having a slot 331, and provided with a center through hole 335 communicating with the longitudinal groove 331. At an outside end of the foothold 11, a pair of engagement protrusions 337 are provided. A reciprocating actuator 339 provided with an engagement annular groove 340 at an end thereof is inserted in the center through hole 335. In addition, this actuator 339 is provided with a vertical adjusting lever 341 at an end part thereof. Thanking for such a construction, when the actuator 339 is shifted, by using the adjusting lever 341, in a direction with respect to the longitudinal groove 333, an end of the actuator 339 protrudes out of an end of the center through hole 335. In normal state, the length adjusting bar 317 is received in the connection bar 315 as depicted in FIGS. 28 and 29, and the protruded end of the actuator 339 is inserted in the engagement hole 56a of the auxiliary lever 50. However, in abnormal state, the connection bar 315 and the length adjusting bar 317 are stretched as depicted in FIG. 40 in order to allow an end of the actuator 339 to engage with the connection links 406 and 416 of the seesaw mechanism 400.

As shown in FIGS. 28, 29, 33, 34 and 35, the knee support unit 500 is constructed such that in normal state, its fixing protrusion 509 engages with an engagement groove 507 of a fixing cover 505 which is elastically hinged to the rear end of the lever 3 by using a spring 501 and a hinge pin 503. In the state, an engagement 513 of the unit 500 is received in an engagement hole 511 of the auxiliary lever 50. This engagement state is maintained by a pin 515 and functions as the arm support member.

Figure 34:
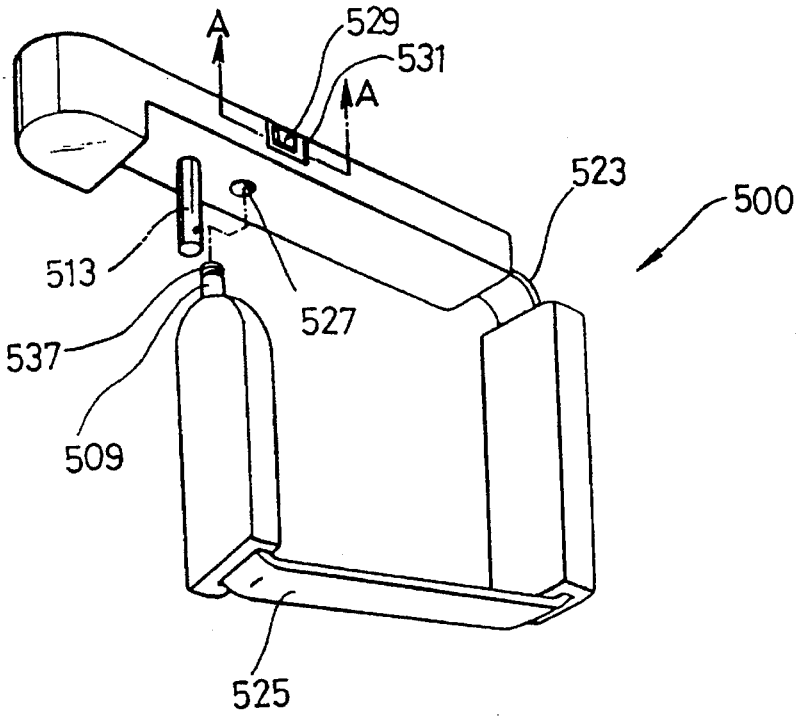
Figure 35:
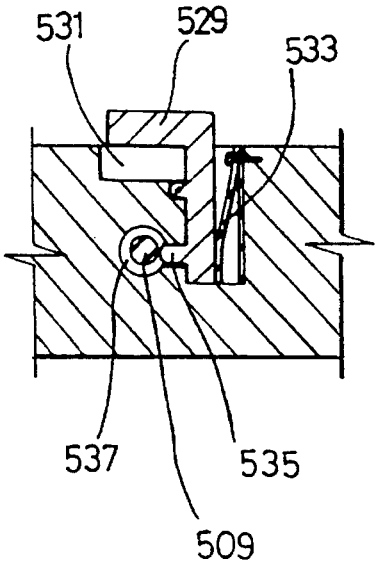

This knee support unit 500 is constructed to have a multistepped construction and is provided with a plurality of band receiving holes 517, 519 and 521 for receiving individual length adjusting bands 523 and 525. In addition, an engagement hole 527 and a fixing knob 529 are provided. Hence, when it is required to change the function of the unit 500 into the knee support member, this unit 500 is rotated about the engagement protrusion 513 and the length adjusting bands 523 and 525 are taken out as depicted in FIG. 34. At this state, the fixing protrusion 509 is inserted into the engagement hole 527 and the fixing knob 529 is controlled in order to fix the engagement state. This allows the unit 500 to function as the knee support member.

At this time, the fixing knob 529 is elastically inserted into a mounting hole 531 of the unit 500 by employing a spring 533 in such a manner that a locking protrusion 535 of the knob 529 moves with respect to the engagement groove 527. In this regard, when the fixing protrusion 509 is inserted into or escapes from the engagement groove 527, the locking protrusion 535 of the knob 529 is locked to or escapes from the locking slot 537 of the fixing protrusion 509.

Figure 25:
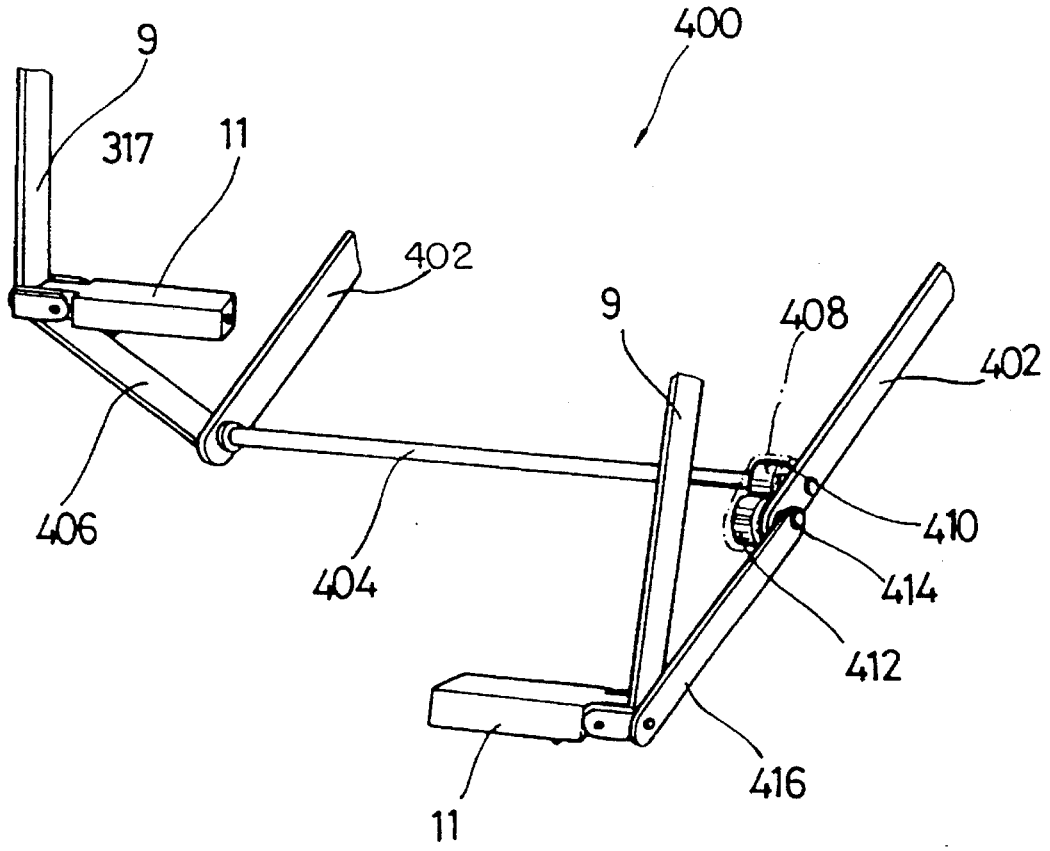
Figure 26:
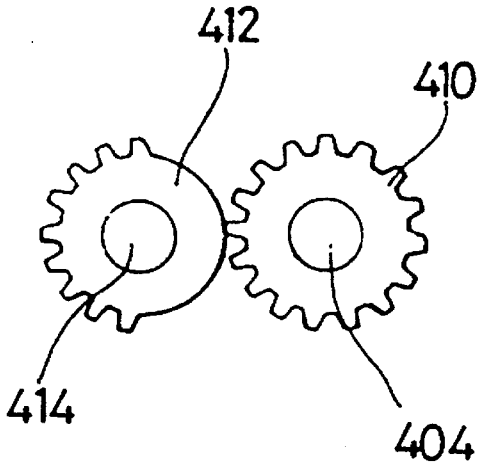
Figure 27:
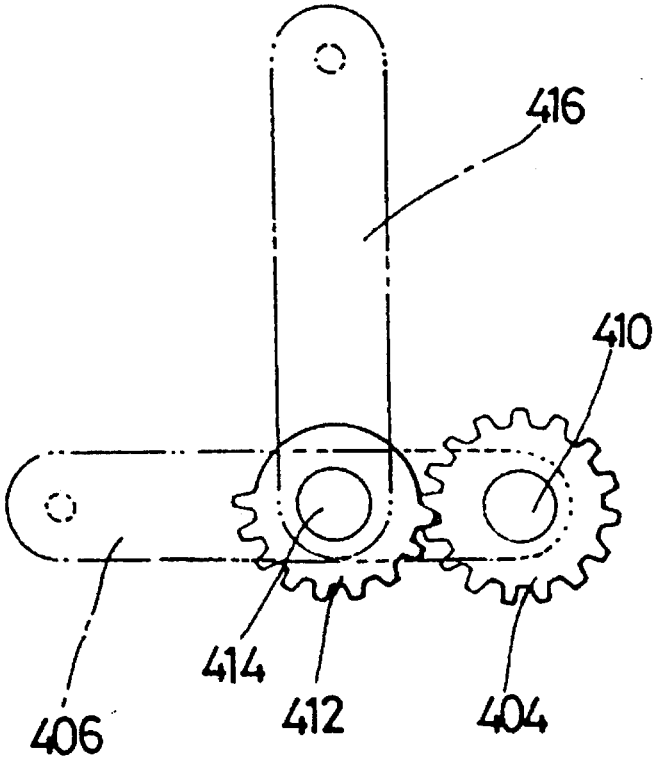

At this state, when the user, sitting on the seat plate 10 as laying his feet on the footholds 11, throws the strength into one of his feet in order to force one of the footholds 11 forwards, the connection link 406 moves downwards centering around the rotational shaft 404 as depicted in FIGS. 25 to 27. This causes the rotational shaft 404 to rotate along with the gear 410 and this makes the segment gear gearing with the above gear 410 rotate in the opposite rotational direction. In accordance, the connection link 416 rotates in order to ascend and this causes the other of the footholds 11 to ascend at the same time. The seesaw movement of the footholds 11 is, therefore, achieved.

On the other hand, when the footholds 11 are rotated in a direction opposite to the aforementioned forcing direction, the engagement state of the gear 410 and the segment gear 412 is released and, as a result, the segment gear 412 does not cooperate with the gear 410.

Figure 36:
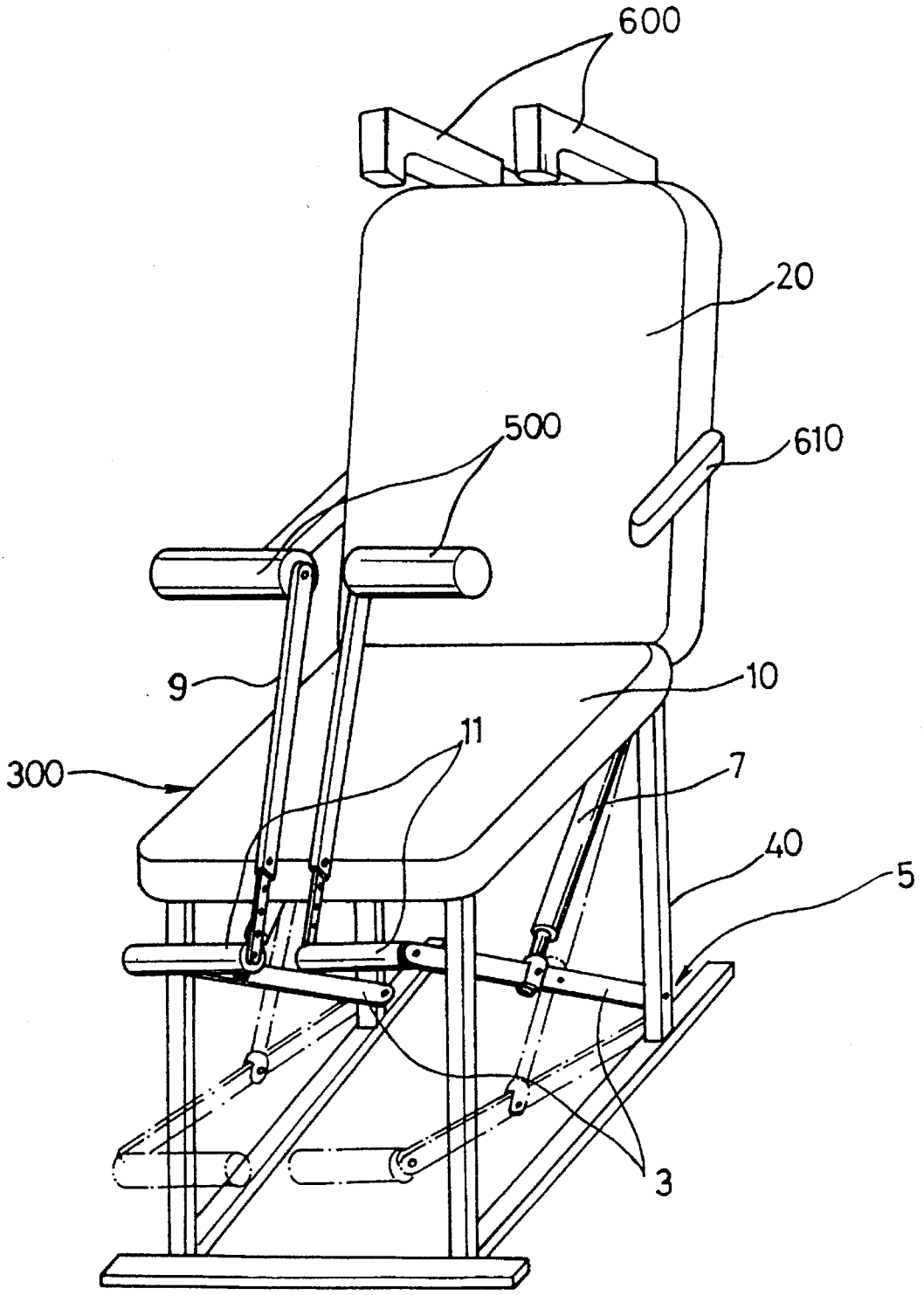
FIG. 36 is a perspective view of a fourteenth embodiment of an exercise device of this invention.

Referring next to FIG. 36 showing another embodiment of this invention, the body support unit 1 comprises a conventional chair type unit including the seat plate 10 provided with the leg unit 40 at its lower part and the back plate 20 provided at the rear part of the seat plate 10. This embodiment includes a pair of auxiliary arm support members 610 at opposite sides of the back plate 20 and a pair of hanger type reaction restraining members 600. The knee support 500 is provided at the upper front of the leg support unit 300. The exercise loading unit 100 is constructed such that the turning support 5 is provided on the leg unit 40 at the rear part of the lever 3. An end of the lever 3 is rotatably mounted on the turning support 5 in order to cause the front end of the lever 3 to turn upwards and downwards. In addition, the load generator 7 is connected between the front portion of the turning support 5 of the lever 3 and an upper portion above the turning support 5. The leg support unit 300 having the footholds 11 and the connection member 9 is provided between the front end of the lever 3 and the knee support unit 500. Thanking for such a construction, this embodiment allows the user to carry out the upward and downward exercise by using the knee support unit 500 and the leg support unit 300.

Figure 37:
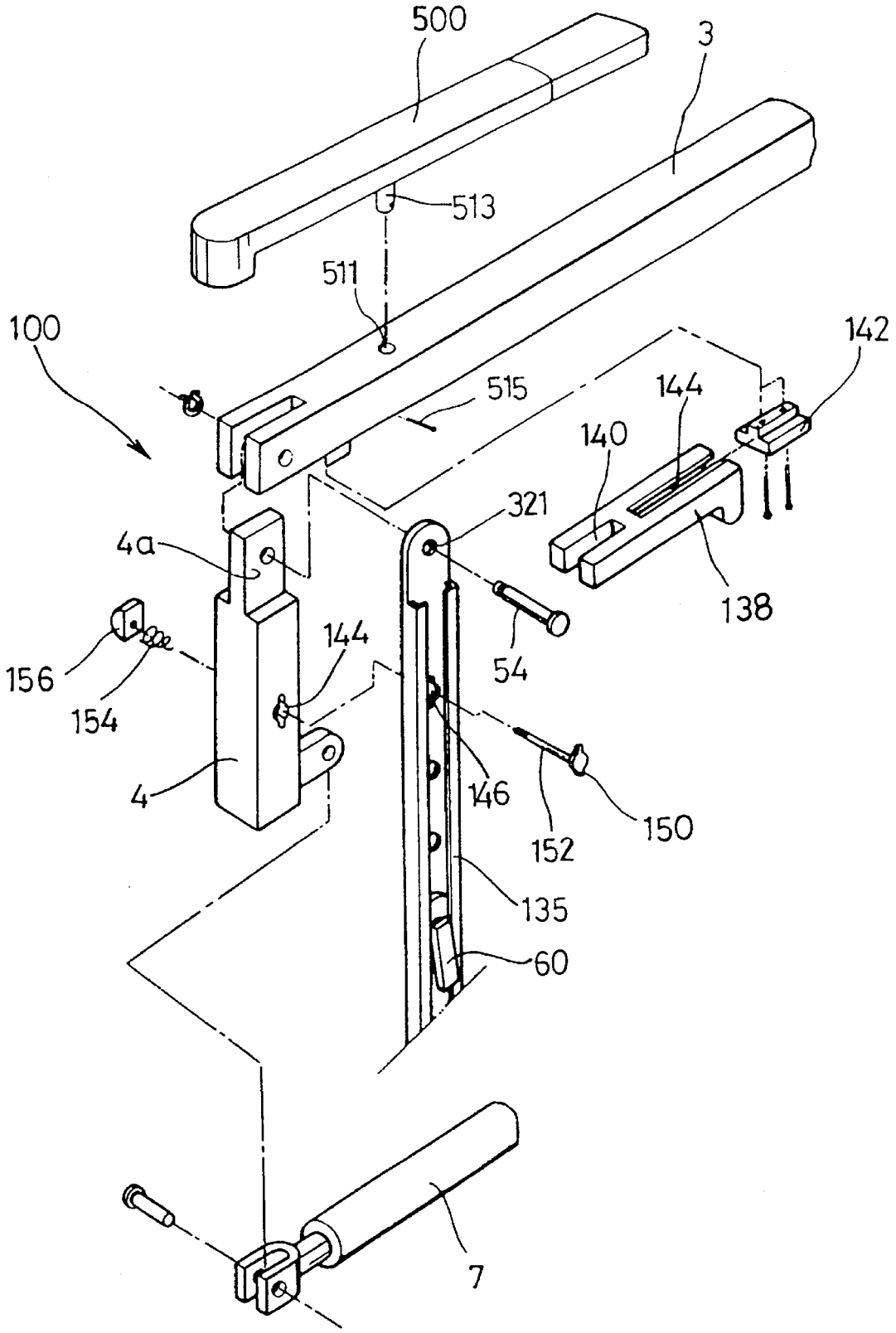
FIG. 37 is an exploded enlarged perspective view of another embodiment of an exercise loading unit of the exercise device of this invention.

Turning to FIG. 37, there is shown another embodiment of a loading unit 100 of the present invention. FIGS. 38 to 41 show another embodiment of an exercise device of this invention combined with the exercises loading unit 100 of FIG. 37, respectively.

As shown in FIG. 37, the exercise loading unit 100 includes an auxiliary link 4 which is provided between the front end of the lever 3 and the front end of the load generator 7. In addition, a stopper 138 is provided under the front part of the lever 3 in such a manner that this stopper 138 engages with the auxiliary link 4 or is retracted from the link 4 in order to be separated therefrom.

At this time, the stopper 138 is formed with an engagement slot 140 at its front part for engaging with an engagement end **4*a* of the auxiliary link 4. This stopper also includes a longitudinal guide groove 144 at its rear part for engaging with a guide 142 fixed to the lower part of the lever 3. In this respect, when the stopper 138 engages with the engagement end 4a of the auxiliary link 4 between the lever 3 and the link 4, the engagement of the lever 3 with the auxiliary link 4 is achieved. On the contrary, when the stopper 138 is retracted from the auxiliary link 4 in order to escape therefrom, link type engagement of the lever 3 with the auxiliary link 4 is achieved and, as a result, the lever 3 and the auxiliary link 4** are able to turn with respect to each other.

Figure 38:
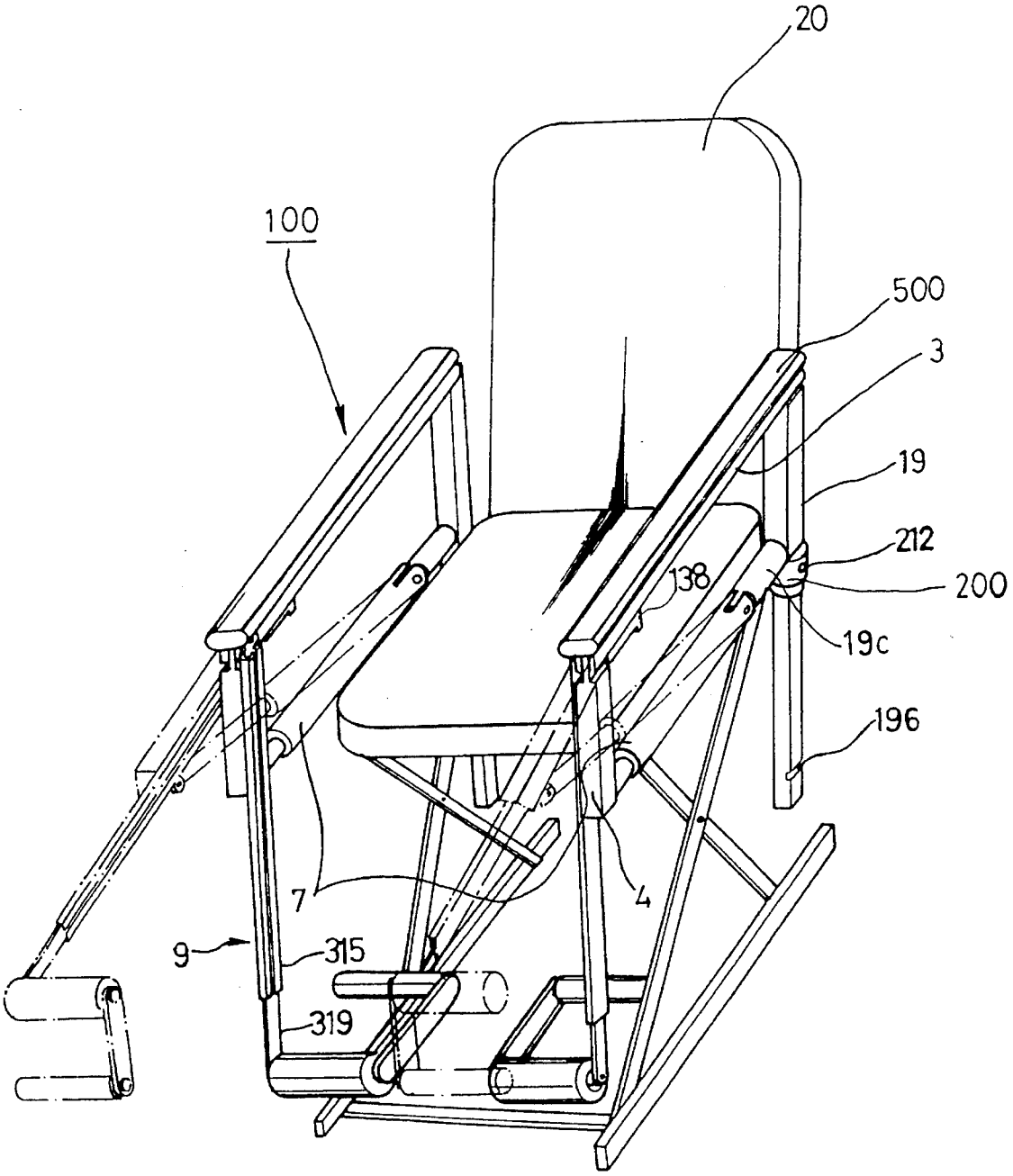
FIG. 38 is a perspective view of a fifteenth embodiment of an exercise device of this invention combined with the exercise loading unit of FIG. 37.
Figure 39:
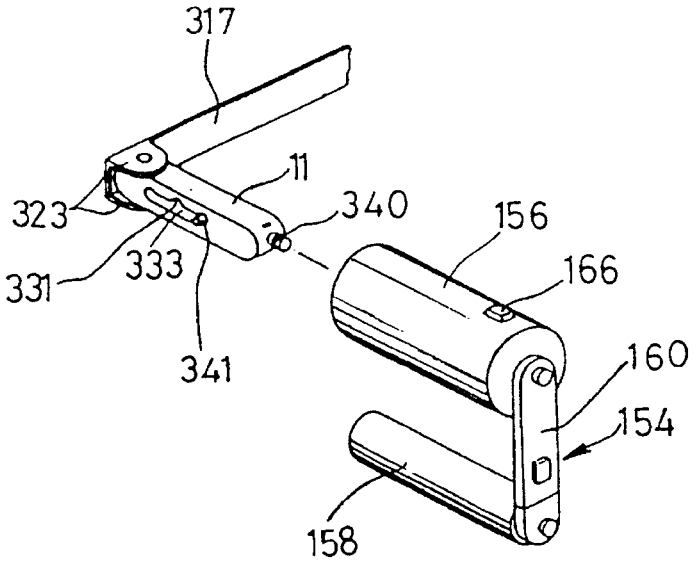
FIG. 39 is an exploded enlarged view of another embodiment of a leg support unit of the exercise device of this invention.
Figure 41:
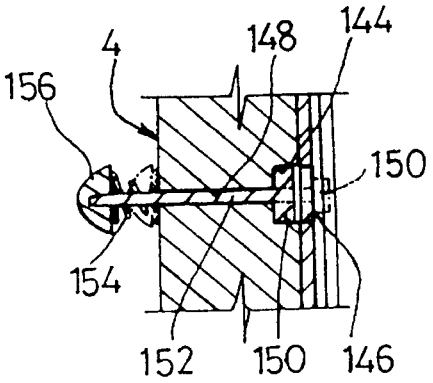
FIG. 41 is an enlarged sectional view showing engagement of an auxiliary link with a foothold connection member of the exercise loading unit of FIG. 37.

In addition, both the auxiliary link 4 and the connection bar 315 are provided with individual mounting holes 144 and 146 having individual rounded center parts. The auxiliary link 4 is formed with a through hole 148 shown in FIG. 41 communicating with the mounting hole 144 of the auxiliary link 4. In the mounting holes 144 and 146, a reciprocating actuator 152 having a head 150 of the same configuration as that of the holes 144 and 146, a biasing spring 154 and a fixing nut 165 are elastically received in order. Here, as depicted in FIGS. 38 and 41, the connection bar 315 and the length adjusting bar 317 are provided in a stretched state. However, when it is required to engage the connection bar 315 with the auxiliary link 4 in order to make these members 4 and 315 be in an integrated state, the reciprocating actuator 152 is forced in order to insert the head 150 of the actuator 152 into the mounting hole 146 of the connection bar 315. Thereafter, the actuator 152 is rotated at an angle of 90°. Hence, the head 150 of the actuator 152 is prevented from escaping from the mounting hole 146 and this achieves the desired engagement state of the connection bar 315 with the auxiliary link 4.

As depicted in FIG. 38, the exercise loading unit 100 may be applied to the exercise device of this invention. In this embodiment of FIG. 39, a pair of ankle support members 154 are rotatably connected to the footholds, respectively. Hence, this embodiment provides frontward and backward exercise for the user.

Here, each of the ankle support members 154 comprises a cylindrical top foot support 156, which is adapted for supporting the top of the foot and engages with the foothold 11, and a cylindrical heel support 158 and a connection bar 160 for connecting the two members 156 and 158 to each other.

As shown in FIG. 40, the top foot support 156 is provided with an engagement hole 162 and a fixing hole which communicate with each other. This support 156 further includes a release knob 166. In result, when the foothold 11 is inserted in the support 156, the body of the foothold 11 engages with the engagement hole 162 of the support 156 and the reciprocating actuator 339 provided with a locking groove 340 engages with the fixing hole 164. In this case, a fixing protrusion 168 of the release knob 166 detachably engages with the locking groove 340 of the actuator 339, and this achieves the engagement state of the ankle support member 154 with the foothold 11. However, the release of the engagement state of the members 11 and 154 is simply achieved by forcing the release knob 166.

In exercising by using the exercise device of FIG. 38, the user lays his feet on the ankle support members 154, respectively, and throws the strength into the ankles and the knees in order to cause all of the length adjusting bar 317, the connection bar 315 and the auxiliary link 4 to move frontward-upward and backward-downward. Hence, the load generator 7 generates loading force and, in this respect, the user develops and conditions his lower body. In this case, the connections between the lever 3 and the auxiliary link 4, between the auxiliary link 4 and the load generator 7, and between the load generator 7 and the support member 19*c* which is mounted on the support rod 19 of the turning support 5 achieve link motions, respectively.

Figure 42:
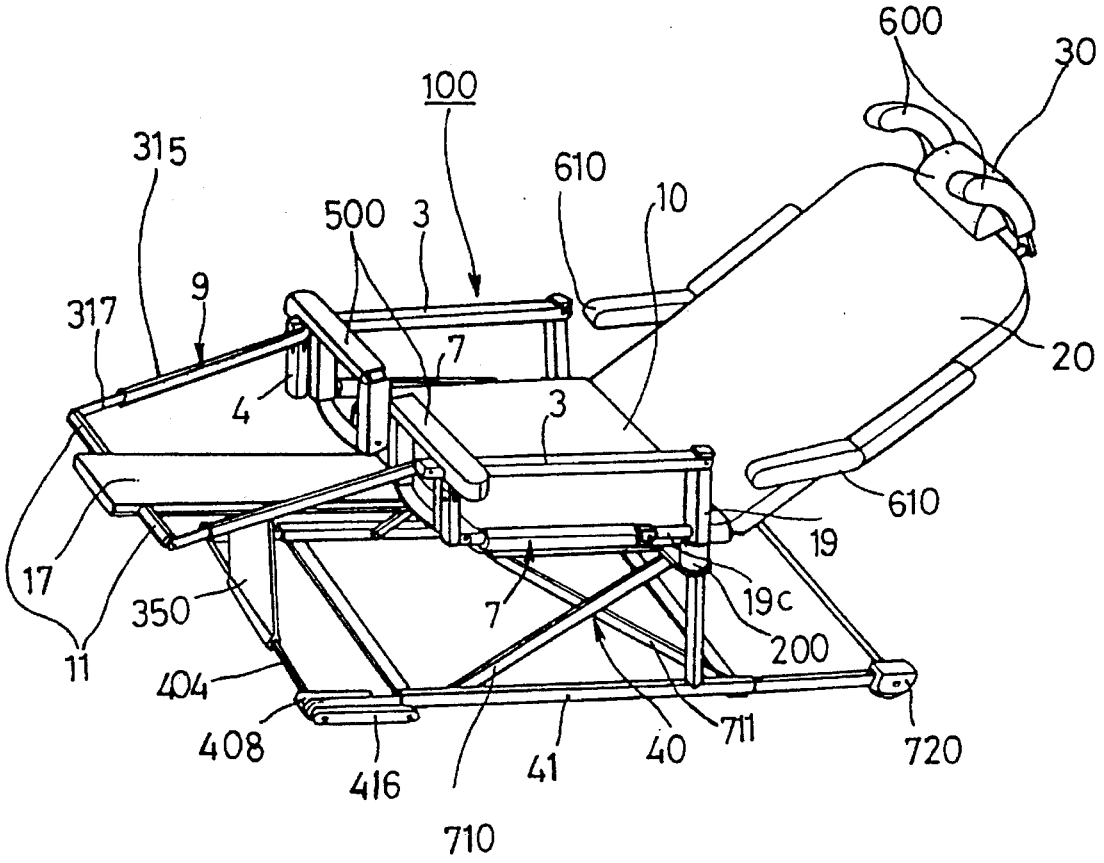
FIG. 42 is a perspective view of a sixteenth embodiment of an exercise device of this invention combined with the exercise loading unit of FIG. 37.

Turning to FIG. 42, there is shown still another embodiment of an exercise device of this invention combined with the exercise loading unit 100 of FIGS. 37 and 38. In this embodiment, the body support unit 1 has the conventional structure as described in the embodiment of FIG. 24. Otherwise stated, this unit 1 comprises the seat plate 10, the back plate 20 and the leg unit 40 provided under the seat plate 10. The back plate 20 is provided with the head support or the pillow 30, the reaction restraining members 600 and the auxiliary arm support members 610. In order to constitute the leg unit 40, the front part of the lower frame 41 of the seat plate 10 is provided with the seesaw mechanism 400. In addition, the exercise loading unit 100 is provided as inserted into the fixing mount 200 fixed to the lower part of the seat plate 10. The leg support unit 300 provided on the front part of the lever 3 is constructed such that a foothold support member 350 is mounted On a rotating shaft 404 at an end thereof and hinged to a lower surface of the additional foothold support 17 at the other end thereof. The rear part of the foothold support 17 is mounted on the lower surface of the seat plate 10 as inserted thereinto and opposite sides of the support 17 is connected to the footholds 11, respectively. At the rear part of the lower frame 41 of the seat plate 10, a pair of auxiliary legs 720 are provided in order to cooperate with an end of one 711 of a cross-shaped link mechanism comprising links 710 and 711 and, as a result, provides the back plate support member 700. Thanking for such construction, when the back plate 20 is opened with respect to the seat plate 10 and the height of the seat plate 10 is lowered, the auxiliary legs 720 are fully stretched backwards. As a result, this embodiment allows the user to stable carry out the exercise as laying on the opened body support unit 1.

Figure 43:
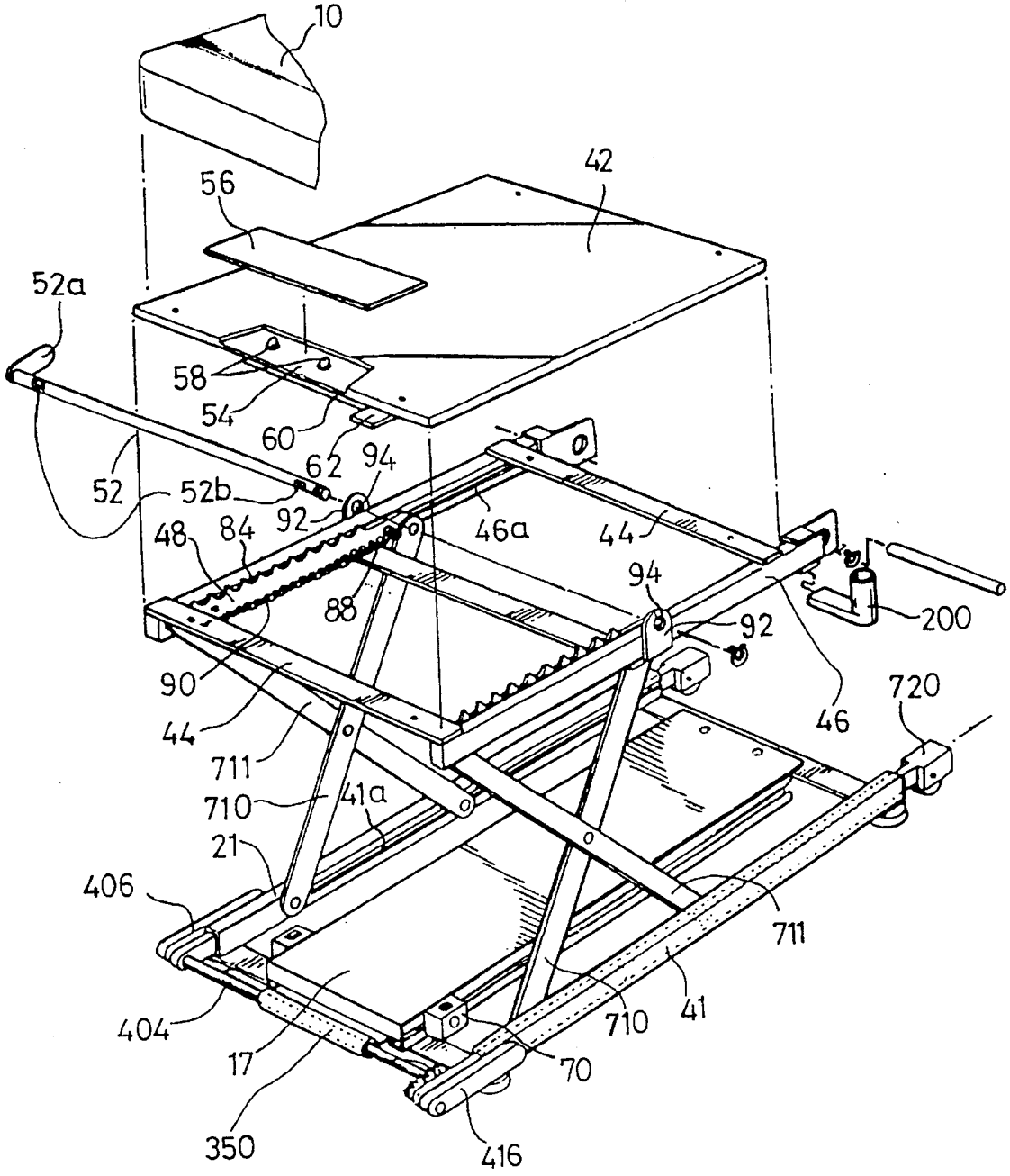
FIG. 43 is a partial exploded perspective view showing a structure of a lower part of a seat plate of the exercise device of FIG. 42.

As depicted in FIG. 43, a seat support plate 42 is mounted on the lower surface of the seat plate 10 and provided at the lower part thereof with an upper frame 46, which has a pair of lateral support bars 44 welded to the frame 46. The upper and lower frames 46 and 41 comprise hollow frames and longitudinal grooves 46*a* and 41*a*, respectively. These frames 46 and 41 are connected to each other by the X-links 710 and 711. Here, the link 710 is hinged to the lower frame 41 at its lower end and hinged at its upper end to a moving member 48 of a seat height control mechanism comprising the moving member 48 and a movement checking lever 52. However, the link 711 is hinged to the upper frame 46 at its upper end and hinged to the auxiliary leg 720 at its lower end.

At this time, the lower frame 41 is the hollow frame having the longitudinal groove 41*a* as described above. A longitudinal part of the auxiliary leg 720, which is hinged to the link 711, is slidably received in the hollow frame 41 such that the hinge part of the link 711 and the leg 720 moves forwards and backwards as guided by the longitudinal groove 41*a*.

Figure 44:
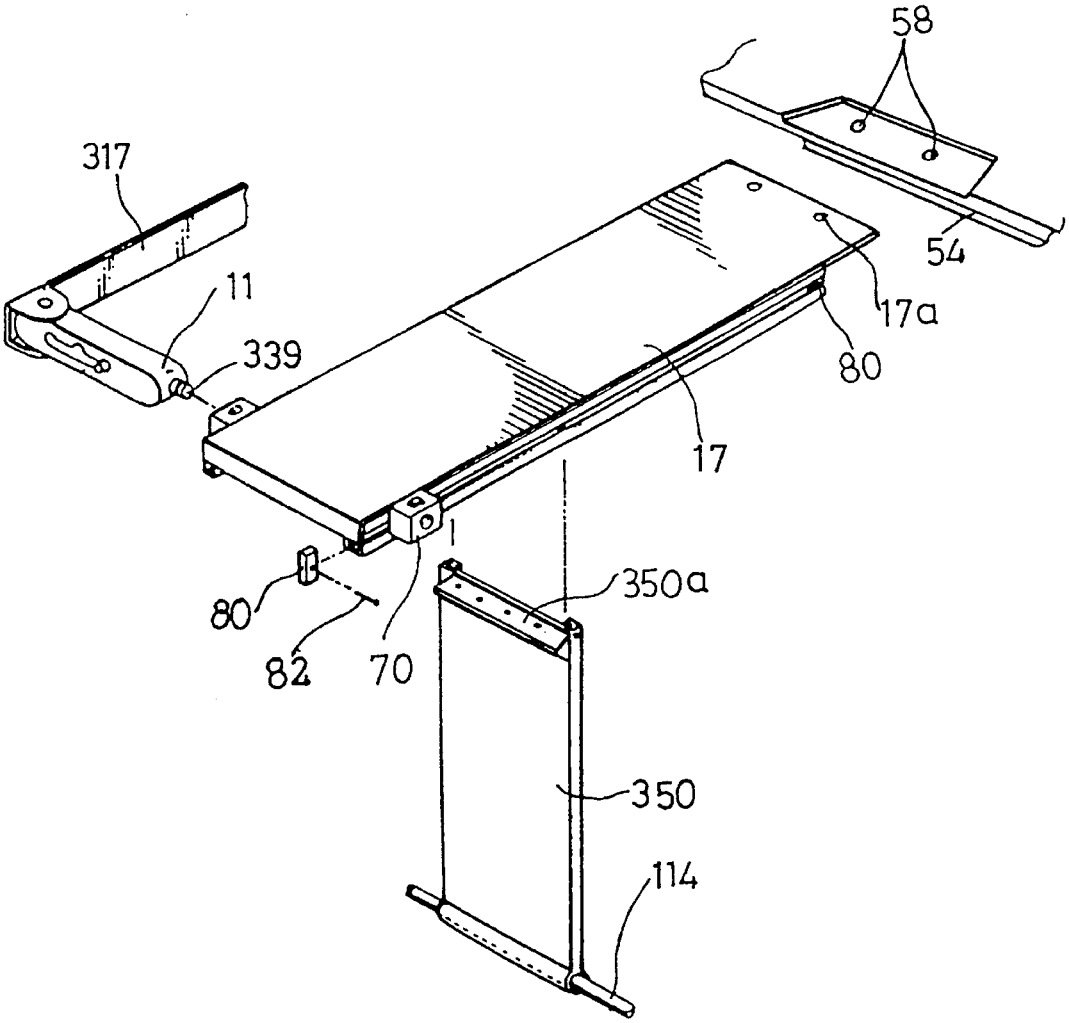
FIG. 44 is a partial exploded perspective view showing a structure of a leg support unit of the exercise device of FIG. 42.
Figure 45:
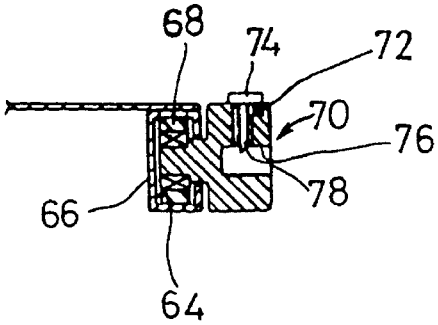
FIG. 45 is an enlarged sectional view of a foothold support member of the leg support unit of FIG. 44.
Figure 46:
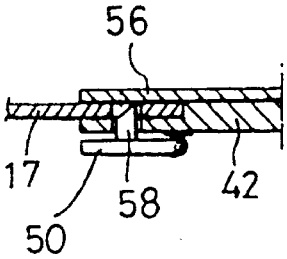
FIG. 46 is a partial enlarged sectional view of an engagement portion of the foothold support member of the leg support unit of FIG. 44.
Figure 47:
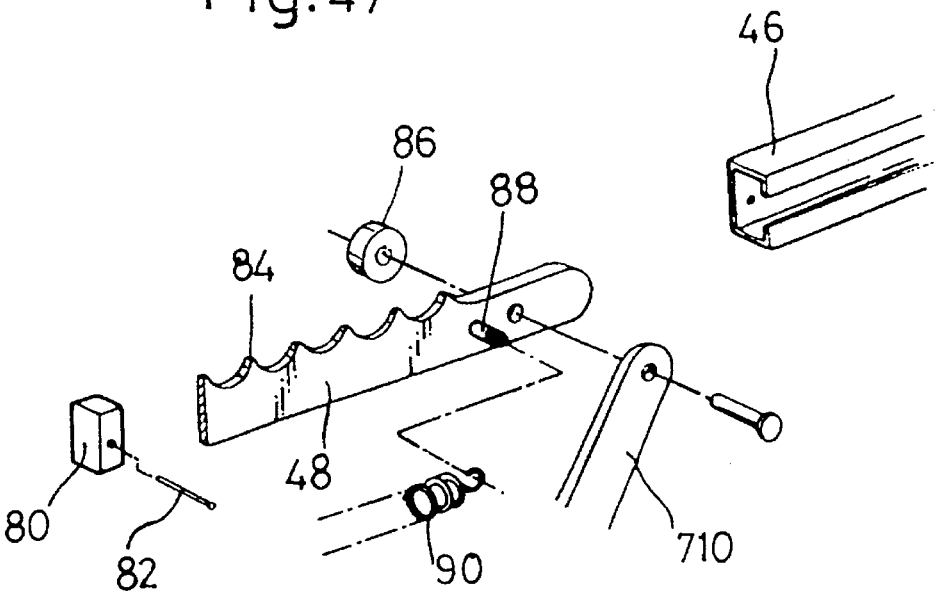
FIG. 47 is a partial enlarged exploded perspective view of a seat plate height control unit of FIG. 43.
Figure 48:
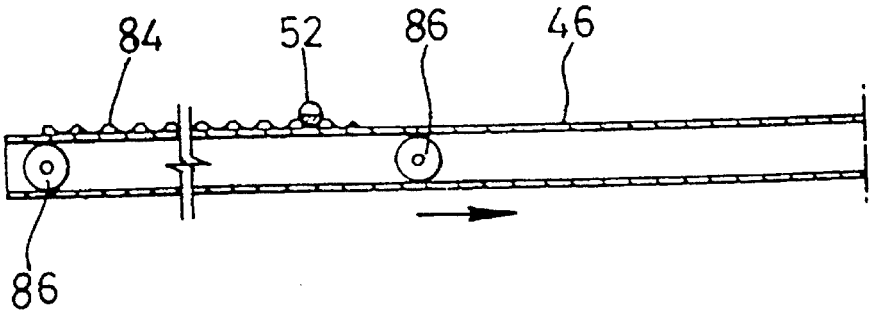
FIG. 48 is a sectional view of the control unit of FIG. after assembling.
Figure 49:
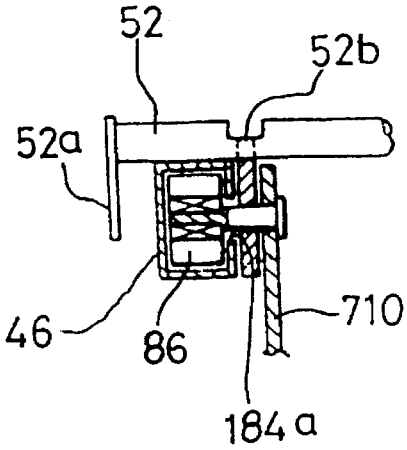
FIG. 49 is a sectional view of a roller of the control unit of FIG. 48.

The seat support plate 42 is provided, as depicted in FIGS. 43, 44 and 46, with a mount 54 for mounting an end of the foothold support 17. This mount 54 is depressed in order to be gently enlarged toward its free end and, as a result, allows the free end of the foothold support 17 to easily engage with this mount 54. In addition, a cover 56 is welded to the upper surface of the mount 54. The mount 54 also includes a pair of snap protrusions 58 having individual tapered heads. Each of these snap protrusions 58 is elastically supported by a biasing plate 60, hinged to the lower surface of the seat support plate 42, as biased by a spring member. This biasing plate 60 is provided with a handle 62 at its front end.

As shown in FIG. 44, the foothold support member 350, an end of which is connected to the rotational shaft 404, is connected at the other .end thereof to a lower surface of the foothold support 17 by employing a hinge 350*a*. On the other hand, the foothold support 17 is provided with a pair of engagement holes 17*a* at the end thereof. In this regard, when this support 17 is inserted into the mount 54, the snap protrusions 58 of the mount 54 engage with individual engagement holes 17*a* and this achieves the elastic engagement of the support 17 with the mount 54 as described in FIGS. 44 and 46. This foothold support 17 is provided with a pair of guide rails 66, having individual guide grooves 64, at opposite sides thereof. Each of the guide rails 66 cooperates with a foothold connection member 70 having a roller 68 which slides in the guide groove 64.

In addition, the foothold connection member 70 is provided with a fixing knob 74, which is biased by a tension spring 72 at a side thereof, and formed with a foothold connection hole 76. The fixing knob 74 has a tapered locking protrusion 78 which partially protrudes into the foothold connection hole 76 and allows the reciprocating actuator 339 of the foothold 11 to be inserted into the connection hole 76 and to be connected to foothold connection member 70. In the drawings, the reference numerals 80 and 82 denote a finishing member for blocking each end of the guide groove 64 of the guide rail 66 and a set screw for mounting the finishing member 80 on the guide rail 66, respectively.

The seat height control mechanism comprises the moving member 48 and the movement checking lever 52 as described above and as depicted in FIGS. 43 and 47 to 50. The moving member 48 is provided with wave-shaped teeth 84 at its upper part and rotatable rollers 86 which are mounted on both ends of the member 48 and received in the upper frame 46. In mounting the rollers 86 on the member 48 by using hinge pins, one of the rotatable rollers 86 is mounted on the member 48 together with the upper end of the link 710. At an end of the member 48 adjacent to the link 710, this member 48 is provided with a protrusion 88 which supports an end of a spring 90. The other end of this spring 90 is supported by the lateral support bar 44.

Figure 50:
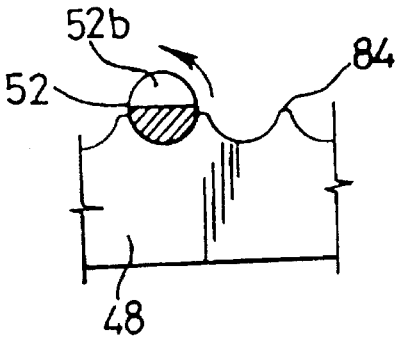
FIG. 50 is an enlarged sectional view showing the operation of the control unit of FIG. 48.

The movement checking lever 52 is inserted into an engagement hole 94 of a fixing member 92 mounted on the outside of the upper frame 46. This lever 52 is further provided with a handle 52*a* and formed with depression slots 52*b* each of which is aligned with the teeth 84 of the moving member 48. Hence, as depicted in FIG. 50, when the movement checking lever 52 is rotated, the height of the seat plate 10 is adjusted as desired thanking for the interrelation between the depression slots 52*b* of the lever 52 and the teeth 84 of both moving members 48.

If described in detail, when it is required to lower the seat plate 10, the movement checking lever 52 is rotated under the condition that the seat plate 10 is forced downwards. Hence, the lever 52 engaging with the teeth 84 of the moving members 48 causes the members 48 to move backwards and this makes the upper end of the link 710 along with the lower end of the link 711 move backwards and, as a result, reduces the height of the seat plate 10. At this time, the auxiliary legs 720 cooperating with the links 711 also move backwards in order to elongate their lengths. On the contrary, when it is required to raise the seat plate 10, the movement checking lever 52 is rotated in reversed direction under the condition that the downward force applied to the seat plate 10 is released. Hence, the lever 52 engaging with the teeth 84 of the moving members 48 causes the members 48 along with the links 710 and 711 to move forwards due to the restoring force of the spring 90. This increases the height of the seat plate 10. At this time, the auxiliary legs 720 return to their initial positions as moving frontwards and shorten their lengths.

Here, the foothold support 17 may be mounted on the seat support plate 42 of the seat plate 10 and, at the same time, the foothold 11 may be connected to the foothold connection member 70. In this case, it may be not required to engage the foothold support member 350, the upper and lower frames 46 and 41 and the links 710 and 720 with each other.

Hereinbelow, several embodiments which allow the user to carry out the inward and outward exercise in the leftward and rightward direction will be described in conjunction with FIGS. 51 to 61.

Referring to FIGS. 51, 53, 37, 58 and 60, there are shown several embodiments of an exercise device of this invention each of which comprises the body support unit 1 having the seat plate 10 and the back plate 20. Particularly, in these embodiments, the exercise loading unit 100 is mounted on the fixing member 9 fixed at a side of the seat plate 10 and the knee support unit 500 is mounted on the front part of the exercise loading unit 100. Hence, these embodiments of these drawings have no leg support unit 300.

Figure 52:
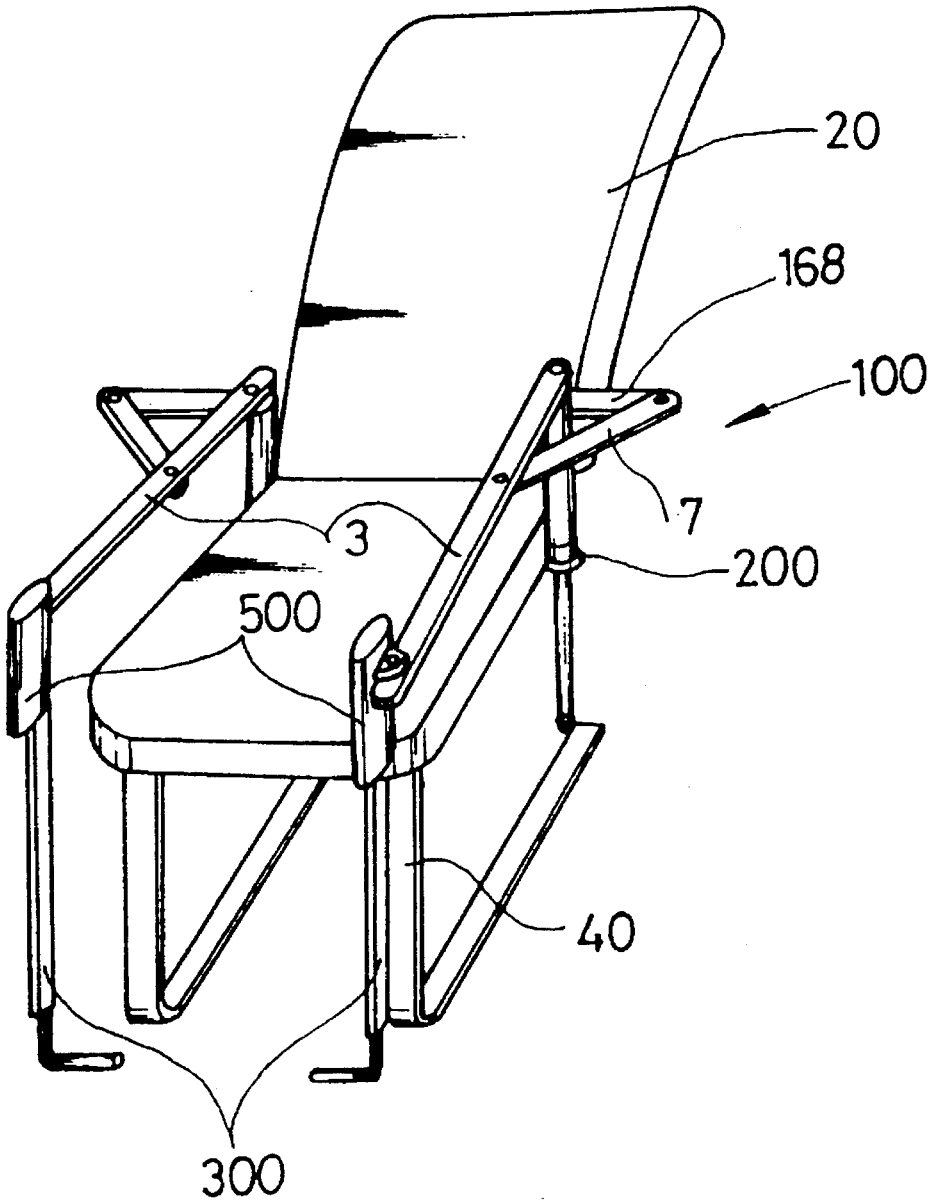
FIG. 52 is a view corresponding to FIG. 51, but showing a eighteenth embodiment of this invention.

On the other hand, FIG. 52 shows an embodiment of an exercise device having the knee support unit 500 and the leg support unit 300 all of which are mounted on the front part of the exercise loading unit 100.

Figure 51:
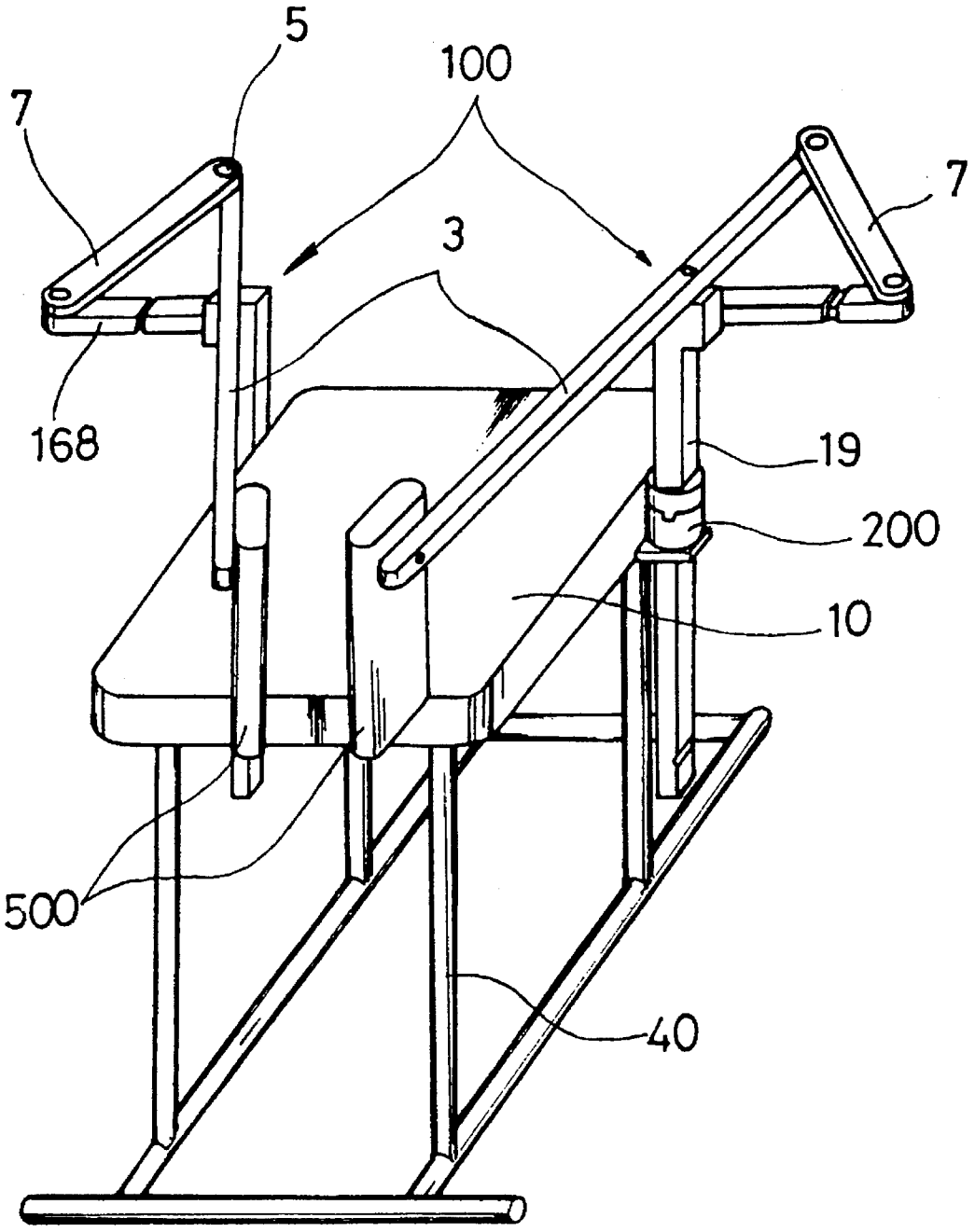
FIG. 51 is a perspective view of an seventeenth embodiment of an exercise device of this invention capable of providing inward and outward exercise.
Figure 53:
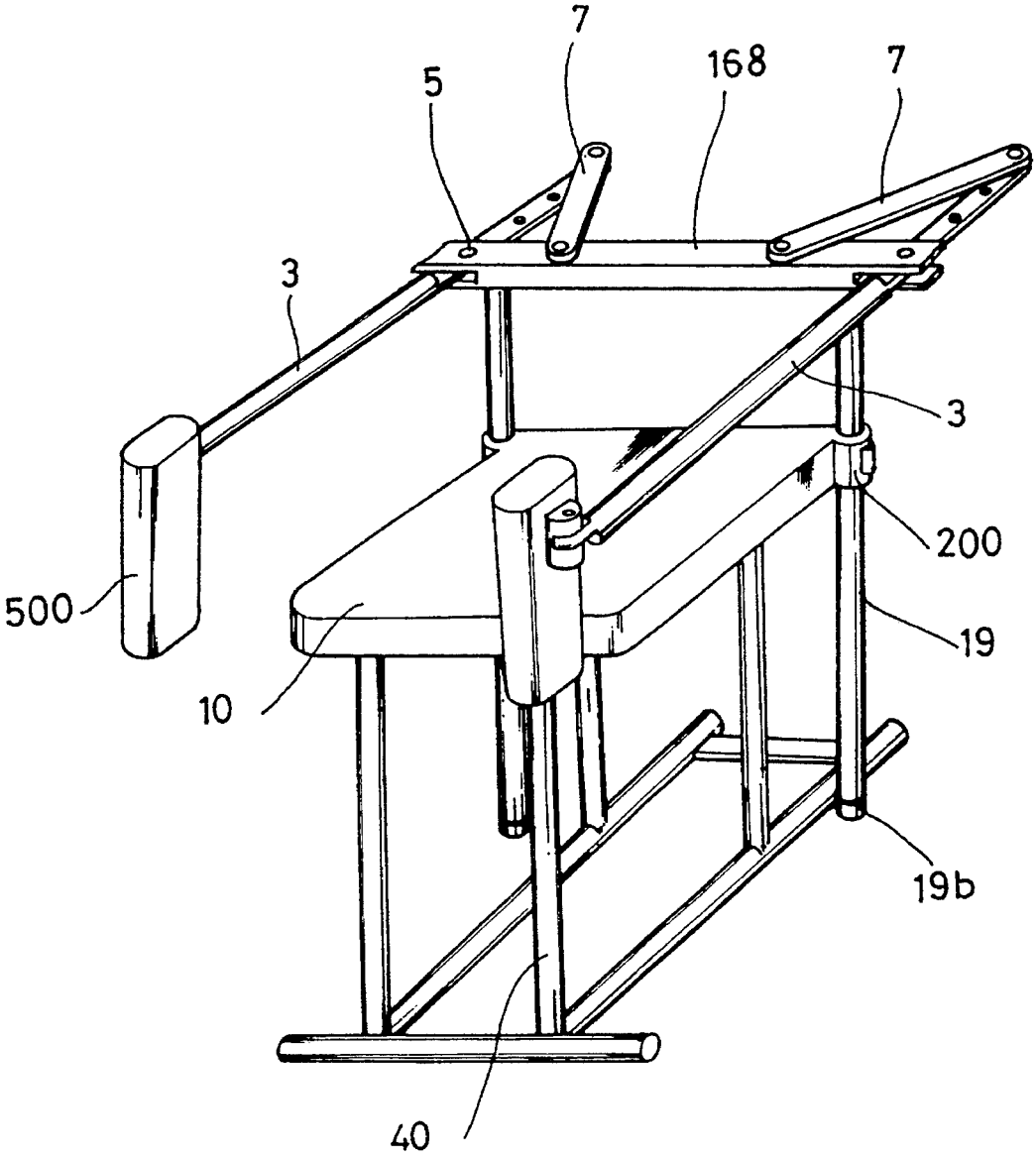
FIG. 53 is a view corresponding to FIG. 51, but showing a nineteenth embodiment of this invention.

Here, in the embodiments of FIGS. 51 and 53, the exercise loading unit 100 is constructed such that the turning support 5 is provided at a middle portion of the lever 3 and the lever 3 is hinged to the turning support 5 in order to allow its front end to move inward and outward in the leftward and rightward direction. The load generator 7 is hinged to the lever 3 behind the turning support 5 and an outside end or an inside portion of horizontal fixing means 168.

Figure 57:
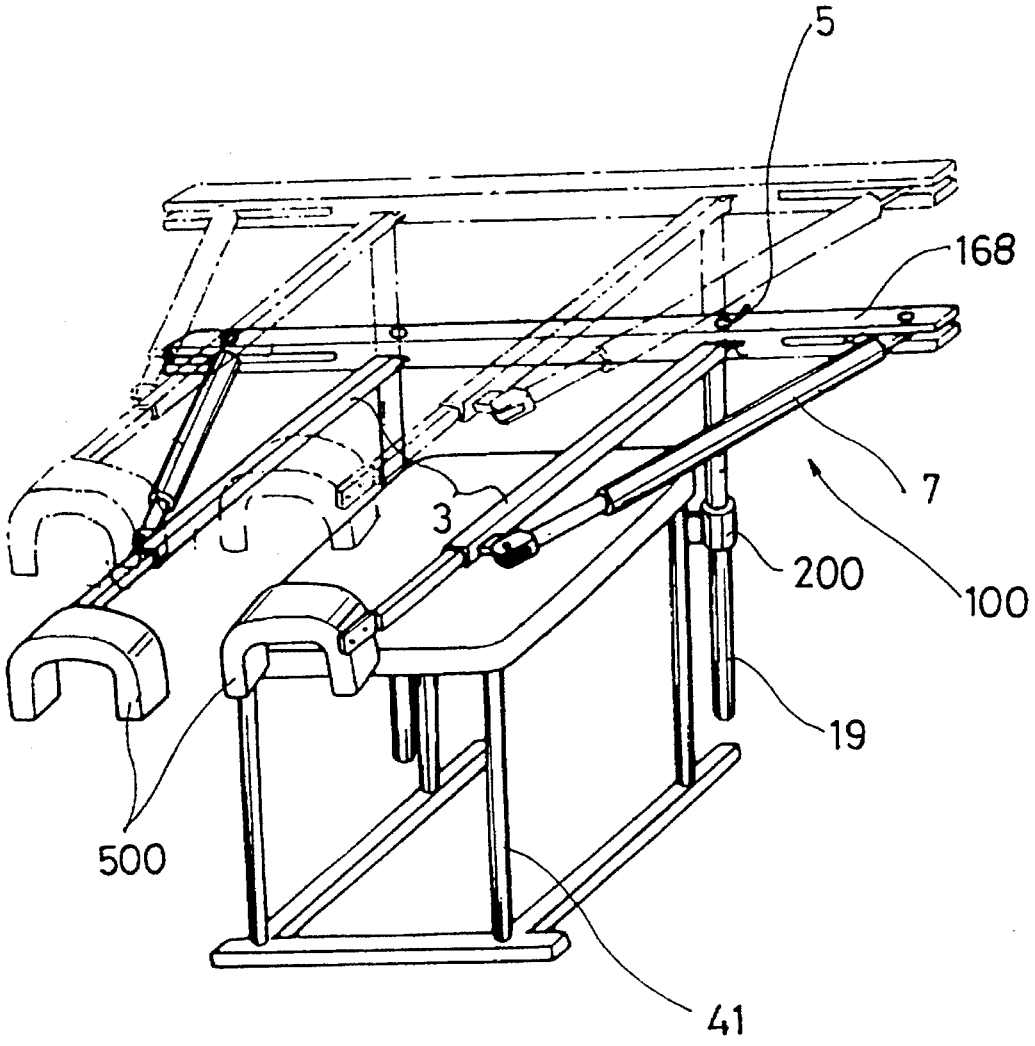
FIG. 57 is a perspective view of a twentieth embodiment of an exercise device of this invention.

In the embodiments of FIGS. 52 and 57, the exercise loading unit 100 is constructed such that the turning support 5 is provided at the rear part of the lever 3. The lever 3 is hinged to the turning support 5 in order to allow its front end to move inward and outward in the leftward and rightward direction. The load generator 7 is hinged to the lever 3 before the turning support 5 and an outside end of the horizontal fixing means 168.

Here, please note that the exercise loading unit 100 is constructed such that the turning support 5 is provided at a middle portion or the rear part of the lever 3. This lever 3 is hinged to the turning support 5 in order to allow its front end to move leftward and rightward, and the load generator 7 is hinged to the lever 3 before or behind the turning support 5 and an outside end or an inside portion of the horizontal fixing means 168. Hence, the embodiments of the exercise device allows the inward and outward exercise by leftward and rightward motion of the front ends of opposite the levers 3.

Figure 54:
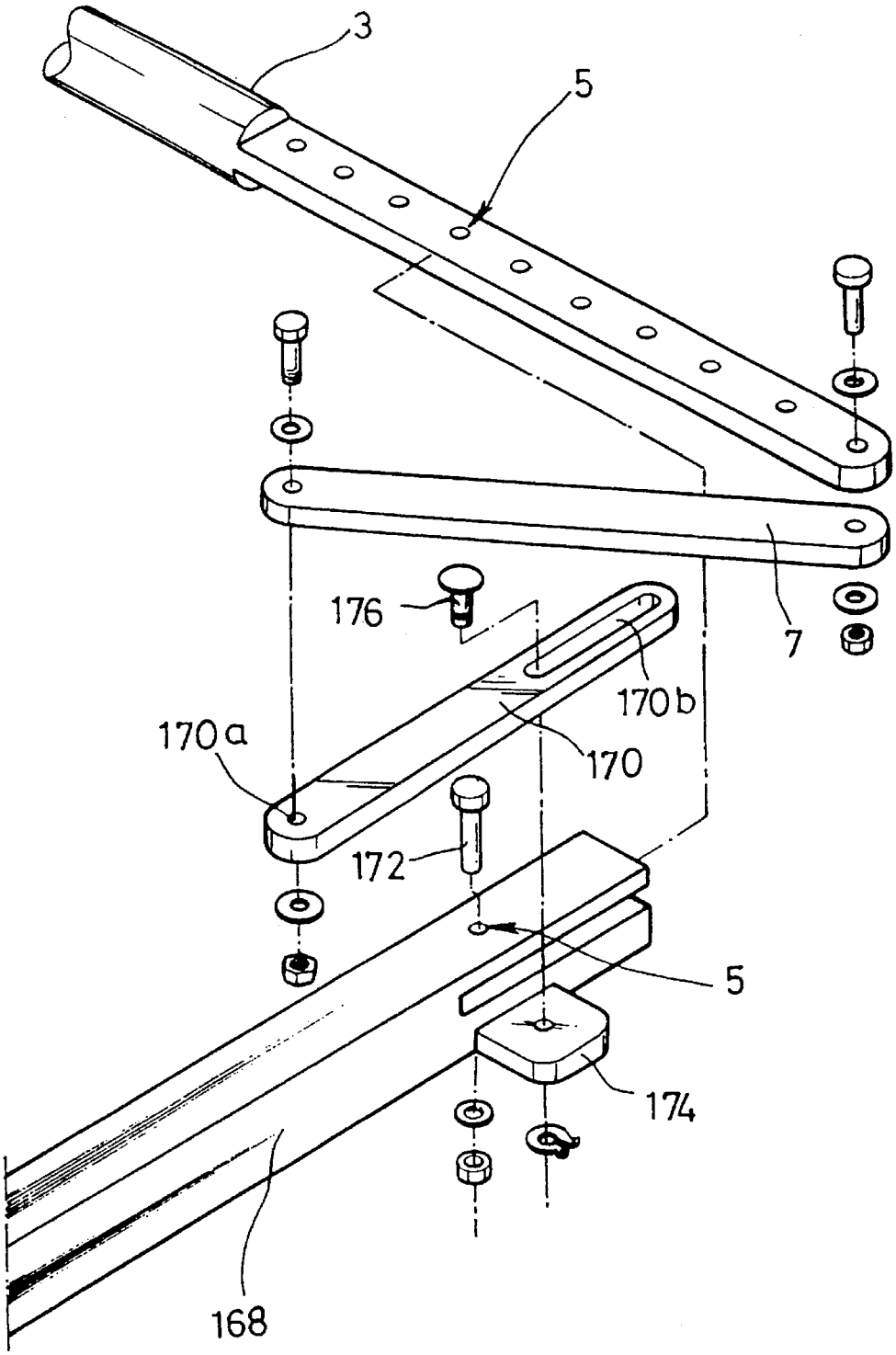
FIG. 54 is an enlarged exploded perspective view of a directional conversion link which is used in the embodiments of FIGS. 51 to 53.
Figure 55:
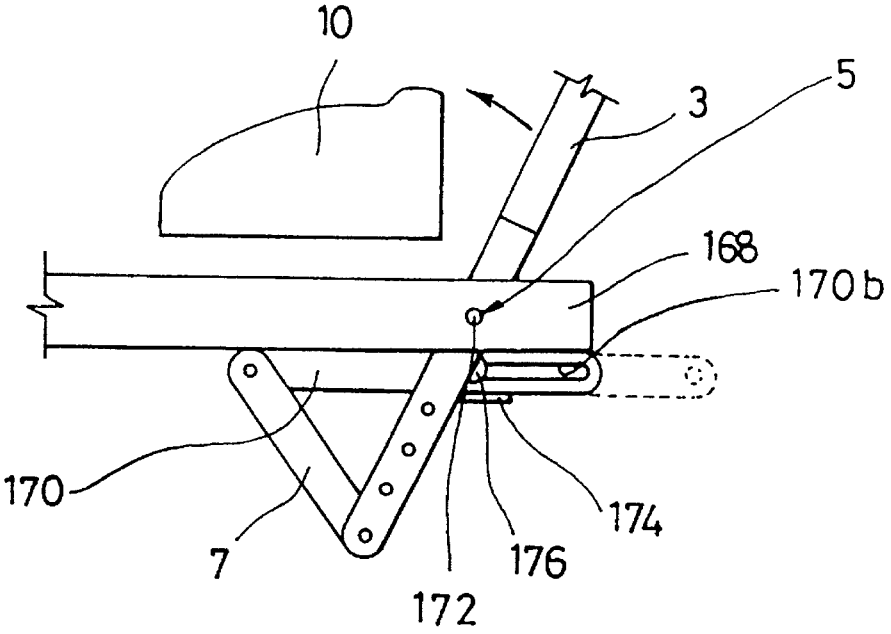
Figure 56:
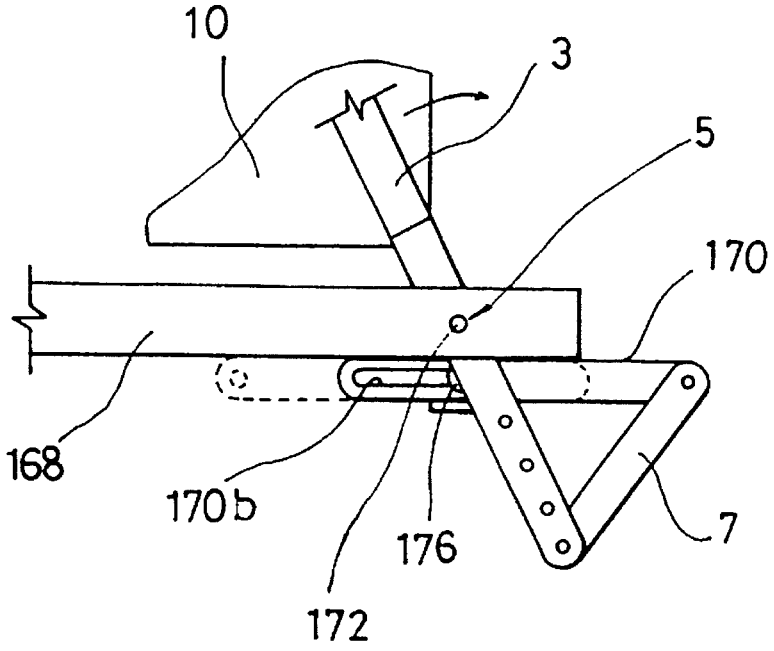

In FIGS. 54 to 56, there is shown an embodiment of the exercise loading unit 100 which provides inward and outward exercise and provided with a direction conversion link 170 connected to a connection part of the lever 3 and the horizontal fixing means 168. In this embodiment, the load generator 7 is connected between an end of the lever 3 and an end of the direction conversion link 170. Here, the direction conversion link 170 is provided with a pin hole **170*a* and a longitudinal hole 170*b* at opposite end parts thereof. The lever 3 is hinged to the horizontal fixing means 168 by using a pin 172 such that the front end of the lever 3 horizontally moves leftward and rightwards. The direction conversion link 170 is hinged to the fixing means 168 in such a manner that its longitudinal hole 170*b* is aligned with a protruded fixing part 174 provided at the end of the means 168 and connected thereto by employing a hinge pin 176. In this case, an end of the load generator 7 is hinged to the other end of the lever using a hinge pin and the other end of the generator 7 is hinged to the direction conversion link 170** using a hinge pin.

In accordance, when the lever 3 is turned counterclockwise as depicted at the arrow of FIG. 55, the direction conversion link 170 is pressed against the horizontal fixing means 168 at the right-side part thereof with respect to the hinge pin 176 and, as a result, allows the user to exercise. Here, the direction conversion link 170 is pulled leftwards in order to locate the pin 176 at the end of the longitudinal hole **170*b* and, at this condition, the link 170 is pulled frontwards and rotated 180° and, thereafter, shifted leftwards, thereby achieving the state shown in FIG. 56. At this position, when the load generator is connected between the lever 3 and the direction conversion link 170, it is possible to move the lever 3 in a direction opposite to that of the state of FIG. 55**.

Figure 58:
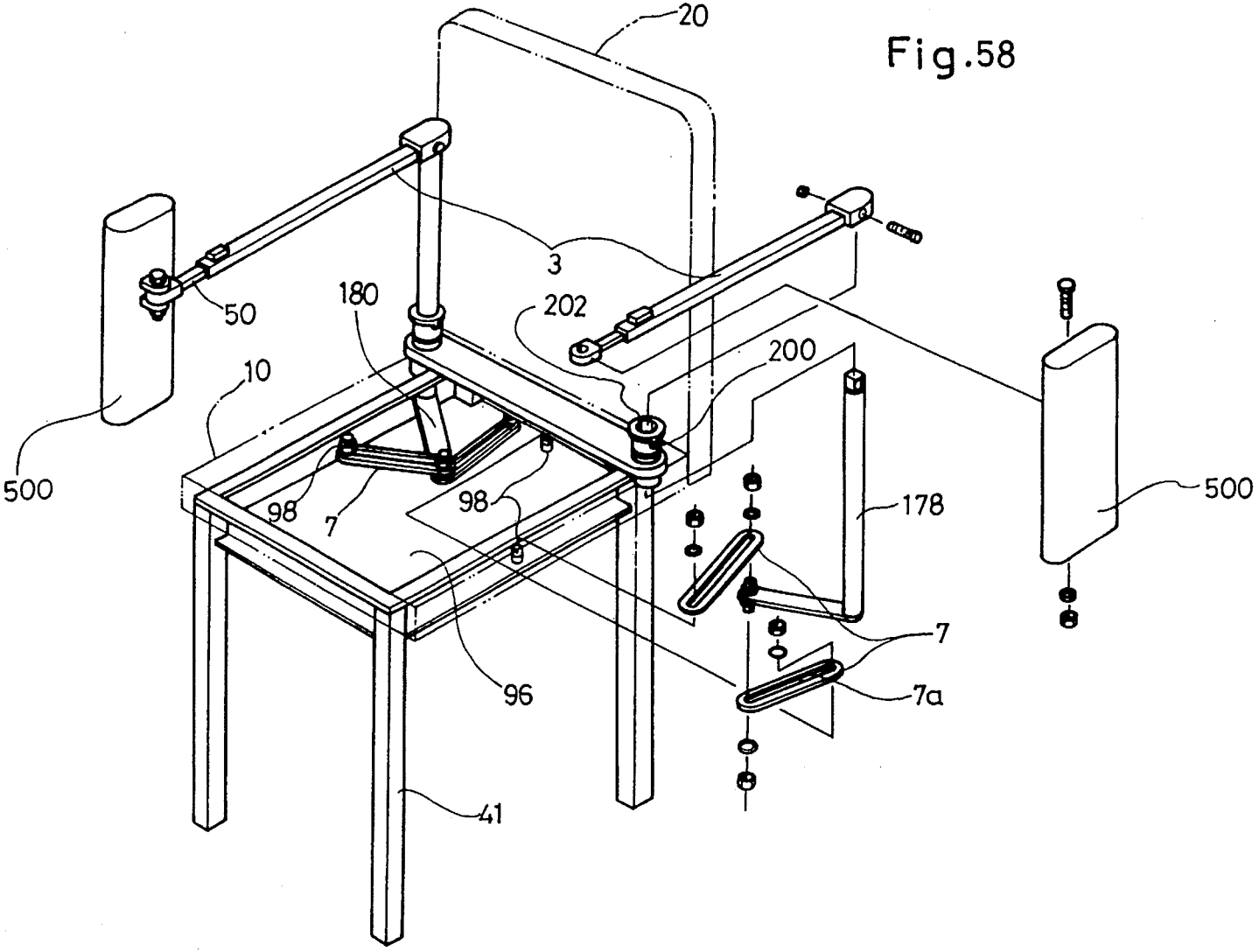
FIG. 58 is a partial exploded perspective view of a twenty-first embodiment of an exercise device of this invention which provides inward and outward exercise.

Referring to FIG. 58, there is shown an embodiment of an exercise device of this invention which is provided with a plate 96 under the seat plate 10 of the body support unit 1 and a pair of fixing members 200 which are mounted on opposite rear sides of the seat plate 10 and have individual mounting holes 202. In this embodiment, the exercise loading unit 100 is constructed such that the lever 3, a vertical rod 178 and a link 180 are connected to each other in order to provide predetermined angles therebetween. Here, the vertical rod 178 is inserted into the mounting hole 202 of the fixing member 200 in order to cause this rod to function as a lever. In this embodiment, there is provided a load generator 7 made of an elastic material. This load generator 7 is provided with a longitudinal hole **7*a* and connected between the front end of the link 180 and a fixing pin 98 mounted on the plate 96. In addition, the knee support unit 500 is mounted on the front part of the lever 3**.

Since the load generators 7 are provided at opposite sides of the device, this device of FIG. 58 allows the user to carry out the inward and outward exercise in the leftward and rightward direction centering around the fixing members 200 and the fixing pins 98.

Figure 59:
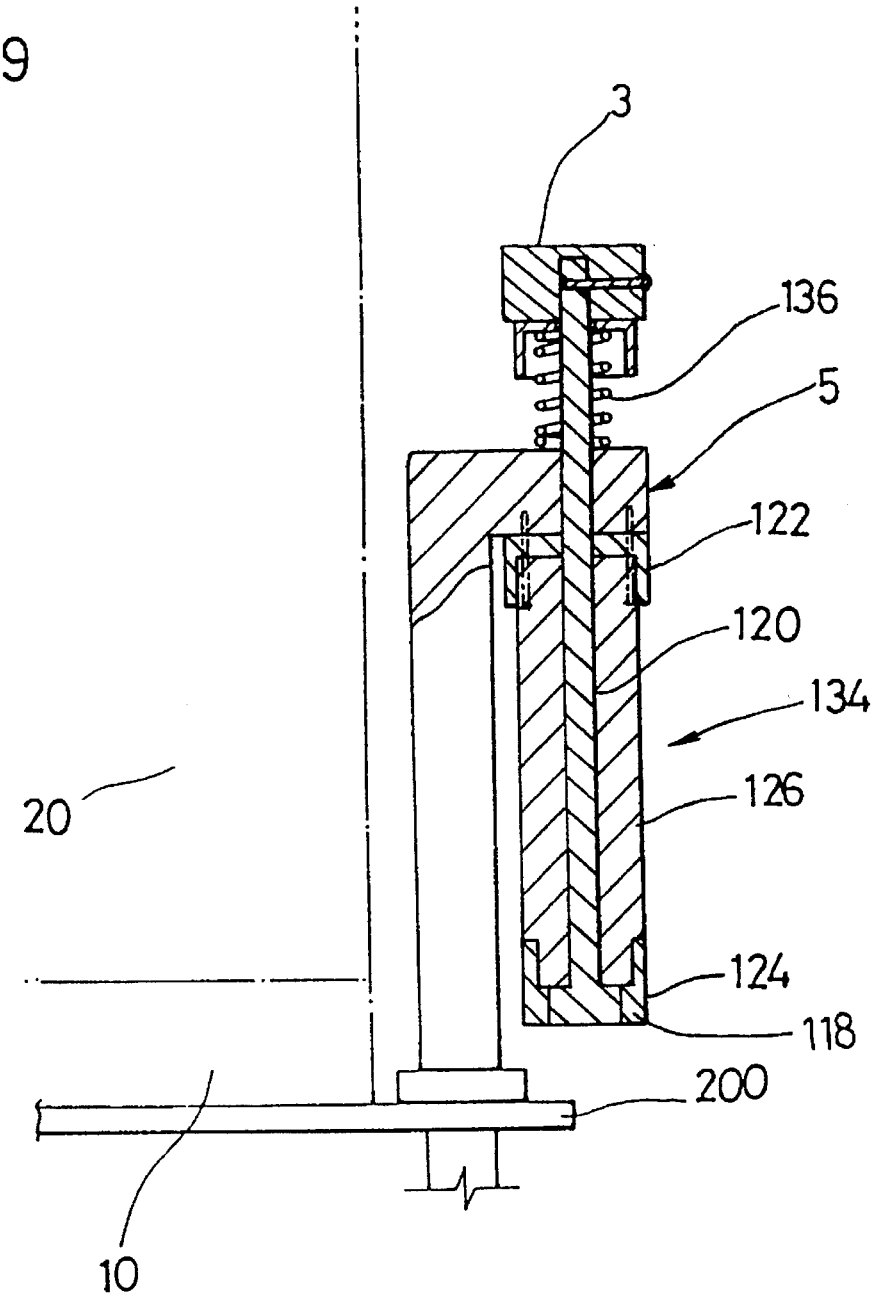
FIG. 59 is an enlarged sectional view of another embodiment of an exercise loading unit of this invention.

Turning to FIG. 59, there is shown another embodiment of an exercise loading unit 100 of this invention. In this embodiment, the unit 100 uses a load generator 134 comprising a torsion bar like the embodiment of FIGS. 22 and 23 and provides inward and outward exercise. Here, the embodiments of FIGS. 22, 23 and 59 have the same construction in engagement of the load generator 134 with the fixing block 122, the movable block 124, the elastic member 126 and the actuation rod 120. However, there is a difference between the embodiments in a fact that the load generator 134 of the exercise loading unit 100 of this embodiment is connected to a protruded lower part of the turning support 5 and the connection end of the actuation rod 120 is connected to the lever 3 by employing a pin, thereby causing the lever 3 to turn leftwards and rightwards together with the actuation rod 120.

In operation of this embodiment, it is possible to move the lever 3 inward and outward in leftward and rightward direction and, as a result, provide the inward and outward exercise. At this time, the exercise load is generated as a result of twisting of the elastic member 126 when the actuation rod 120 connected to the lever 3 is rotated at an angle in the leftward and rightward direction. This causes the movable block 124 engaging with a locking end 118 of the actuation rod 120 to be rotated.

Of course, the angular position of the lever 3 is changeable in accordance with the interrelation between the engagement of the locking end 118 with a locking hole 132 and a spring 136 which is elastically provided between the lever 3 and the turning support 5 above the actuation rod 120. However, this interrelation was described in the embodiment of FIGS. 22 and 23 and, therefore, description of this interrelation is efficiently omitted herein below.

Figure 60:
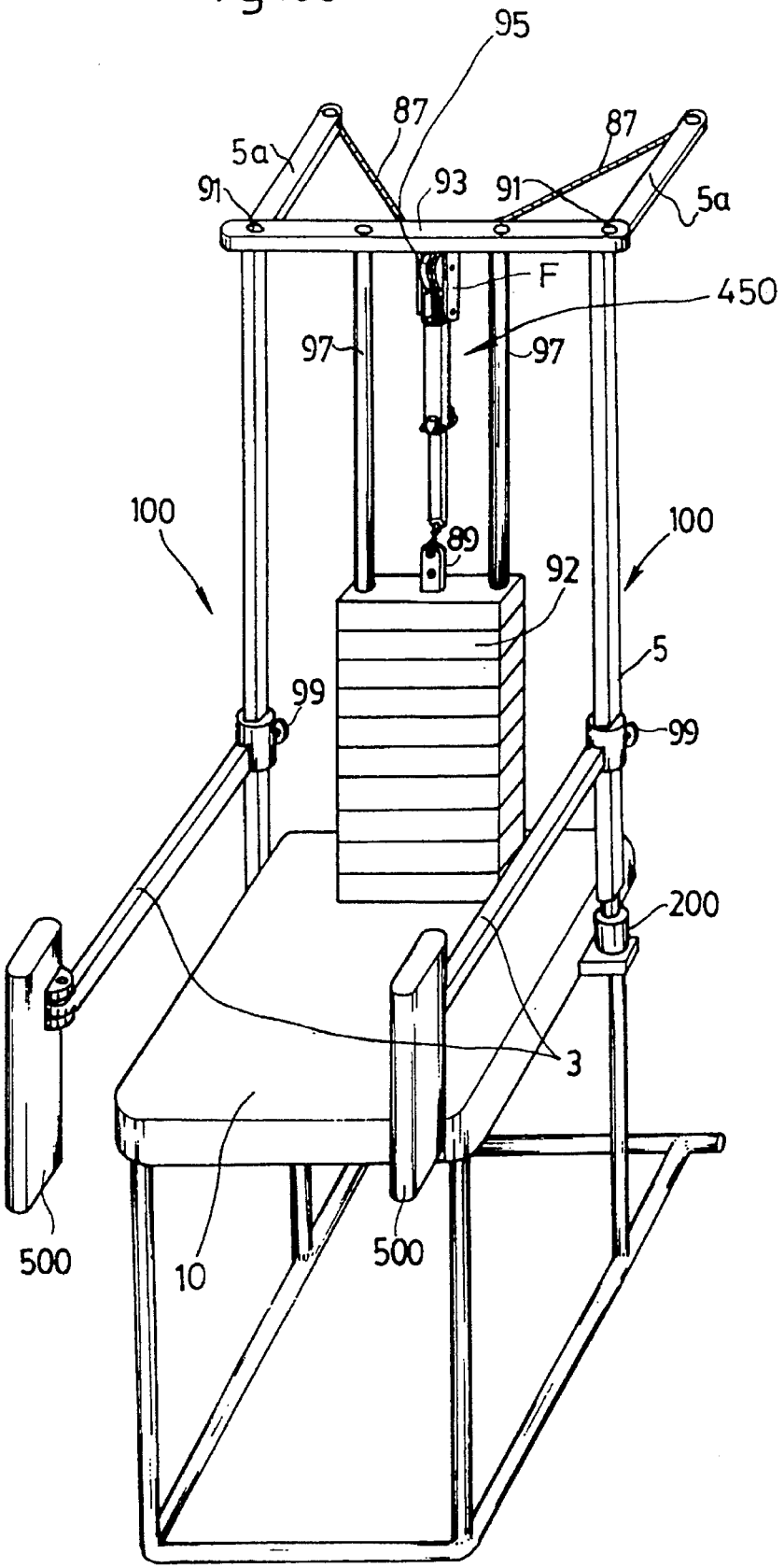
FIG. 60 is a perspective view of a another embodiment of an exercise device of this invention which provides inward exercise.
Figure 61:
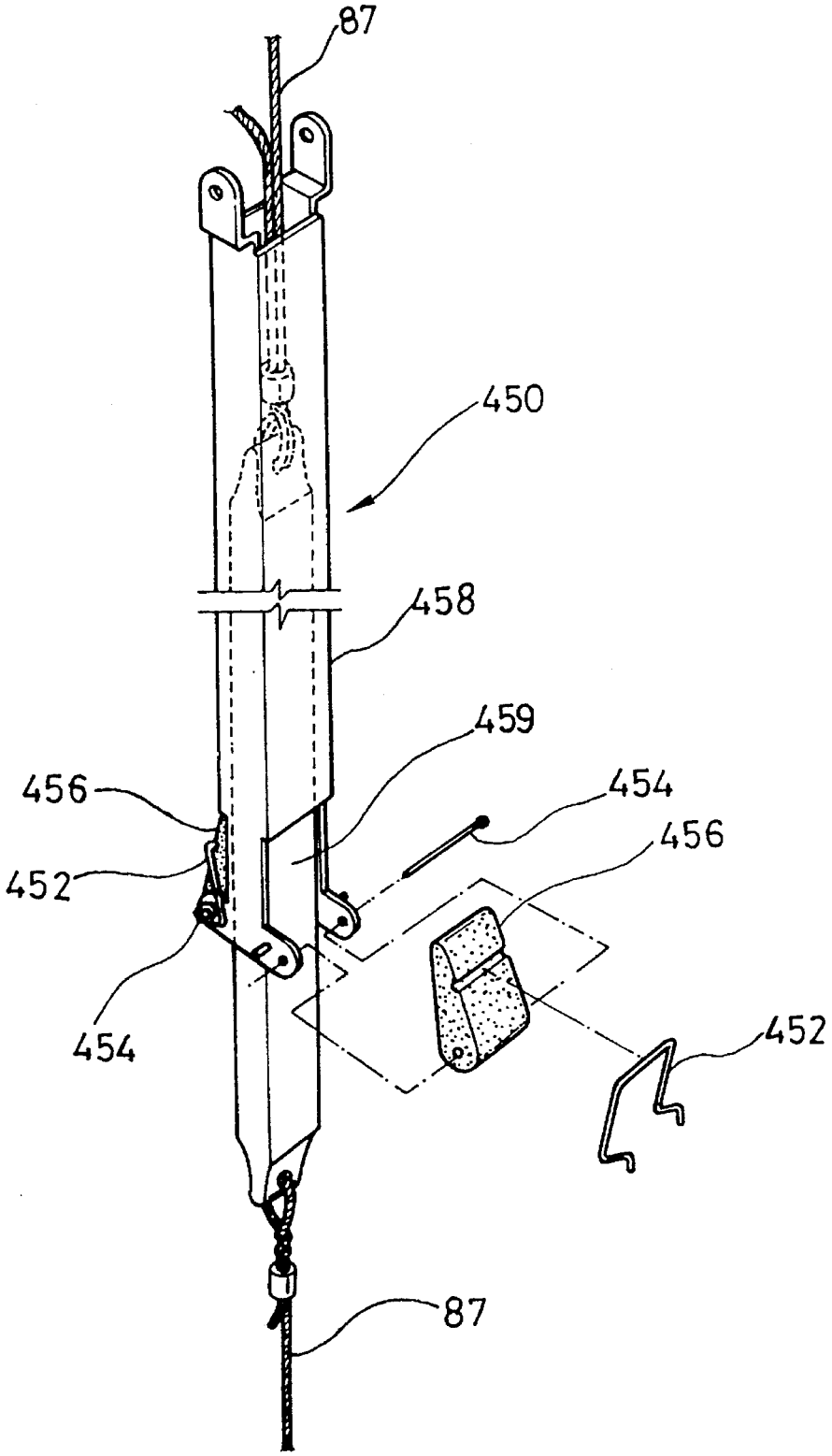
FIG. 61 is a partial exploded perspective view of the embodiment of FIG. 61.

Referring next to FIGS. 60 and 61, there is shown another embodiment of this invention. The body support unit 1 of this embodiment comprises a conventional chair type unit. In this embodiment, the exercise loading unit 100 is mounted, using a shaft, on the turning supports 5 which are inserted into the fixing members 200 provided at opposite sides of the seat plate 10. The lever 3, provided with the knee support unit 500 at its front part, is mounted on a middle portion of the turning support 5 by employing a setting bolt 99 such that this lever 3 is adjustable in its height and rotatable leftwards and rightwards along with the turning support 5. In addition, a fixing link 5*a* is provided above the turning support 5. At the top part of this embodiment, there is provided a lateral bar 93, which includes a pair of vertical guides 97 and a roller 95, by employing a pair of pins 91. The pair of vertical guides 97 are inserted into and support a plurality of weights 92. The uppermost weight 92 is provided with an upper locking part 89. Between this locking part 89 and an end of the fixing link 5*a*, a wire 87 along with a return force damper 450 is connected as passing through the roller 95.

Here, the return force damper 450, provided above the locking part 89 of the weights 92, has a fixing frame 458 on which a break block 456 which is biased by a pair of springs 452 at its opposite sides and movable about a rotating shaft 454. In this fixing frame 458, a movable member 459 connected to the wire 87 is slidably received. The fixing frame 458 is mounted on a frame F of the roller 95.

In this embodiment, when the knee support unit 500 is forced to move inward, the fixing links 5*a* are rotated outward and, as a result, pulls the wire 87 and raises the weights 92 together with the movable member 459 with no influence by the break block 456 of the return force damper, thereby provides inward exercise by using the levers 3 and the knee support unit 500. When the user forces the levers 3 outward so as to cause the weights 92 to be lowered, the break block 456 of the return force damper 450 breaks the movement of the movable member 459 thanking for the biasing force of the spring 452. This causes the weights 92 to descend slowly and allows the user to easily force the lever 3 outward under the condition that the return force is remarkably attenuated. Hence, this embodiment allows the user to carry out the inward exercise using his knees as well as the inward exercise using his arms under the condition that the levers 3 are located at their upper positions.

Hereinbelow, several embodiments which allow the user to carry out the upward and downward exercise and the inward and outward exercise in the leftward and rightward direction at the same time or independently will be described in conjunction with FIGS. 62 to 75.

Figures 62, 62A:
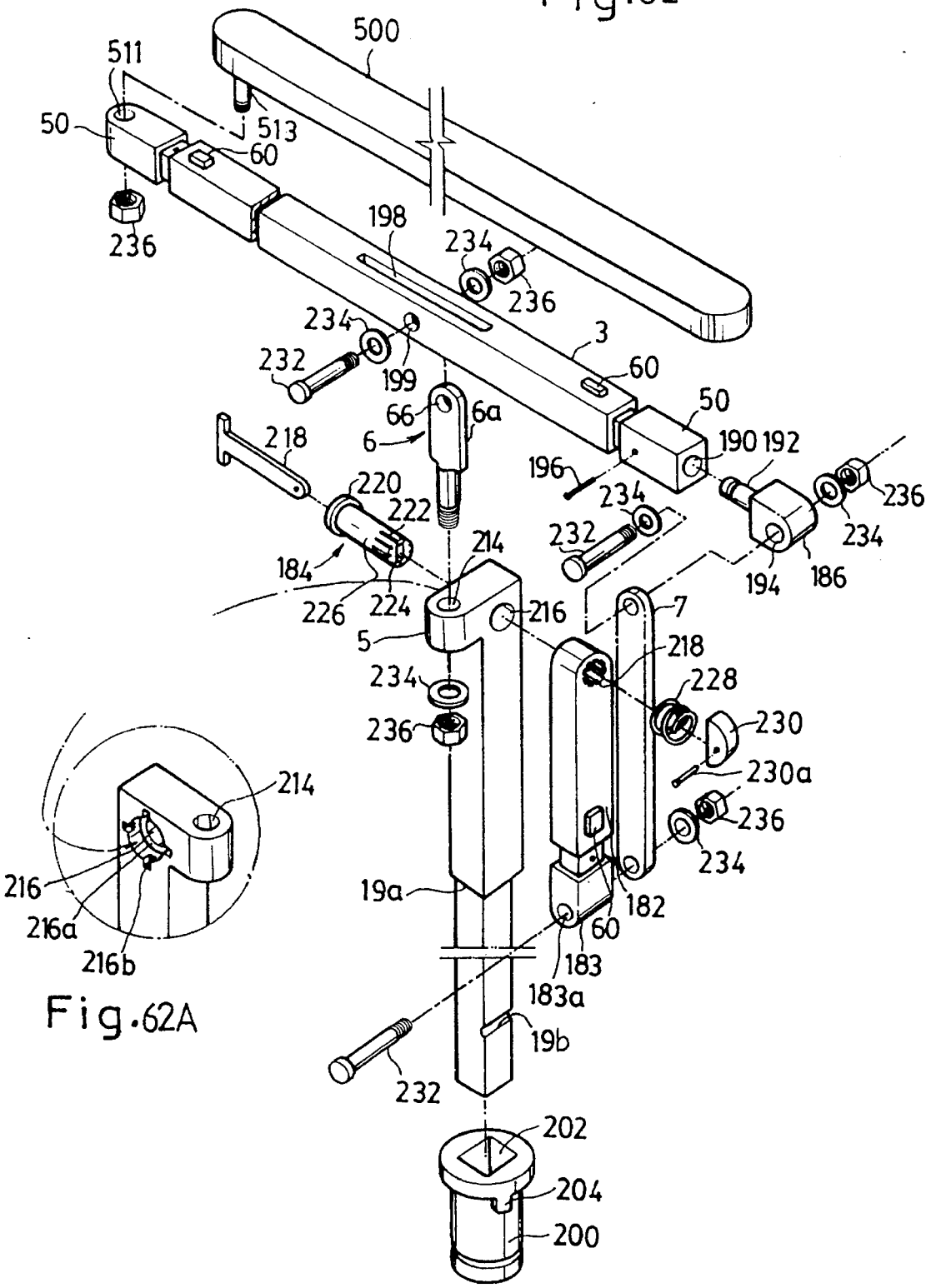
Figure 63:
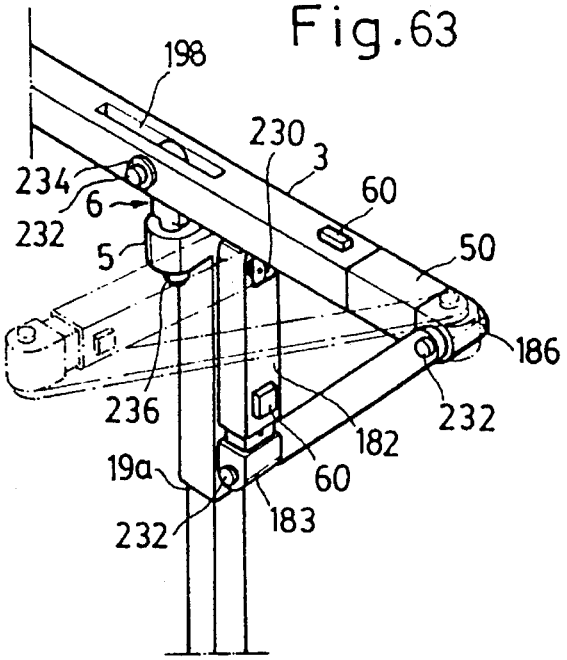
Figure 64:
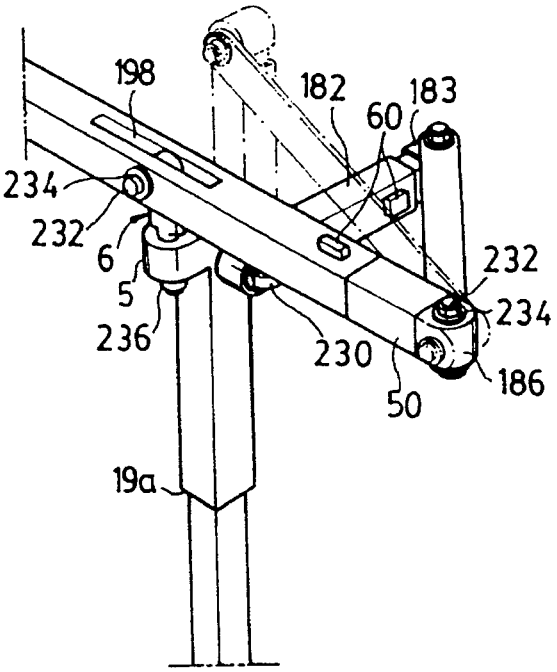

Referring to FIGS. 62 to 64, there is shown another embodiment of an exercise loading unit 100 of this invention. This unit 100 comprises a rotatable pin 6 which is provided between a middle part of the lever 3 and the turning support 5 and causes the lever to turn upwards and downwards and leftwards and rightwards. A direction conversion link 182 is at an end thereof mounted to a rear part of the turning support 5 by using a direction conversion mechanism 184 in order to be able to convert the direction. In this case, the load generator 7 is connected between the rotatable pin 6, rotatably connected to the rear part of the lever 3, and the other end of the direction conversion link 182.

Here, the lever 3 is provided with a pair of front and rear auxiliary lever 50, each of which is extendable in order to adjust the length of the lever 3, at the front and rear ends thereof. The rear auxiliary lever 50 is formed with an engagement hole 190 at its rear end. This rear lever 50 is also provided with an engagement protrusion 192. The engagement hole 190 receives a rotating pin 186 having a pin hole 194. In addition, a fixing pin is provided in order to maintain the engagement of the rotating pin 186 with the engagement hole 190. The lever 3 is provided with a center longitudinal hole 198 and a pair of pin holes 199 communicating with the longitudinal hole 198. The pin holes 199 are formed at opposite sides of the longitudinal hole 198.

The turning support 5 is provided at its upper end with a protruded part having a vertical through pin hole 214. This support 5 also includes a mount hole 216 at a position near the protruded part. This mount hole 216 is formed with a step 216*a* at its front end and with four engagement slots 216*b*. The turning support 5 has a stepped lower part 19*a* and formed with a lock slot 19*b*. This turning support 5 is inserted into a rectangular opening 202 of the fixing member 200 and engages therewith.

The direction conversion link 182 is formed with a locking through hole 218 at its upper part and an extendable auxiliary link 183 at its lower part. This link 183 is adapted for adjusting the length of the direction conversion link 182. In addition, the auxiliary link 183 is provided with a pin hole 183*a*.

The direction conversion mechanism 184 comprises a T-shaped bar 218, a fixing pin 226 which is formed with a protrusion 220 at an end thereof and a plurality of locking depressions 222 at the other end thereof, and a rectangular center through hole 224. This mechanism 184 further includes a knob 230 which is fixed by a spring 228 and a fixing pin 230*a*. Here, the T-shaped bar 218 is inserted into the rectangular through hole 224 of the fixing pin 226 which is in turn inserted into the mount hole 216 of the turning support 5 and the locking through hole 218 of the direction conversion link 182 in such a manner that the plurality of locking depressions 222 engage with the locking through hole 218. Hence, the direction conversion link 182 is rotated along with the fixing pin 226. After inserting the spring 228, a distal end of the T-shaped bar 218 is inserted into the knob 230 and, thereafter, fixed by using a fixing pin 230*a*. In this regard, the protrusion 220 of the fixing pin 226 is inserted to the step 216*a* of the turning support 5 in normal position. On the other hand, the upper and lower protrusions of the T-shaped bar 218 engage with two opposite lock slots 216*b* and this makes the direction conversion link 182 be maintained at a predetermined position.

In connecting the lever 3 to the rotatable pin 6, the engagement protrusion 6*a* of the rotatable pin 6 is inserted into the longitudinal hole 198 of the lever 3. Thereafter, this engagement position is maintained by a fixing pin 232, a washer 234 and a snap spring 236 which are applied to the pin hole 199 and the pin hole 66 of the rotatable pin 6. The lower part of the rotatable pin 6 is inserted into the turning support 5 and, thereafter, engages with a washer 234 and a snap spring 236, thereby causing the lever 3 to turn upwards, downwards, leftwards and rightwards by virtue of rotatable pin 6. Here, the load generator 7 is connected to the pin hole 194 of the rotatable pin 186 and a pin hole 183*a* of the auxiliary link 183 by using a fixing pin 232, a washer 234 and a snap spring 236.

At this time, a protruded plate 513 of the knee support unit 500 may be inserted into a through hole of the auxiliary lever 50 and fixed using a snap spring 236 as required.

In exercising using this loading unit of this embodiment, the knob 230 of the direction conversion mechanism 184 is biased. This makes the T-shaped bar 218 advance in order to cause the upper and lower protrusions of the T-shaped bar 218, which have engaged with the locking slots 216*b*, to be separated from the locking slots 216*b*. Hence, the direction conversion link 182 achieves rotatable state wherein it can turn about the mount hole 216 along with the rotatable pin 226. Therefore, the link 182 can convert the direction upwards, downwards, leftwards or rightwards as depicted in FIGS. 63 and 64. In addition, when the biasing force applied for the knob 230 is released, the upper and lower protrusions of the t-shaped bar 218 engage with opposite locking slots 216*b* of the turning support 5 due to the restoring force of the spring 228 and, as a result, achieves its place.

At this time, an end of the load generator 7 move along with the direction conversion link 182 while the other end of the generator 7 is rotated along with rotatable pin 186 since the rotatable pin 186 can easily rotate under the condition the other end of the generator 7 is fixed to the rotatable pin 186.

In accordance, the loading unit 100 of this embodiment provides the downward exercise at the position represented at the solid line of FIG. 63, the inward exercise at the position of the dotted line of FIG. 63, the outward exercise at the position of the solid line of FIG. 64 and the upward exercise at the position of the dotted line of FIG. 64.

Figures 65, 65A:
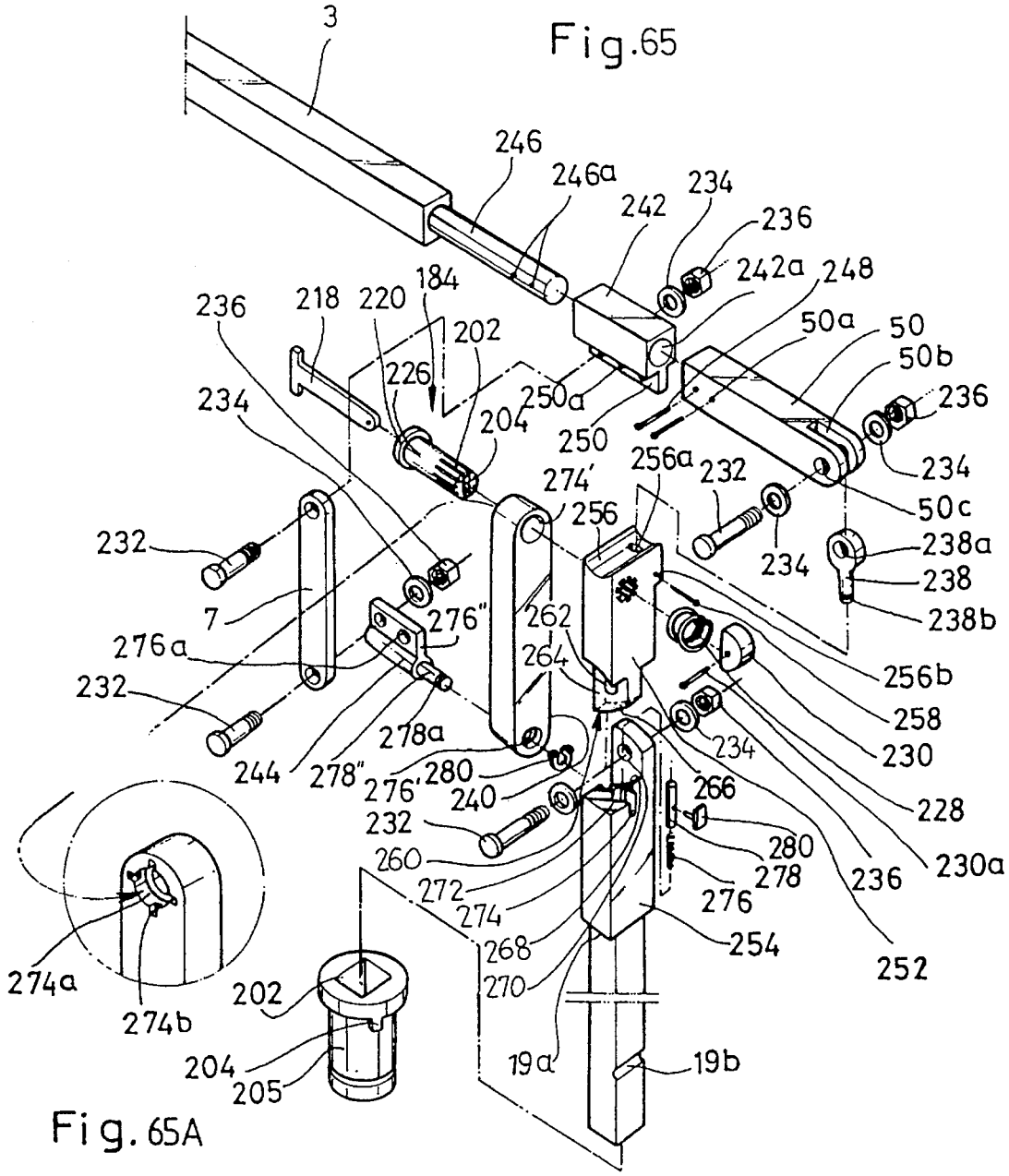
Figure 66:
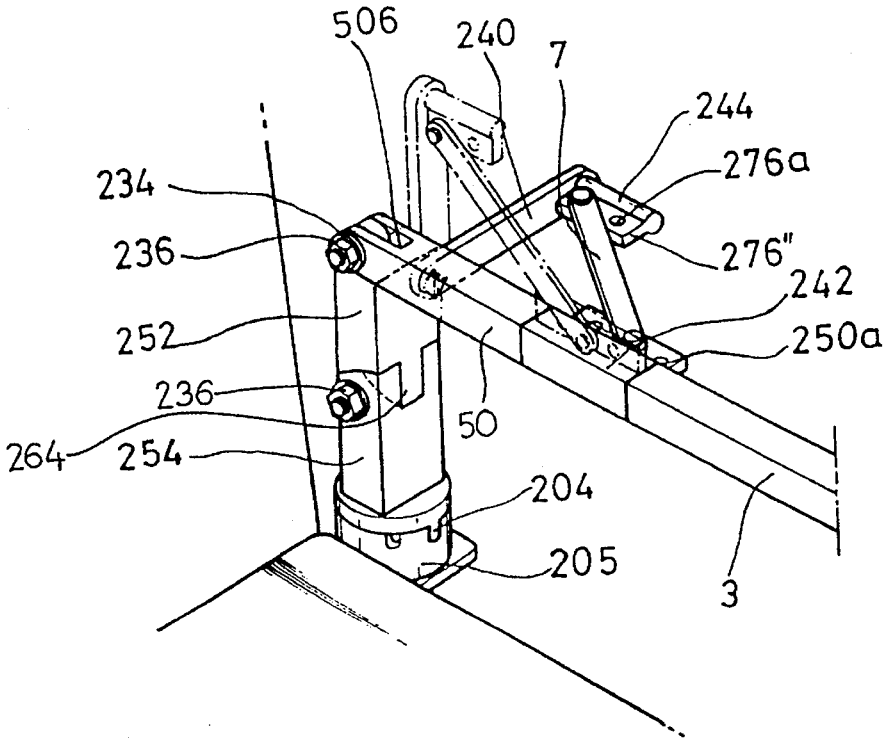
Figure 67:
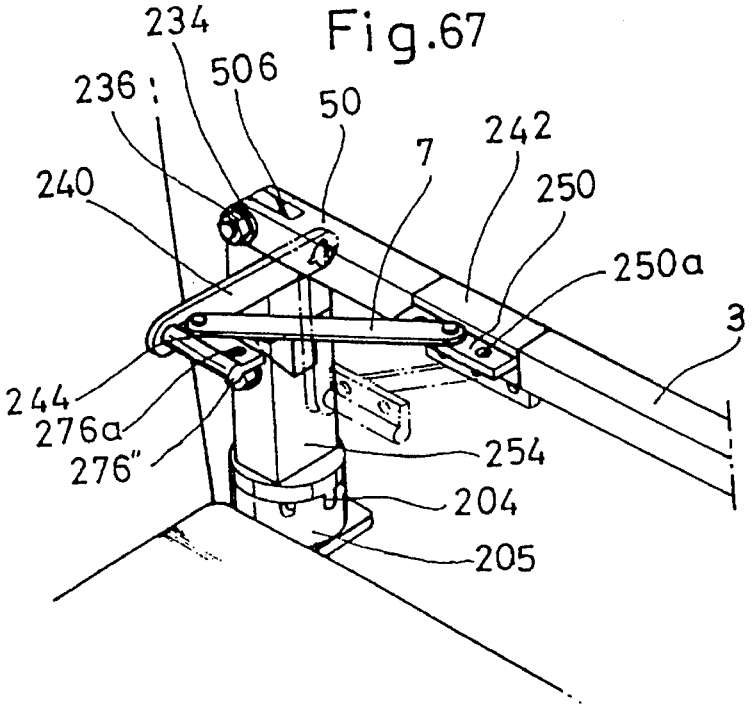

Turning to FIGS. 65 to 67, there is shown another embodiment of an exercise loading unit 100 of this invention. In this embodiment, the unit 100 comprises a rotatable pin 238 which is provided between an end part of the lever 3 and the turning support 5 and causes the lever 3 to turn upwards and downwards and leftwards and rightwards. The turning support 5 comprises separated type support for controlling the inclination angle. A direction conversion link 182 is at an end thereof mounted to a front part of the turning support 5 by using a direction conversion mechanism 184 in order to be able to convert the direction. In this case, the load generator 7 is connected between the rotatable member 242, mounted on a middle part of the lever 3, and another rotatable member 244 mounted on the other end of the direction conversion link 182.

Here, the lever 3 is integrally formed with a rear cylindrical shaft 246 which inserted into a rotatable member 242. An auxiliary lever 50 is received around the cylindrical shaft 246. Thereafter, a pair of fixing pins 248 are applied to the lever 50 and shaft 246 under the condition that pin holes 246*a* of the cylindrical shaft 246 and pin holes 50*a* of the auxiliary lever 50 are aligned with each other, thereby achieving engagement between the two levers 3 and 50. The auxiliary lever 50 is provided at its rear part with a pin mount slot 50*b* and a pair of pin holes 50*c* communicating with the mount slot 50*b*. This pin mount slot 50*b* receives an upper part of a rotatable pin 238 having an upper pin hole 238*a* and a lower locking groove 238*b*. The auxiliary lever 50 and the rotatable pin 238 are hinged to each other by using a fixing pin 232, a washer 234 and a snap spring 236 under the condition that the pin holes 50*c* and 238*a* are aligned with each other. Hence, the lever 3 and the auxiliary lever 50 turns upwards, downwards, leftwards and rightwards about the fixing pin 238. At this time, the rotatable member 242 is provided with a center shaft hole 242*a* for inserting this member 242 into the cylindrical shaft 246 of the lever 3. The member 242 further includes a lower protrusion 250 provided with a plurality of engagement holes 250*a*.

The turning support 5 comprises upper and lower members 252 and 254. Here, the upper member 252 has an upper arc-shaped groove 256 and is formed with a rotatable pin hole 256*a* at an end thereof, a stationary pin hole 256*b* at a rear end thereof and a locking through hole 218. The rotatable pin hole 256*a* receives the rotatable pin 238 while the stationary pin hole 256*b* receives the fixing pin 258. In this regard, the rotatable pin 238 is prevented from escaping upwards but rotatable within the rotatable pin hole 256*a*. The locking through hole 218 receives an end of the direction conversion link 240 as well as the direction conversion mechanism 184. In addition, the upper member 252 is provided at its lower part with a protrusion 264 having a lower arc-shaped surface 260 and a pin hole 262. The arc-shaped surface 260 is formed with a pair of locking holes 266. On the other hand, the lower member 254 is provided at its upper part with an arc-shaped engagement part 268, a pin hole 270 communicating with the engagement part 268 in leftward and rightward directions. The engagement part 268 has a center mount hole 272 and a rear longitudinal hole 274 communicating with the mount hole 272. The mount hole 272 receives a spring 276 and an actuator 278. A knob 280 is inserted into the engagement part 268 through the longitudinal hole 274. The upper and lower members 252 and 254 engage with the engagement part 268 by the protrusion 264 which is inserted into the part 268. A fixing pin 232 is inserted through pin holes 262 and 270 and fixed using a washer 234 and a snap spring 236. At this state, one of the locking holes 266 formed at the protrusion 260 receives the actuator 268 elastically supported by a spring 276, thereby adjusting the inclination angle of the upper member 252. Of course, the lower member 254 is provided with the stepped part 19*a* and the locking hole 19*b* and received by the mount hole 202 of the fixing member 200.

The direction conversion link 240 is provided with a pair of pin holes 274' and 276' at upper and lower parts thereof. The pin hole 274' is provided with a locking slot 274*b* and a stepped part 274*a*. The pin hole 274' receives the rotatable fixing pin 226 of the direction conversion mechanism 184.

At this time, the lower member 244 is integrally formed with a protrusion 276" having an engagement hole 276*a* and formed at its rear part with an engagement protrusion 278" having a mount slot 278*a*. In this state, the engagement protrusion 278" is received in the pin hole 276' of the direction conversion link 240 and the mount slot 278*a* engages with a snap ring 280.

In this case, the load generator 7 is connected between the holes 250*a* and 276*a* of the members 242 and 244 by a fixing pin 232, a washer 24 and a snap spring 236.

Here, the direction conversion mechanism has the same construction as that of the embodiment of FIGS. 62 to 64.

In exercising by using this embodiment, the load generator 7 is located at a predetermined position according to a position of the direction conversion link 240 with respect to the turning support 5. At this time, since the members 242 and 244 provided to the load generator 7 are easily rotated about the cylindrical shaft 246 and the engagement protrusion 278", the load generator 7 is not distorted but maintains its fixed state.

In accordance, the loading unit 100 of this embodiment provides the inward exercise at the position represented at the solid line of FIG. 66, the downward exercise at the position of the dotted line of FIG. 66, the outward exercise at the position of the solid line of FIG. 67 and the upward exercise at the position of the dotted line of FIG. 67.

Figure 68:
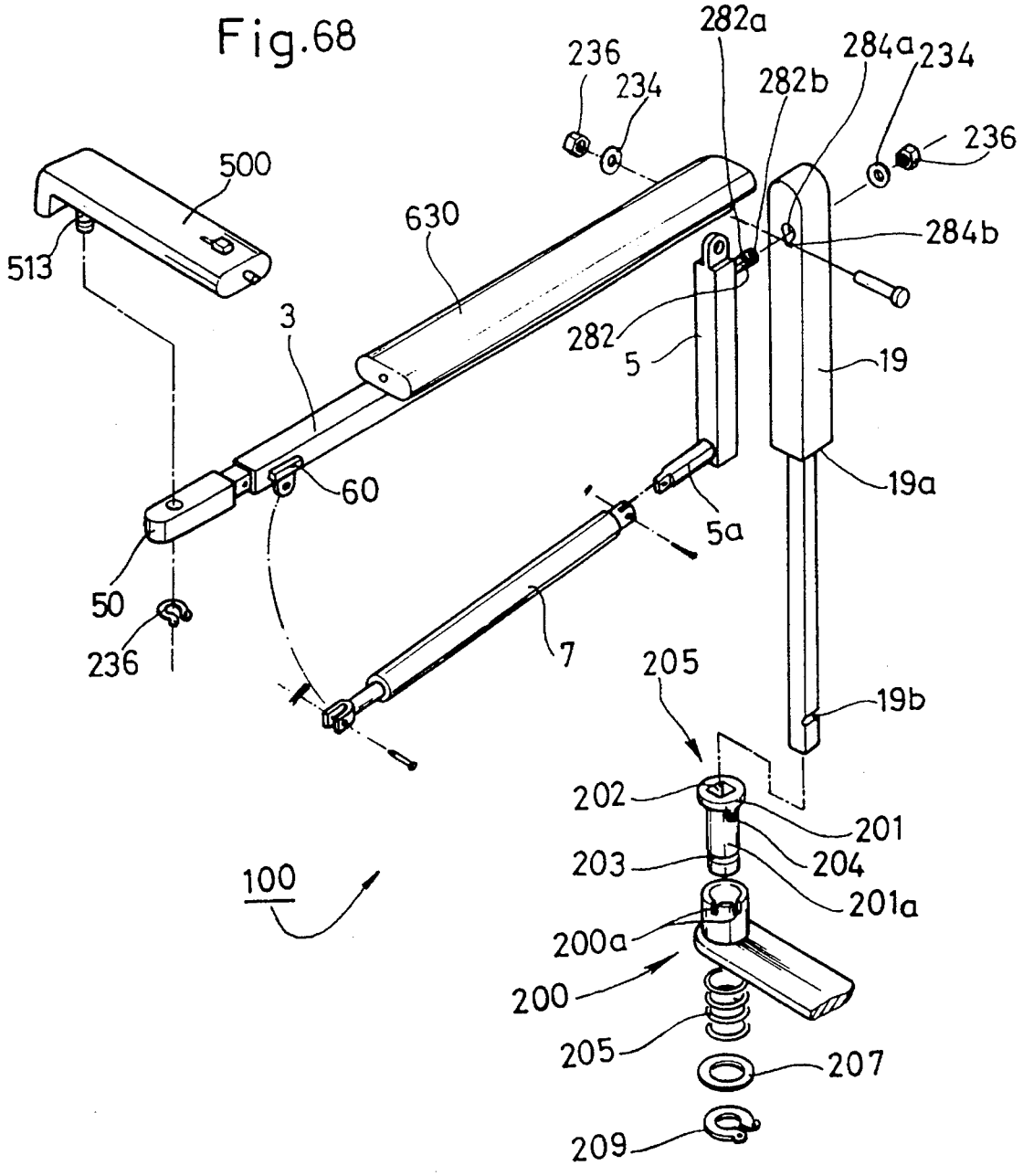
FIG. 68 is an exploded perspective view of another embodiment of an exercise loading unit of this invention.

FIG. 68 illustrates another embodiment of an exercise loading unit of this invention. In the exercise loading unit 100 according to this embodiment, the lever 3 is coupled at its rear end to the upper end of turning support 5, so as to pivot upwards and downwards. The load generator 7 is connected between the support bar 5*a* of the turning support 5 and the front end of the lever 3, so as to move angularly in upward and downward directions. The turning support 5 has at its rear end a pivot pin 282. A support rod 19 is also provided which is coupled with the turning support 5 by means of the pivot pin 282. The construction including the lever 3, the turning support 5 and the load generator 7 is maintained in upward and downward directions or leftward and rightward horizontal directions, by the pivot pin 282 formed at the turning support 5. Thus, upward and downward exercise and inward and outward exercise in leftward and rightward directions can be accomplished by the lever 3.

In this case, the pivot pin 282 has a rectangular direction conversion fixing portion 282*a* and a threaded portion 282*b*. On the other hand, the support rod 19 has a circular throughout hole 284*a* and a rectangular throughout hole 284*b* for receiving the pivot pin 282. The fitting of the pivot pin 282 to the support rod 19 is carried out under a condition that the rectangular direction conversion fixing portion 282*a* and the threaded portion 282*b* have been received in the circular throughout hole 284*a* and the rectangular throughout hole 284*b*. First, the pivot pin 282 is inserted into the circular throughout hole 284*a* of the support rod 19 such that its rectangular direction conversion fixing portion 282*a* is fitted in the rectangular throughout hole 284*a*. Thereafter, a snap spring 236 is coupled onto the threaded portion 282*b* of the pivot pin 282. Thus, the construction including the lever 3, the turning support 5 and the load generator 7 is maintained in upward and downward directions or leftward and rightward horizontal directions.

The support rod 19 is provided at its lower portion with a step 19*a* and a lock groove 19*b*. A fixing member 200 is provided for supporting the support rod 19. In the fixing member 200, a rotatable member 205 is fitted which has a step 201 at its upper portion and a coupling groove 203 at its lower portion. A spring 207 and a spring seat 209 are fitted around the rotatable member 205. A snap ring 211 is also fitted in the coupling groove 203 of the rotatable member 205, so as to prevent the spring 207 and the spring seat 209 from being separated from the rotatable member 205. The rotatable member 205 also has a rectangular central throughout hole 202 for receiving the support rod 19, a step 201, an angle adjusting protrusion 201*a* and a lock portion 204 for locking the raised position of the support rod 19. On the other hand, the fixing member 200 has, at its upper portion, angle adjusting grooves 200*a* for receiving the angle adjusting protrusion 201*a* of the rotatable member 205 selectively. The horizontal angle of the exercise load unit 100 and particularly the lever 3 can be changed according to the engaged position of the angle adjusting protrusion 201*a* of the rotatable member 205.

An assistant lever 50 is connected to the lever 3, so as to adjust the lever length. To the upper portion of the lever 3, a fixed type arm support 630 is mounted rearwardly of the assistant lever 50. To the assistant lever 50, the knee support unit 500 is pivotally coupled, by means of a pivot pin 513 and a snap ring 236. The knee support unit 500 can be used as a part of the arm support 630, when it is positioned above the lever 3.

Figure 69:
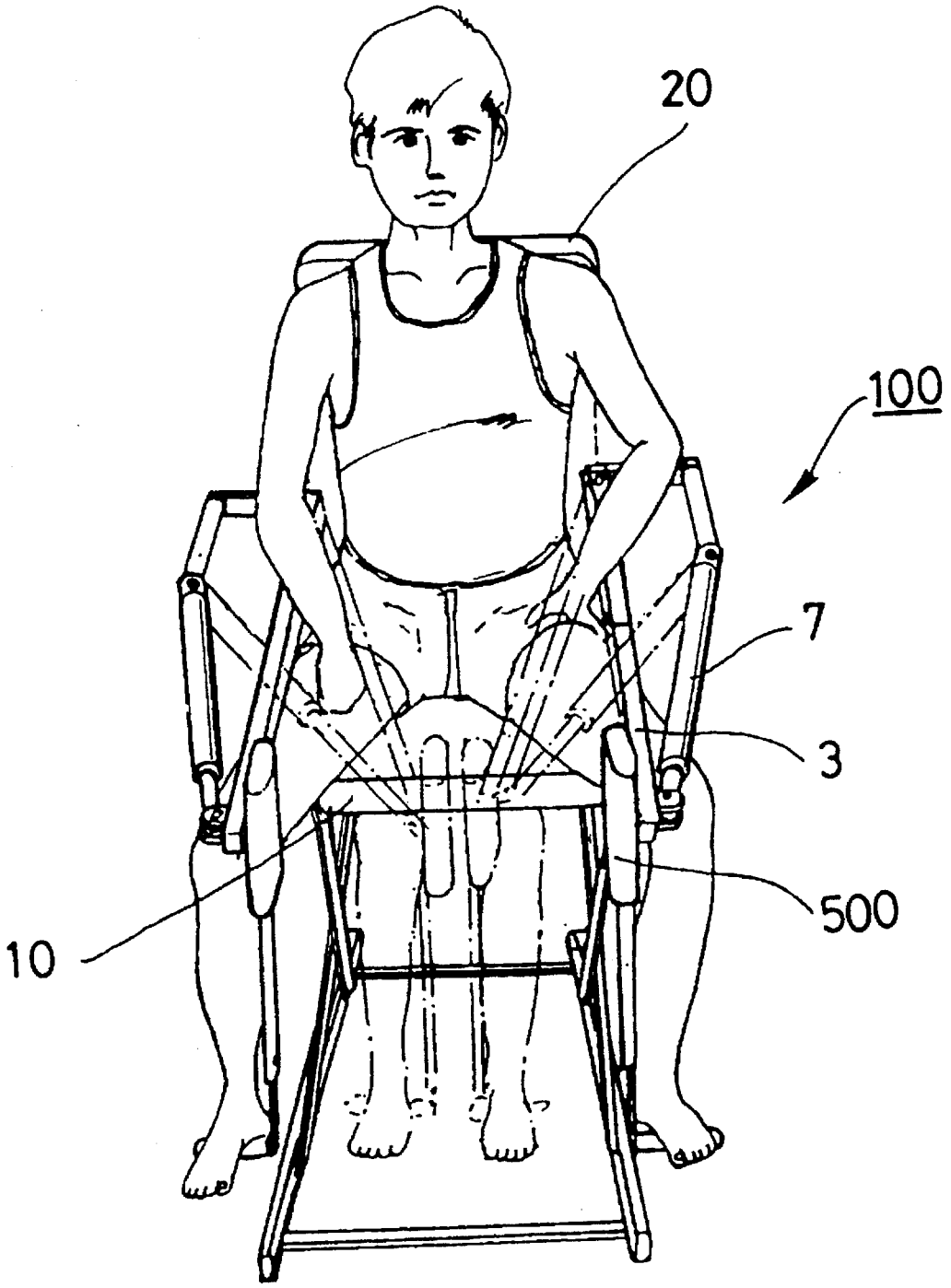
FIG. 69 is the operation of the exercise loading unit of FIG. 68.

As shown in FIG. 69, this construction can be mounted to the exercise device, by mounting the fixing member 200 to the chair construction of the body support unit 1. Accordingly, upward and downward exercise and inward and outward exercise in leftward and rightward directions can be accomplished by using the exercise loading unit 100 and the knee support unit 500.

Figure 70:
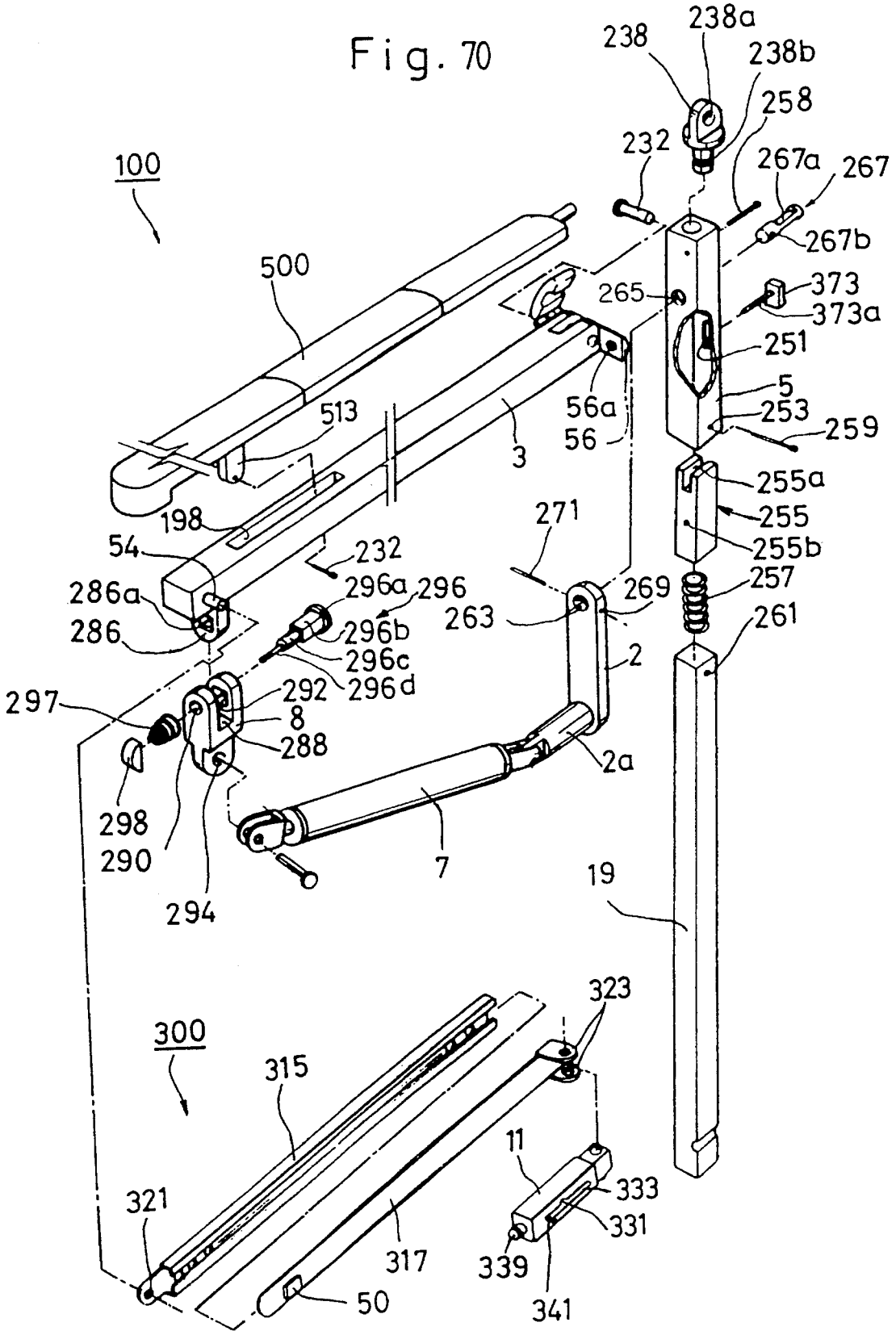
FIG. 70 is an exploded perspective view of another embodiment of an exercise loading unit of this invention.
Figure 71:
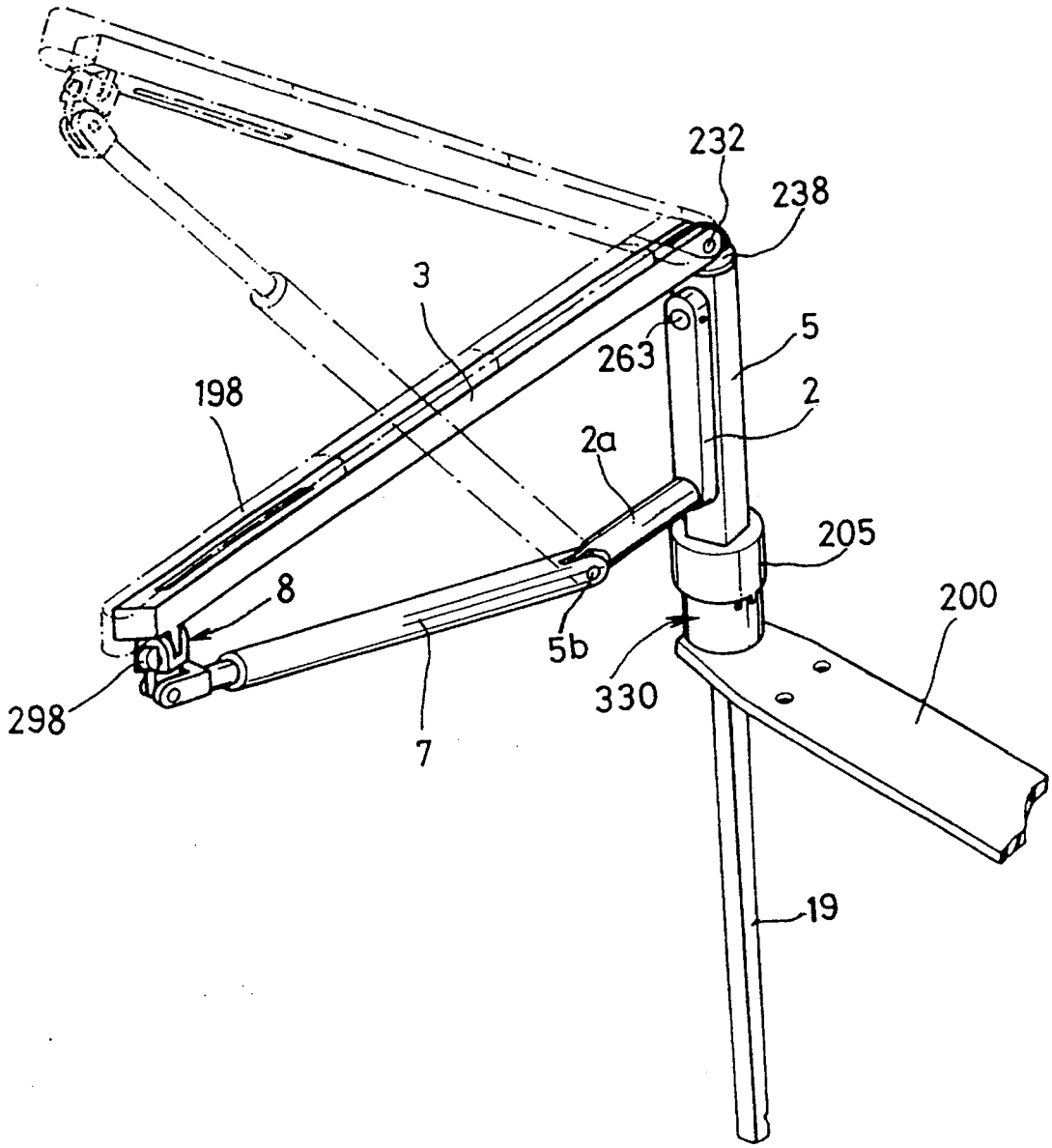
FIG. 71 is a perspective view of the assembled exercise loading unit of FIG. 70 for showing upward and downward exercise.
Figure 72:
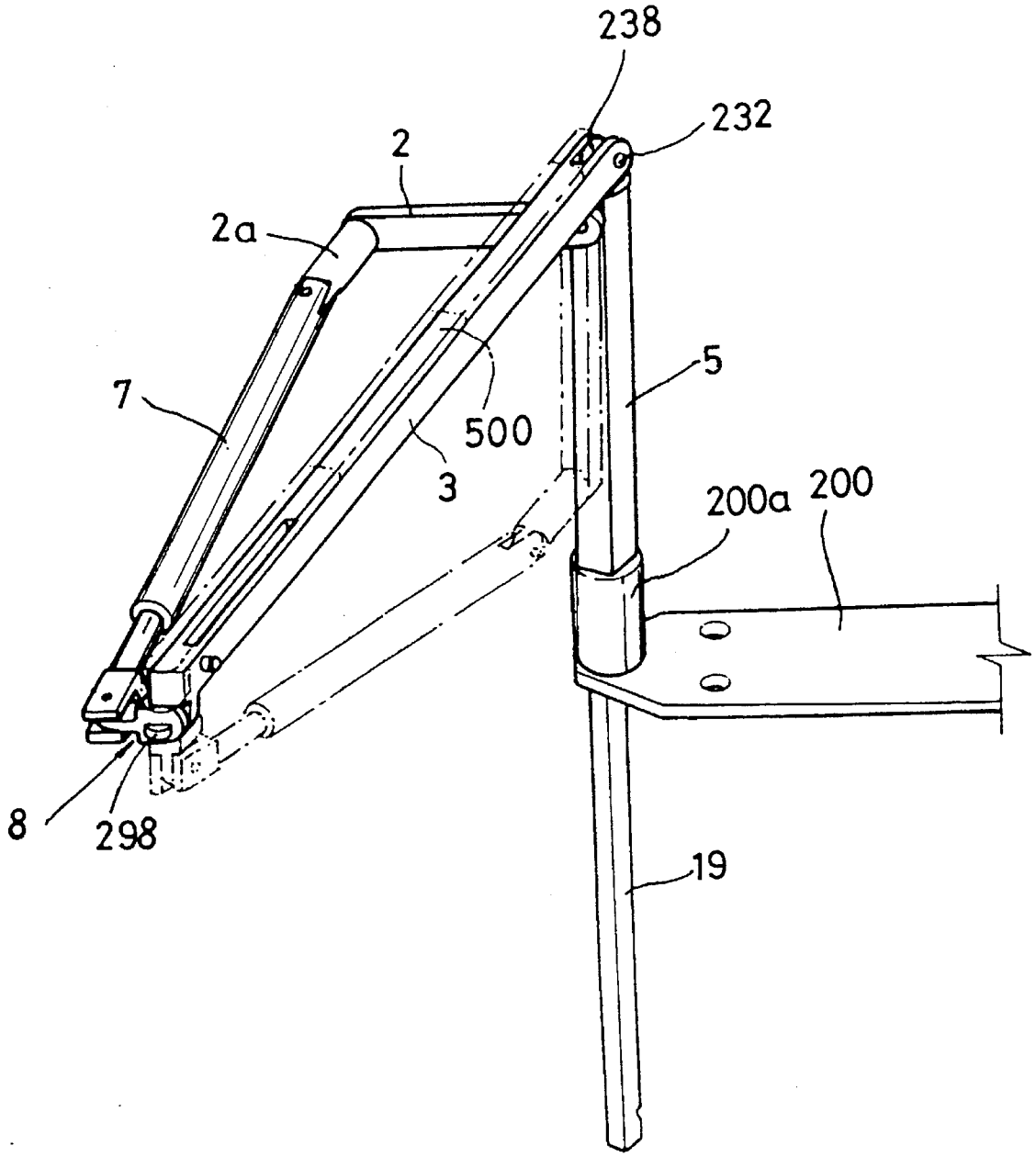
FIG. 72 is a perspective view of the assembled exercise loading unit of FIG. 70 for showing directional conversion.

Referring to FIGS. 70 to 72, there is illustrated another embodiment of an exercise loading unit of this invention. In accordance with this embodiment, the exercise loading unit 100 comprises a hinge member 238 rotatably fitted into one end of the turning support 5 by means of a fixed pin 258, a lever 3 connected at one end thereof to the hinge member 238 by means of a pin 232, a link 2 pivotally mounted to a portion of the turning support 5, a support member 2*a* fixed to the lower portion of link 2, a connecting member 8 pivotally connected to the other end of lever 3, and a load generator 7 connected between the support member 2*a* and the connecting member 8.

In this embodiment, the mounting of the connection bar 315 of the leg support unit 300 and knee support unit 500, the length adjusting bar 317 and the footholds 11 is achieved in the same manner as that of the embodiment shown in FIG. 28.

Differently from the embodiment of FIG. 28, the lever 3 has a slot 198 in which a coupling protrusion 513 of the knee support unit 500 is received and fixed by means of a pin 232. The lever 3 also has at the other end thereof a protrusion 54 to which the connection bar 315 is fixedly connected. Beneath the protrusion 54, a coupling protrusion 286 with a rectangular throughout hole 286*a* is provided at the other end of lever 3. To the coupling protrusion 286, the connecting member 8 is coupled. In the lower portion of the turning support 5 is fitted with a support rod 19.

At the upper portion, the connecting member 8 has a coupling groove 288 and a coupling hole 290 and a rectangular hole 292 facing to each other at both sides of the coupling groove 288. The connecting member 8 also has a coupling hole 294 at the lower portion thereof. In the coupling hole 290 and rectangular hole 292, a direction conversion pin 296 is fitted which has a head portion 296*a*, a rectangular portion 296*b*, a cylindrical portion 296*c* and a threaded portion 296*d*. The fitting of the direction conversion pin 296 to the connecting member 8 is carried out under a condition that the coupling protrusion 286 has been received in the coupling groove 288. First, the direction conversion pin 296 is inserted into the rectangular hole 292 of the connecting member 8 such that its rectangular portion 296*b* is fitted in the rectangular hole 292 and rectangular throughout hole 286*a* while its cylindrical portion 296*c* is fitted in the coupling hole 290. Thereafter, a spring 297 is disposed around the tail end of direction conversion pin 296. An adjusting knob 298 is then coupled to the threaded portion 296*d*.

With this construction, the connecting member 8 can be turned in right and left directions, when the adjusting knob 298 is pushed against the spring force of spring 297 such that the cylindrical portion 296*c* of the direction conversion pin 296 is disposed at the rectangular throughout hole 286*a* of the coupling protrusion 286.

On the other hand, the turning support 5 is provided at its interior with a mounted space in which an actuator 255 having a coupling groove 255*a* and a pin hole 255*b* is received. The turning support 5 also has a slot 251, a pin hole 253 and a coupling hole 265. In the mounting space of turning support 5, a spring 257 and the upper portion of support rod 19 having a pin hole 261 are inserted to be disposed beneath the actuator 255. The insertion of the support rod 19 is carried out until its pin hole 261 is aligned with the pin hole 253 of turning support 5. Under this condition, a fixing pin 259 is inserted into the aligned pin holes 253 and 261 so that the turning support 5 and the support rod 19 are coupled to each other.

The link 2 has at its upper portion a coupling hole 263 which is aligned with the coupling hole 265 of the turning support 5. In the aligned coupling holes 263 and 265, a direction conversion pin 267 is fitted which has coupling grooves 267*a* at its upper and lower portions and a pin hole 267*b* at its one end portion. The coupling between the link 2 and the turning support 5 is achieved by fitting a fixing pin 271 in the aligned coupling holes 263 and 265. An adjusting knob 373 with a fixing pin 373*a* is coupled to the actuator 255. The coupling of adjusting knob 373 to the actuator 255 is achieved by inserting the fixing pin 373*a* into the pin hole 255*b* of actuator 255 exposed outwardly through the slot 251 of turning support 5.

When the construction including the connecting member 8, the load generator 7, the support bar 2*a* and the link 2 is maintained to extend in a direction corresponding to the extending direction, namely, vertical direction of the turning support 5, the direction conversion pin 267 is maintained such that its coupling grooves 267*a* are horizontally disposed. At this state, the direction conversion pin 267 can not be fitted in the coupling groove 255*a* formed at the upper end of actuator 255. When the construction is turned 90° from the above-mentioned state, so as to extend in a direction perpendicular to the extending direction of turning support 5, namely, horizontally, the direction conversion pin 267 is turned such that its coupling grooves 267*a* are vertically disposed. At this state, the direction conversion pin 267 allows the actuator 255 to move upwardly by virtue of the spring force of spring 257. Accordingly, the direction conversion pin 267 is fitted in the coupling groove 255*a* of actuator 255 so that its coupling grooves 267*a* are engaged with the coupling groove 255*a*, thereby preventing the construction from turning downwards. As a result, the construction is maintained at its horizontal position.

Figure 73:
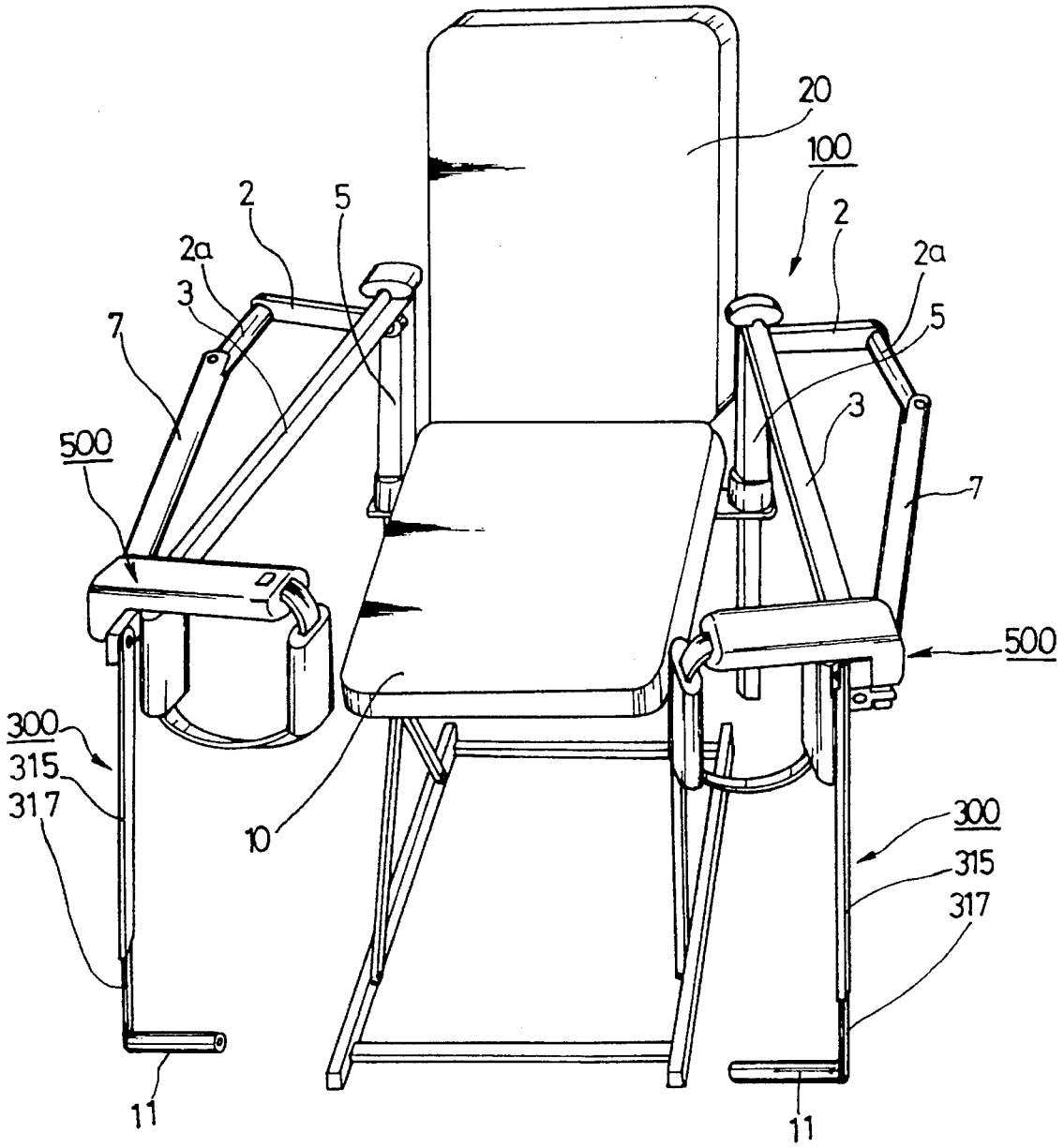
FIG. 73 is a perspective view of an exercise device of this invention combined with the exercise loading unit of FIG. 70.

At a state that the exercise loading unit 100 is coupled with the leg support unit 300 and knee support unit 500 and maintained at its horizontal position, as shown in FIG. 73, inward and outward exercise can be made by turning the exercise loading unit 100 horizontally and laterally. Although not shown, the upward and downward exercise can be also made by a direction conversion of the exercise loading unit 100.

Figure 74:
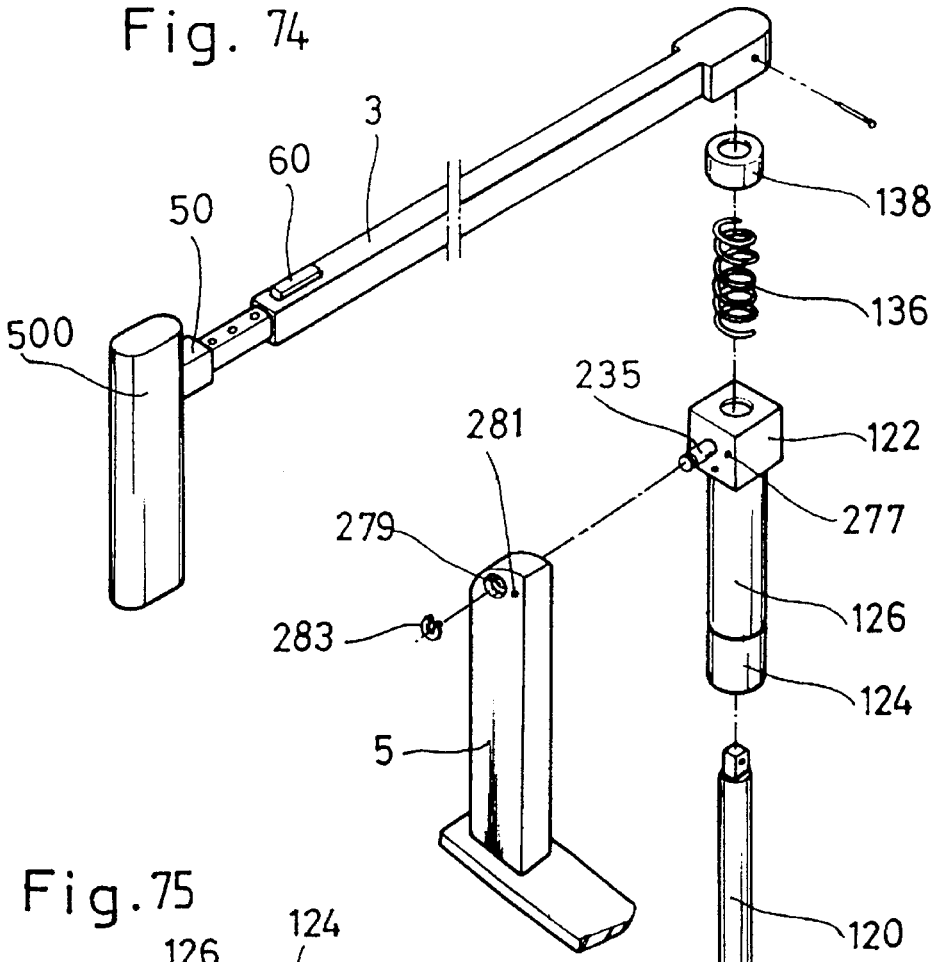
FIG. 74 is an exploded view of another embodiment of an exercise loading unit of this invention.
Figure 75:
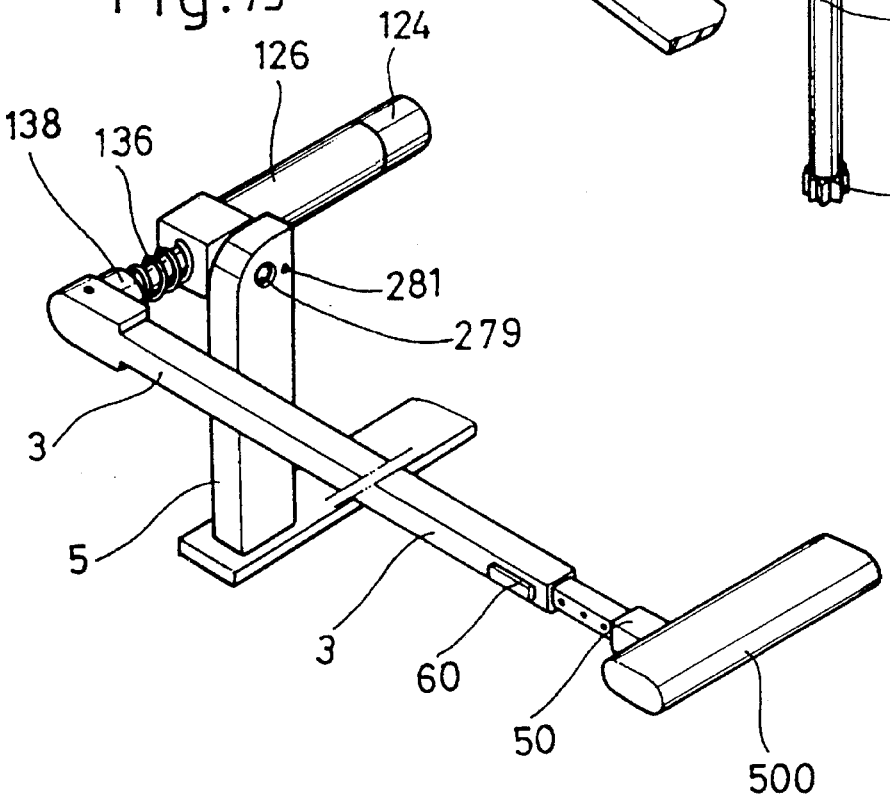
FIG. 75 is a perspective view of the assembled exercise loading unit of FIG. 74.

FIGS. 74 and 75 illustrate another embodiment of an exercise loading unit of this invention. This embodiment shows a construction using a load generator 134 of a torsion bar type similar to those of FIGS. 22, 23 and 59 and thus enabling upward and downward exercise and inward and outward exercise by a lever 3.

In accordance with this embodiment, the exercise loading unit 100 comprises a fixing block 122 mounted to one end of the load generator 134 and provided with a pin 235 and lock holes 277, and a turning support 5 provided at its upper portion with a pin hole 279 for receiving the pin 235 of fixing block 122 and a lock member 281. The pin 235 of fixing block 122 is inserted into the pin hole 279 of turning support 5 and coupled at its end with a snap ring 283, so as to prevent it from being separated from the pin hole 279. With this construction, the exercise loading unit 100 with the lever 3 and load generator 134 can be turned about the pin 235 and locked at a selected lock hole 277 to which the lock member 281 is engaged.

Accordingly, it can be found that upward and downward exercise or inward and outward exercise in a horizontal and lateral direction can be selectively made, by the function of lever 3.

Figure 76:
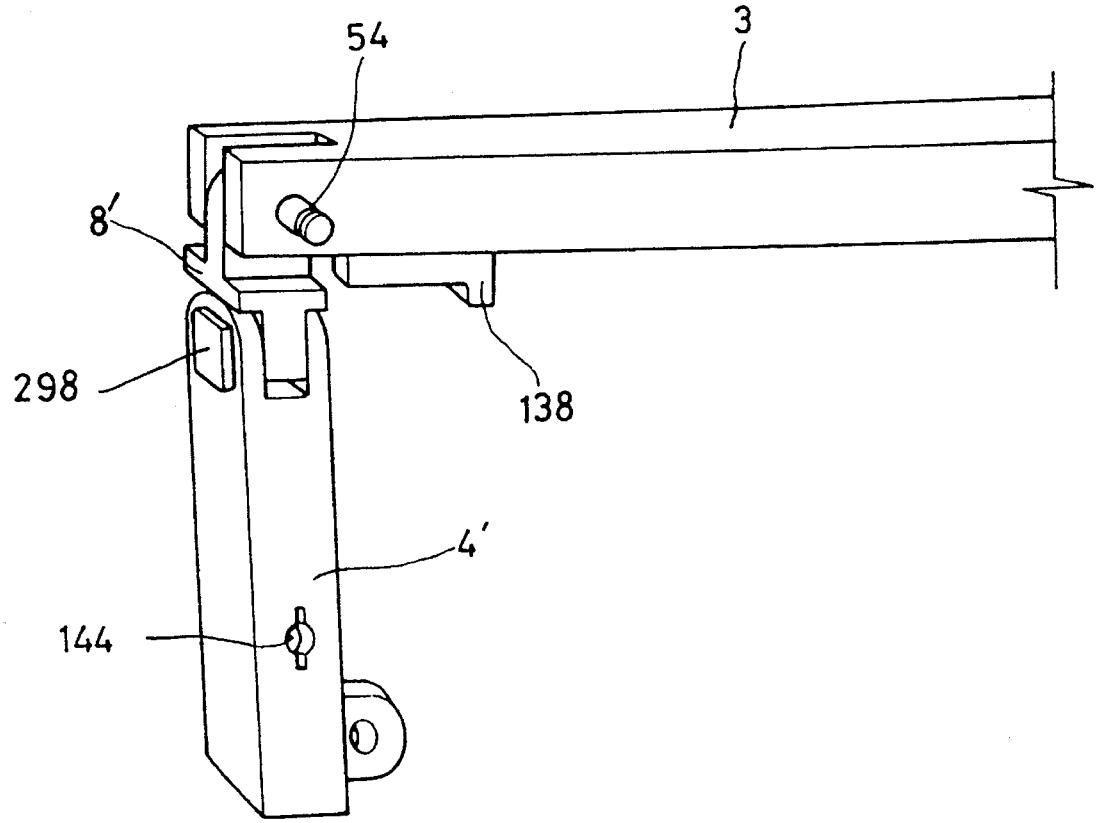
FIG. 76 is an enlarged exploded view of another embodiment of an exercise loading unit of this invention.
Figure 77:
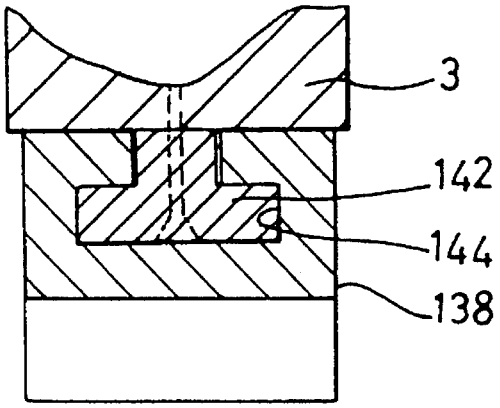
FIG. 77 is an enlarged sectional view of the exercise loading unit of FIG. 76 for showing a stopper.
Figure 78:
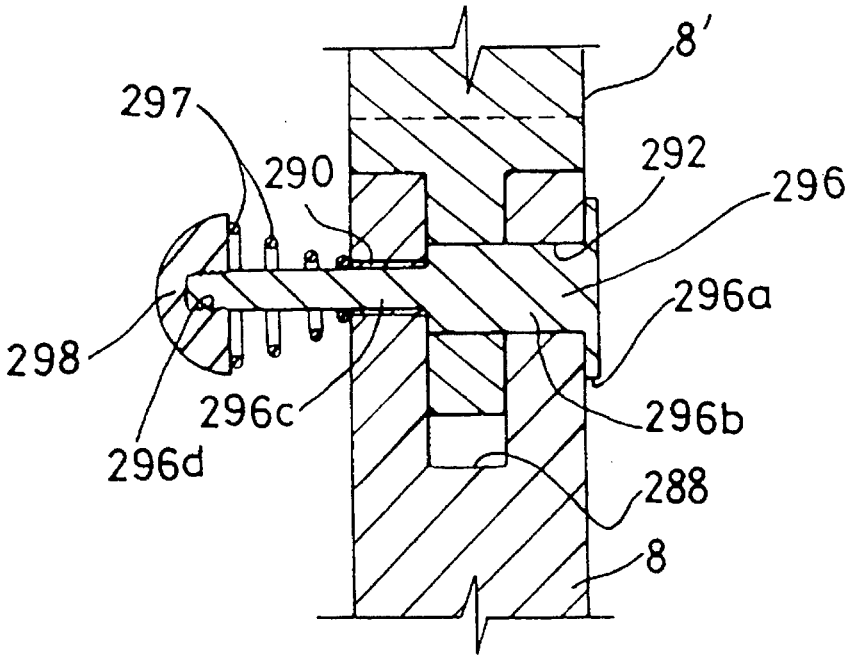
FIG. 78 is an enlarged sectional view of the exercise loading unit of FIG. 76 for showing a direction conversion pin.

FIGS. 76 to 78 illustrate a modification of the embodiment shown in FIG. 70. In accordance with this embodiment, a connecting member 8' is pivotally mounted to one end of the lever 3, to pivot in leftward and rightward directions. To the lower portion of connection member 8', a connecting link 4' is connected by means of a direction conversion pin 296 and an adjusting knob 298. A stopper 138 is provided at the lower portion of the lever 3, so as to selectively prevent the frontward and backward pivotal movements of the connecting member 8' and connecting link 4'.

Figure 79:
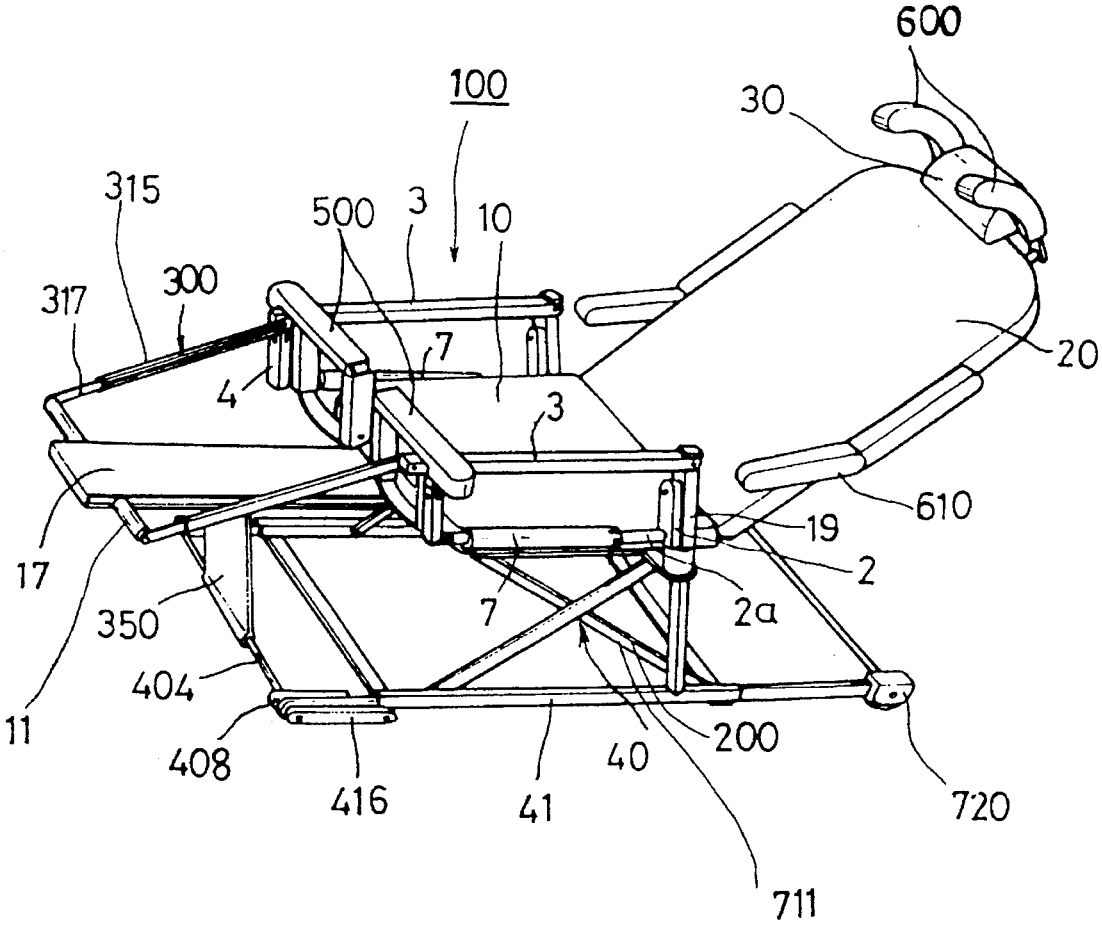
FIG. 79 is a perspective view of another embodiment of an exercise device of this invention combined with the exercise loading unit of FIGS. 76 to 78.
Figure 80:
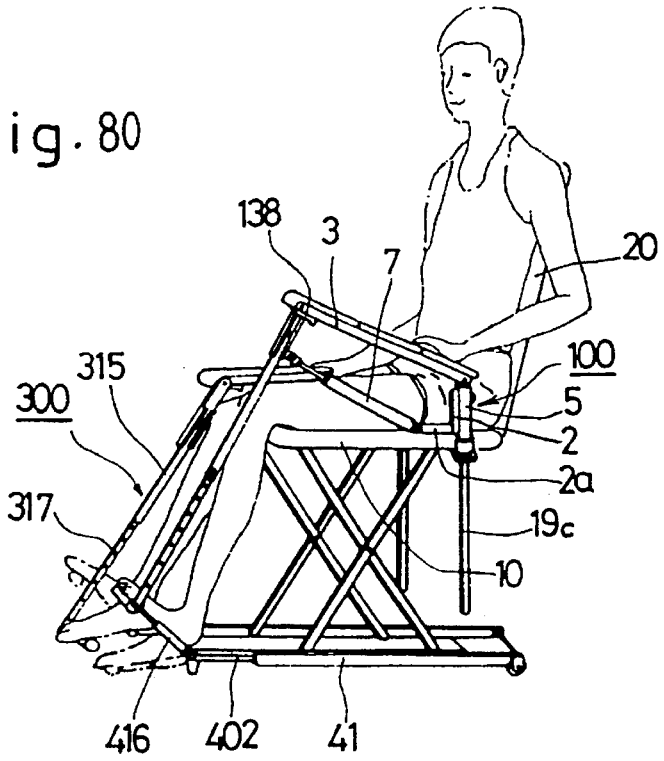
Figure 81:
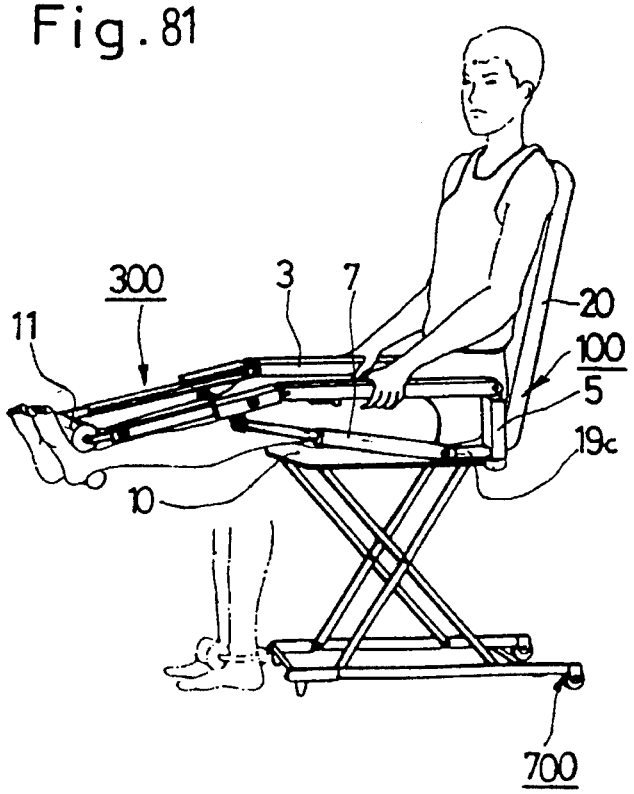
Figure 82:
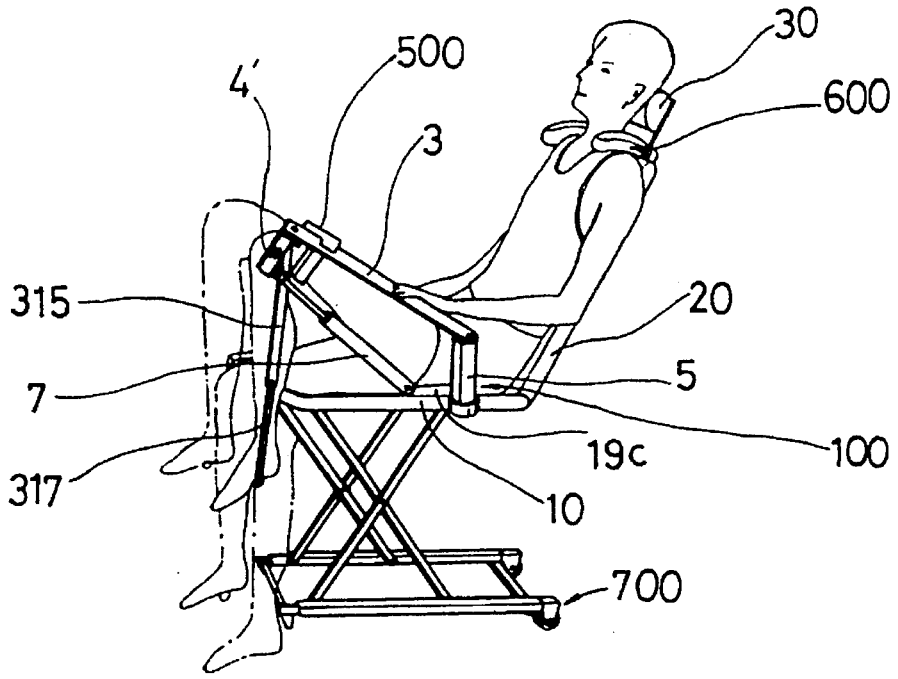
Figure 83:
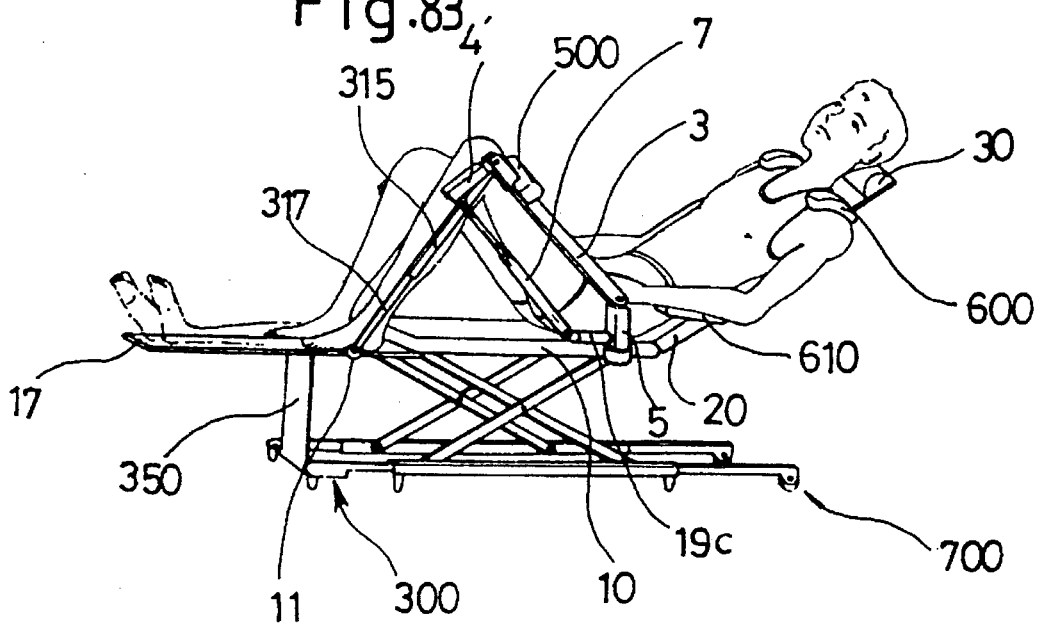

On the other hand, FIG. 79 illustrates a case using the exercise loading unit 100 shown in FIGS. 76 to 78 together with the body support unit 1, the leg support unit 300, the knee support unit 500 and the reaction restraining unit 600 and the back plate support member 700. In this case, an exercise in upward, downward, frontward and backward directions can be achieved, as shown in FIGS. 80 to 83. Although not shown, inward and outward exercise in leftward and rightward directions can be also achieved.

Referring to FIGS. 84 to 86 and FIGS. 87 to 101, there are illustrated load generators of various types such as an elastic bar type and a hydraulic cylinder type, which can be applied to various exercise devices mentioned above.

First, a case wherein the load generator 7 of the elastic bar type is coupled with a return force damper 450 will be described, in conjunction with FIGS. 84 to 86.

Figure 84:
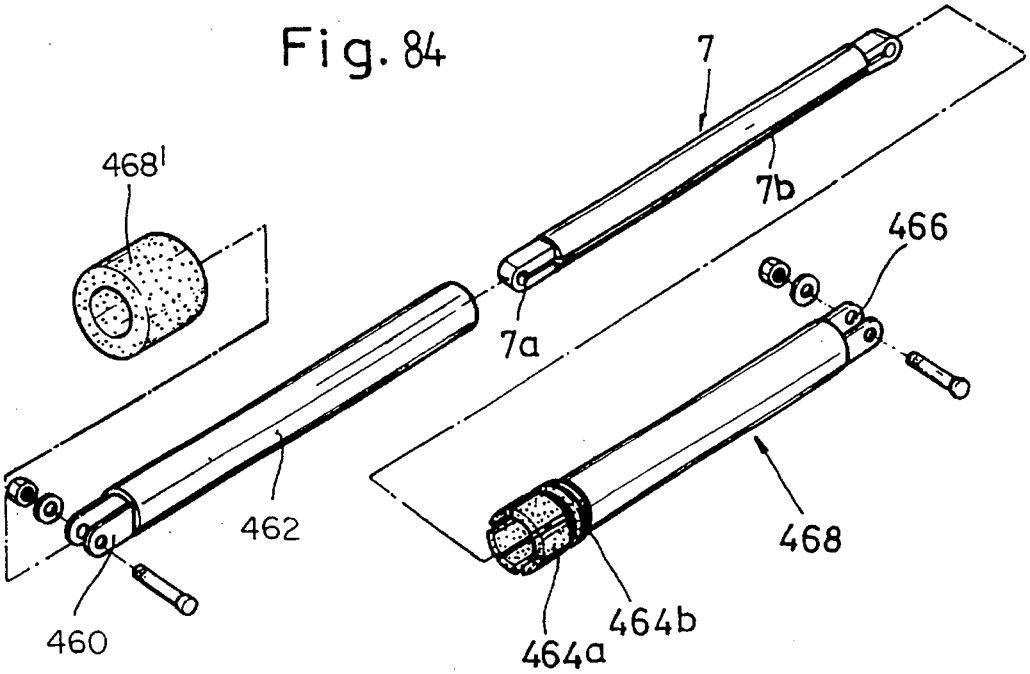
FIG. 84 is an exploded perspective view of a load generator of the exercise loading unit having a return force damper.
Figure 85:
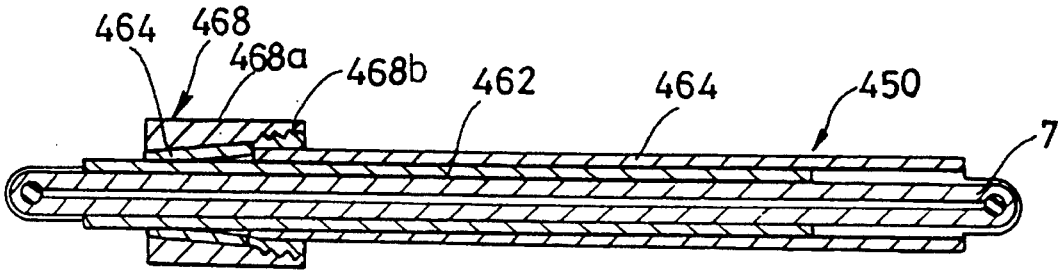
FIG. 85 is a sectional view of the assembled load generator of FIG. 84.
Figure 86:
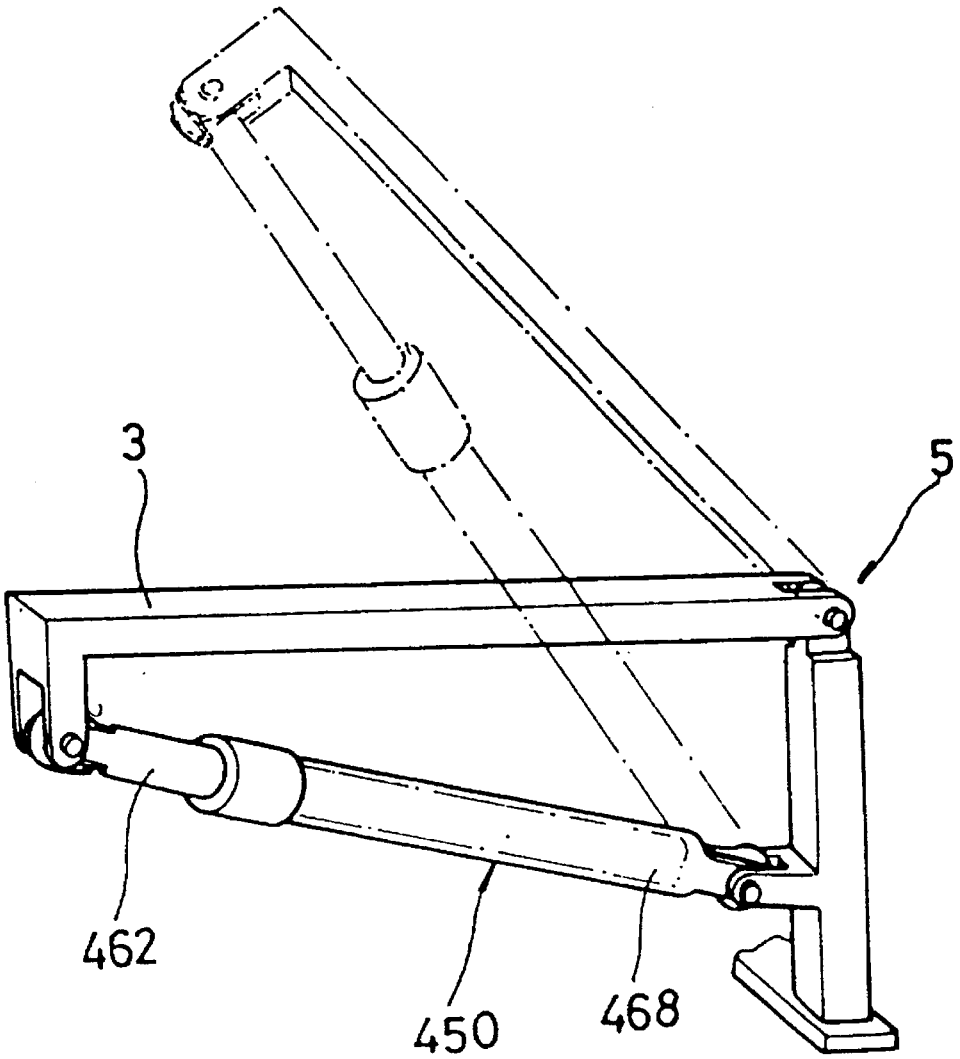
FIG. 86 is a perspective view of the operation of the load generator of FIG. 85.

As shown in FIGS. 84 to 86, the load generator 7 has a pair of mounting holes 7*a* at opposite ends thereof, respectively, and a dividing surface 7*b* formed between the mounting holes 7*a*. On the other hand, the return force damper 450 comprises a hollow movable member 462 having mounting holes 460 at one end thereof and receiving the load generator 7, a hollow friction member 464 provided at opposite ends thereof with a friction portion 464*a* slitted partially and a threaded portion 464*b*, respectively, and a hollow fixed member 468 connected at one end thereof with the friction member 464 and provided at the other end thereof with mounting holes 466. The fixed member 468 receives the movable member 462 carrying the load generator 7 such that the mounting hole 7*a* of the load generator 7 is aligned with the mounting holes 466 of the fixed member 468. The return force damper 450 also comprises a press ring 468' having its inner surface a taper surface 468*a* and a threaded portion 468*b*. The press ring 468' is fitted around the friction portion 464*a* of the friction member 464 such that its threaded portion 468*b* is engaged with the threaded portion 464*b* of the friction member 464.

Where the return force damper 450 carrying the load generator is coupled between the lever 3 and the turning support 5, as shown in FIG. 86, the load generator 7 extends upon an upward exercise. At this time, the movable member 462 is also moved in the fixed member 468. Thus, an exercise load force is generated. On the other hand, when the lever 3 is downwardly moved after the upward exercise, the movable member 462 is slowly retracted, together with the load generator 7, in that the friction member 464 of return force damper 450 is pressed against the outer surface of the movable member 462, by virtue of the taper surface 468a of the press ring 468'. As a result, the return force is greatly reduced, so that the device can be returned to its original state, without requiring a large force.

Now, various load generators 7 of the hydraulic cylinder type applied to various exercise devices mentioned above will be described, in conjunction with FIGS. 87 to 101.

First, some of the various load generators 7 will be described, in conjunction with FIGS. 87 to 95.

Figures 87, 87A, 87B:
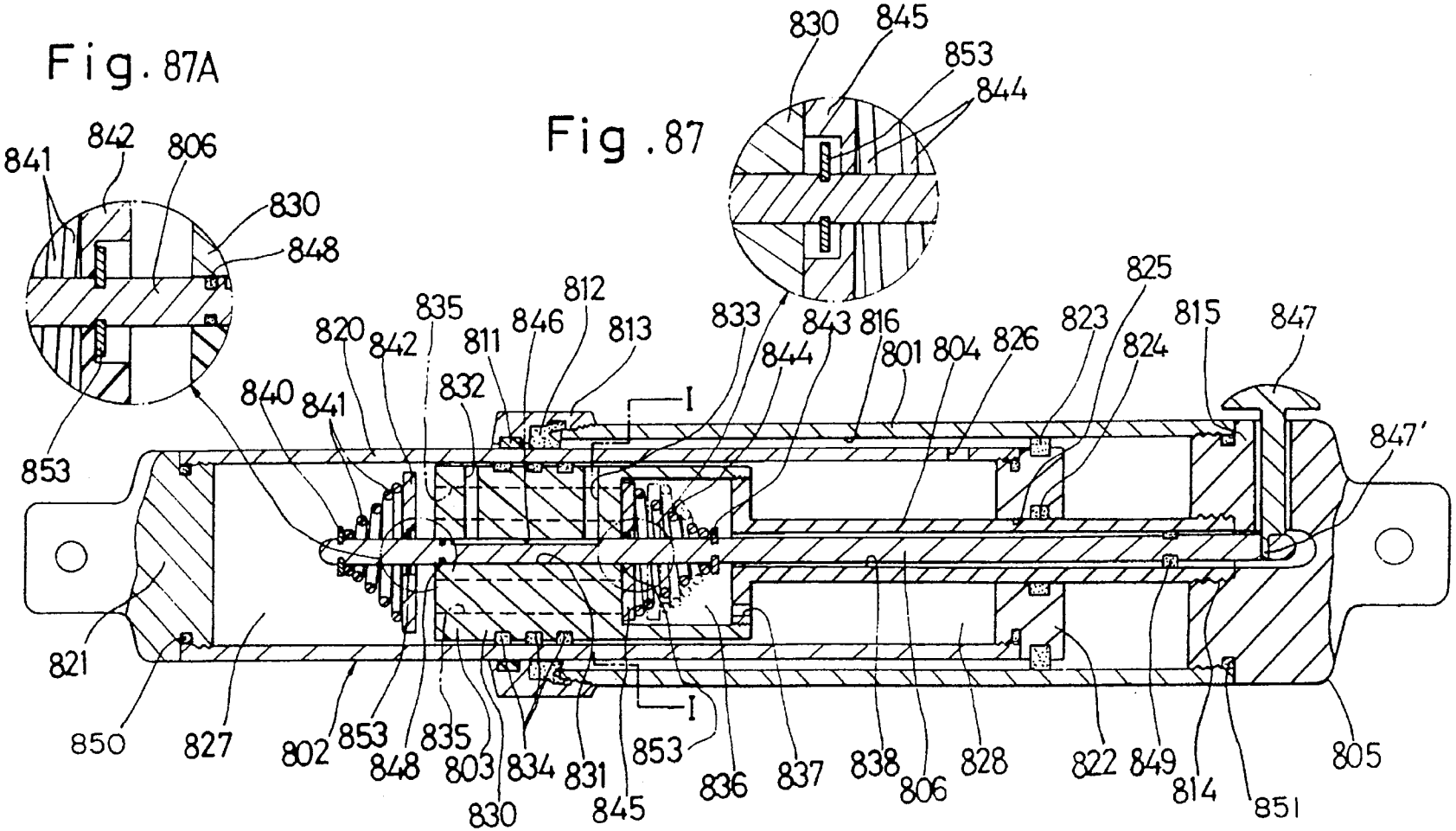
Figure 88:
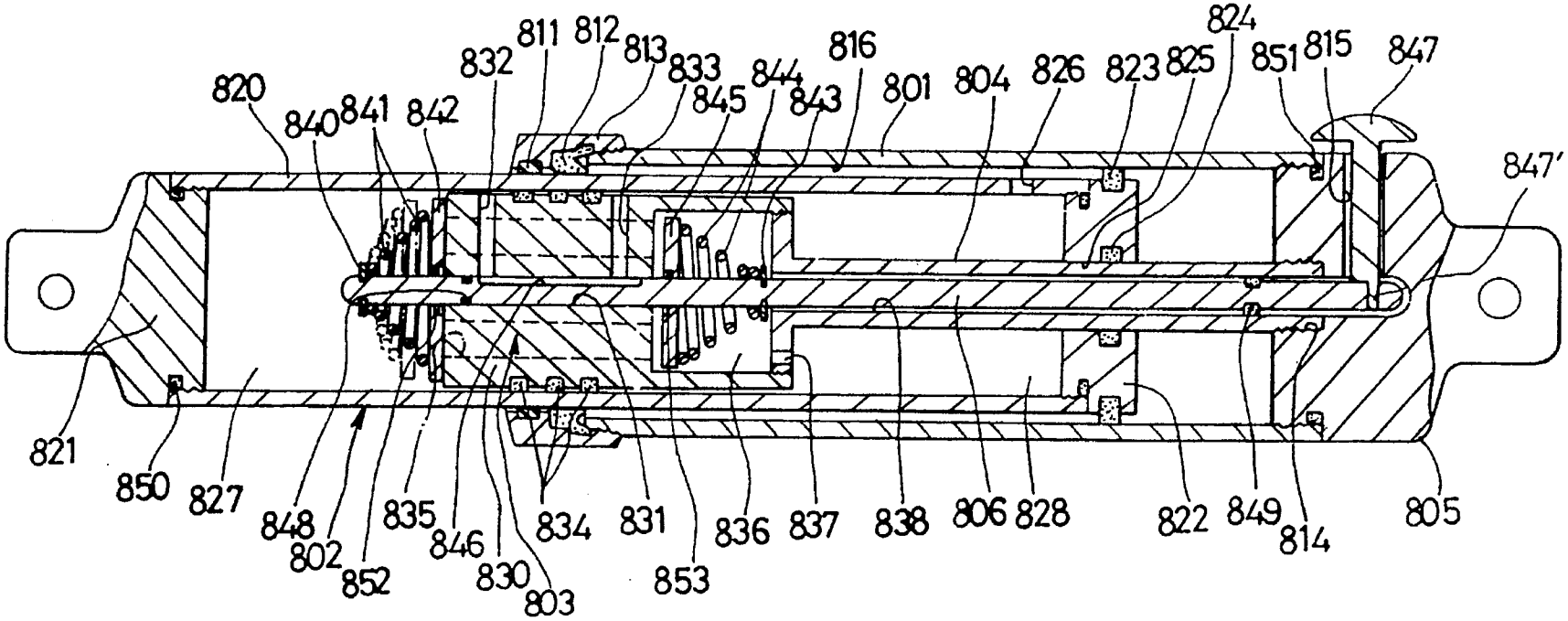

Referring to FIGS. 87 to 88, there is illustrated an example of devices used as the load generators 7 in accordance with the present invention.

As shown in the figures, the device is of a double cylinder construction which comprises an outer cylinder 801 and an inner cylinder 802 sealably fitted in the outer cylinder 801. The inner cylinder 802 comprises a cylinder tube 820 which has a rear end disposed backwardly of the outer cylinder 801 and a front end disposed forwardly of the outer cylinder 801, that is, forwardly protruded through and beyond the front end of outer cylinder 801. In the inner cylinder 802, a piston 803 is fitted which has a hollow piston rod 804 protruded through and beyond the rear end of inner cylinder 802. At its rear end, the outer cylinder 801 has a cylinder block 805 mounted thereto and adapted to close the rear end of outer cylinder 801. The piston rod 804 is coupled at its rear end to the cylinder block 805. Throughout the piston 803 and piston rod 804, an adjusting rod 806 extends axially to have an front end protruded forwardly of the piston 803 and a rear end protruded backwardly of the rear end of the piston rod 804.

To the front end of outer cylinder 801, an annular seal member 813 is threadedly coupled which has a wear ring 811 and a seal ring 812. The cylinder block 805 is provided with an axial stepped hole 814 having a threaded hole portion receiving the rear end of piston rod 804 and a sector-shaped operating hole 815 extending radially and communicating with the axial stepped hole 814.

As shown in FIGS. 87 and 88, the inner cylinder 802 is maintained at sealed condition, by a pair of cylinder blocks 821 and 822 fitted in both ends of the inner cylinder 801 and the outer circumferential surface of cylinder 802. The inner cylinder block 822 has a central throughout hole 825 through which the piston rod 804 extends. An outer seal ring 823 is fitted around the outer circumferential surface of the inner cylinder block 822 and adapted to define together with the seal ring 812 an annular operating medium chamber 816 between the inner circumferential surface of cylinder 802. An inner seal ring 824 is also fitted around the inner circumferential surface of the inner cylinder block 822, so as to maintain a seal at the central throughout hole 825 of inner cylinder block 822 during when the inner cylinder 802 moves reciprocally along the piston rod 804. On the other hand, an operating medium communicating port 826 is provided at the cylinder tube 820, so as to communicate the interior of inner cylinder 802 with the annular operating medium chamber 816.

As shown in FIGS. 87 to 91, the piston 803 comprises a piston body 830 threadedly coupled at its rear end to the front end of piston rod 804. The piston body 830 includes a central throughout hole 831 through which the adjusting rod 806 passes, and a pair of axially spaced radial communicating passages 832 and 833 extending from the outer circumferential surface of the piston body to the central throughout hole 831. Between the radial communicating passages 832 and 833, a plurality of axially spaced seal rings 834 are fitted around the outer circumferential surface of piston body 830. By these seal rings 834, the interior of inner cylinder 802 is divided into two operating medium chambers 827 and 828 arranged at both sides of the piston 803. A plurality of axially extending communicating passages 835 are formed in the piston body 830 to be arranged uniformly along a circle having a radius smaller than that of the piston body 830. The front end of each communicating passage 835 is open to the front operating medium chamber 827. At the rear portion of piston body 830, a valve receiving chamber 836 is provided which is closed at its rear end by the front end of piston rod 804 coupled to the rear end of piston body. The valve receiving chamber 836 is communicated at its front end with the axial communicating passages 835 and thus communicated with the front operating medium chamber 827 via the axial communicating passages 835. The piston rod 804 has at its front end a communicating port 837 which serves to communicate the valve receiving chamber 836 with the rear operating medium chamber 828. For extending the adjusting rod 806, the piston rod 804 also has an axial throughout hole 838 axially aligned with the axial throughout hole 831 of piston body 830.

As shown in FIGS. 87 to 91, the adjusting rod 806 axially extends through the axial throughout hole 831 of piston body 830, the axial throughout hole 838 of piston rod 804 and the axial stepped hole 814 of cylinder block 805 such that its front and rear ends extend forwardly beyond the piston 803 and backwardly beyond the piston rod 804, respectively. In the throughout holes 831, 838 and 814, the adjusting rod 806 is able to rotate and axially move. In order to selectively open and close both ends of respective axial communicating passages 835, a pair of valves are provided at the front operating medium chamber 827 and the valve receiving chamber 836, respectively. The valve for selectively opening and closing front ends of axial communicating passages 835 comprises a valve seat 842 slidably fitted around the protruded front end portion of adjusting rod 806 near the front ends of axial communicating passages 835, a snap ring 840 fixedly fitted around the protruded front end of adjusting rod 806 and spaced forwardly apart from the valve seat 842, and a compression coil spring 841 disposed around the protruded front end portion of adjusting rod 806 between the snap ring 840 and the valve seat 842 and adapted to urge the valve seat 842 backwardly. In order to limit the backward sliding movement of the valve seat 842 to a predetermined position, a snap ring 853 is fixedly fitted around the front end portion of adjusting rod 806 at the same position. In similar, the valve for selectively opening and closing rear ends of axial communicating passages 835 comprises a valve seat 845 slidably fitted around the portion of adjusting rod 806 disposed in the valve receiving chamber 836 near the rear ends of axial communicating passages 835, a snap ring 834 fixedly fitted around the portion of adjusting rod 806 in the valve receiving chamber 836 and spaced backwardly apart from the valve seat 845, and a compression coil spring 844 disposed around the portion of adjusting rod 806 between the snap ring 843 and the valve seat 845 and adapted to urge the valve seat 845 forwardly. In order to limit the forward sliding movement of the valve seat 845 to a predetermined position, a snap ring 853 is fixedly fitted around the portion of adjusting rod 806 at the same position. According to axial positions of the adjusting rod 806, the valves mentioned above are opened at one and closed at the other, and vice versa.

The adjusting rod 806 also has a communication adjusting groove 846 formed axially at a portion of the circumferential surface of the adjusting rod portion axially extending between the radial communicating passages 832 and 833. The communication adjusting groove 846 serves to communicate the radial communicating passages 832 and 833 with each other selectively according to the rotation of the adjusting rod 806, but irrespective of the axial movement of the adjusting rod 806. To the rear end of adjusting rod 806 received in the axial hole 814 of cylinder block 805, an operating lever 847 is connected which is received in the sector-shaped operating hole 815 of cylinder block 805. The operating lever 847 is provided at its lower end with an eccentric shaft, namely a cam shaft 847' received in a cam groove (denoted by no reference numeral) formed at the rear end of adjusting rod 806. As will be described, the operating lever 847 can rotate and move along the sector-shaped operating hole 815 to carry out rotating and camming operations causing the adjusting rod 806 to rotate and axially move.

In order to maintain a seal during the rotation and axial movement, the adjusting rod 806 is provided with a pair of O-rings 848 and 849 disposed near the front and rear ends respectively.

The reference numerals 850 and 851 denote O-rings fitted around the cylinder blocks 821 and 805, respectively.

Figure 93:
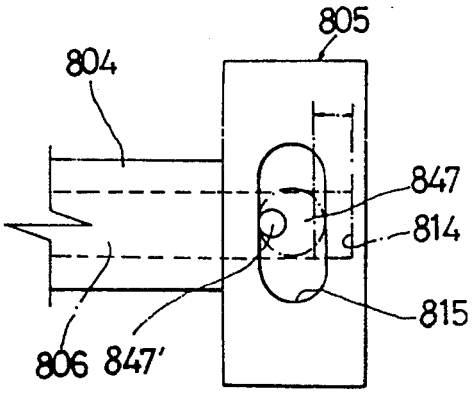
Figure 94:
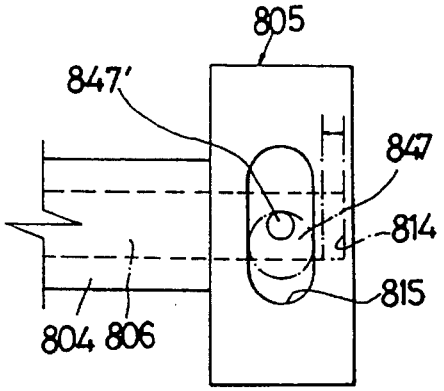
Figure 95:
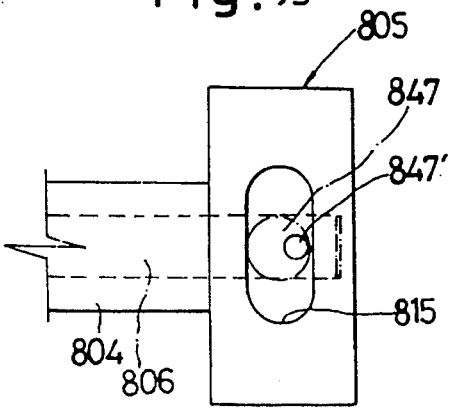

In the above-mentioned construction, when the cylinders 801 and 802 are required to be pulled from each other, that is, to move to their stretched positions, the operating lever 806 is first rotationally adjusted to be positioned at its front position shown in FIGS. 88 and 93. At the front position, the adjusting rod 806 is maintained as having been forwardly moved along the axial throughout holes 831 and 838. At this time, the valve seat 845 is in contact with the facing rear end surface of piston body 830 to close the rear ends of axial communicating passages 835, while the valve seat 842 is spaced apart from the facing front end surface of piston body 830 to open the front ends of axial communicating passages 835.

Figure 89:
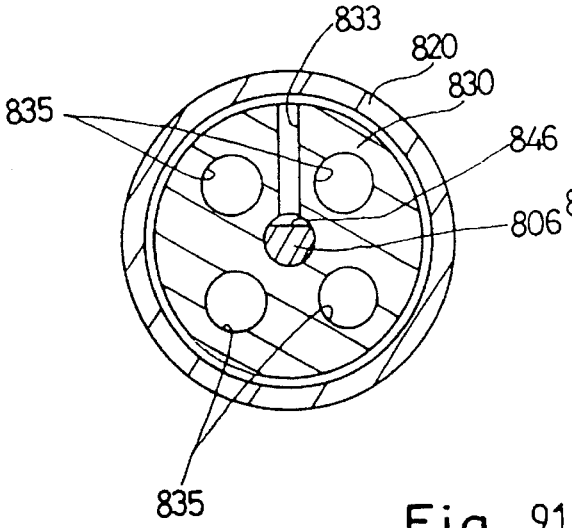
Figure 90:
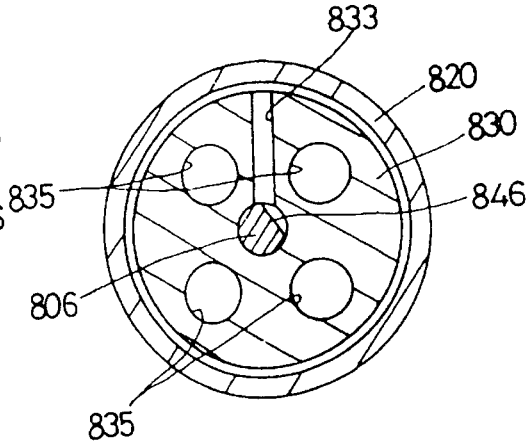
Figure 91:
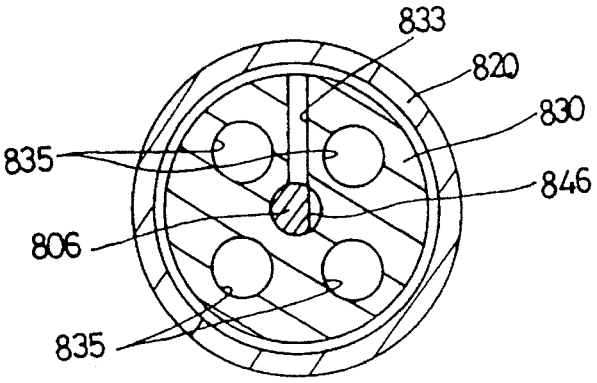

As the cylinders 801.and 802 are pulled from each other to move to their stretched positions under the above-mentioned condition, the internal operating medium contained in the operating medium chambers 816 and 828 and the valve receiving chamber 836 is forced to flow into the front operating medium chamber 827 via the radial communicating passage 833, the axial communication adjusting groove 846 and the radial communicating passage 832. The flow rate of the operating medium can be adjusted by controlling the communication area of the axial communication adjusting groove 846, as shown in FIGS. 89 to 92. This control can be achieved by rotating the adjusting rod 806 according to the movement of operating lever 847 along the sector-shaped operating hole 815. By adjusting the flow rate of the operating medium, it is possible to obtain effects in various modes, that is, a low load effect as shown in FIG. 89, a medium load effect as shown in FIG. 90 and a braking effect as shown in FIG. 91. Although not shown, the load force can be controlled at various levels by precisely adjusting the communication area of axial communication adjusting groove 846 according to the movement angle of operating lever 847.

When the cylinders 801 and 802 are pushed toward each other to return to their original retracted positions under the above-mentioned condition, the operating medium contained in the front operating medium chamber 827 exerts a pressure in the axial communicating passages 835 and urge backwardly the valve seat 845 at the rear ends of axial communicating passages 835, against the force of compression spring 844, as indicated by the dotted line of FIG. 88, thereby causing the axial communicating passages 835 to be opened at their rear ends. Accordingly, the operating medium from the front operating medium chamber 827 can be allowed to flow through the opened axial communicating passages 835 into the valve receiving chamber 836 and the operating medium chambers 816 and 828. The operating medium is also allowed to flow into the rear operating medium chamber 828 through the still opened radial communicating passage 832, axial communication adjusting groove 846 and radial communicating passage 833. However, the flow rate of operating medium in the latter case is very small and a main part of the operating medium flows into the rear operating medium chamber 828 through the axial communicating passages 835. As a result, the flowing of operating medium can be easily carried out, so that the return of cylinders 801 and 802 can be easily achieved with few load.

Where a control in load force is required during the return operation of cylinders 801 and 802, the axial communicating passages 835 are closed at their front ends to permit the operating medium in the front operating medium chamber 827 to flow into the rear operating medium chamber 828 through the radial communicating passage 832, axial communication adjusting groove 846 and radial communicating passage 833, as shown in FIG. 88. The closing of axial communicating passages 835 is achieved by rotating the operating lever 847 from the position shown in FIG. 93 via the position shown in FIG. 94 to the position shown in FIG. 95 in clockwise. That is, the rotation of operating lever 847 causes the adjusting rod 806 to move backwardly along the axial throughout holes 831 and 838, so that the valve seat 842 comes into contact with the facing front end surface of piston body 830 and thus closes the front ends of axial communicating passages 835. Under this condition, as the cylinders 801 and 802 are pushed toward each other to return to their retracted positions, the operating medium in the front operating medium chamber 827 flows into the rear operating medium chamber 828 totally through the radial communicating passage 832, axial communication adjusting groove 846 and radial communicating passage 833. Therefore, it is possible to control the load force, by properly adjusting the axial communication adjusting groove 846 according to the rotation of the adjusting rod 806 caused by the adjustment of operating lever 847 along the sector-shaped operating hole 815.

When the cylinders 801 and 802 are pulled again from each other to move to their stretched positions under the condition that the axial communicating passages 835 are still closed at their front ends, the operating medium contained in the valve receiving chamber 836 and rear operating medium chamber 828 exerts a pressure in the axial communicating passages 835 and urge forwardly the valve seat 842 at the front ends of axial communicating passages 835, against the force of compression spring 841, as indicated by the dotted line of FIG. 88, thereby causing the axial communicating passages 835 to be opened at their front ends. Accordingly, a main part of the operating medium from the rear operating medium chamber 828 can be allowed to flow through the opened axial communicating passages 835 into the front operating medium chamber 827, although a very small part of the operating medium passes through the radial communicating passage 833, axial communication adjusting groove 846 and radial communicating passage 832. As a result, the flowing of operating medium can be easily carried out, so that the movements of cylinders 801 and 802 to their stretched positions can be easily achieved with few load.

Figure 96:
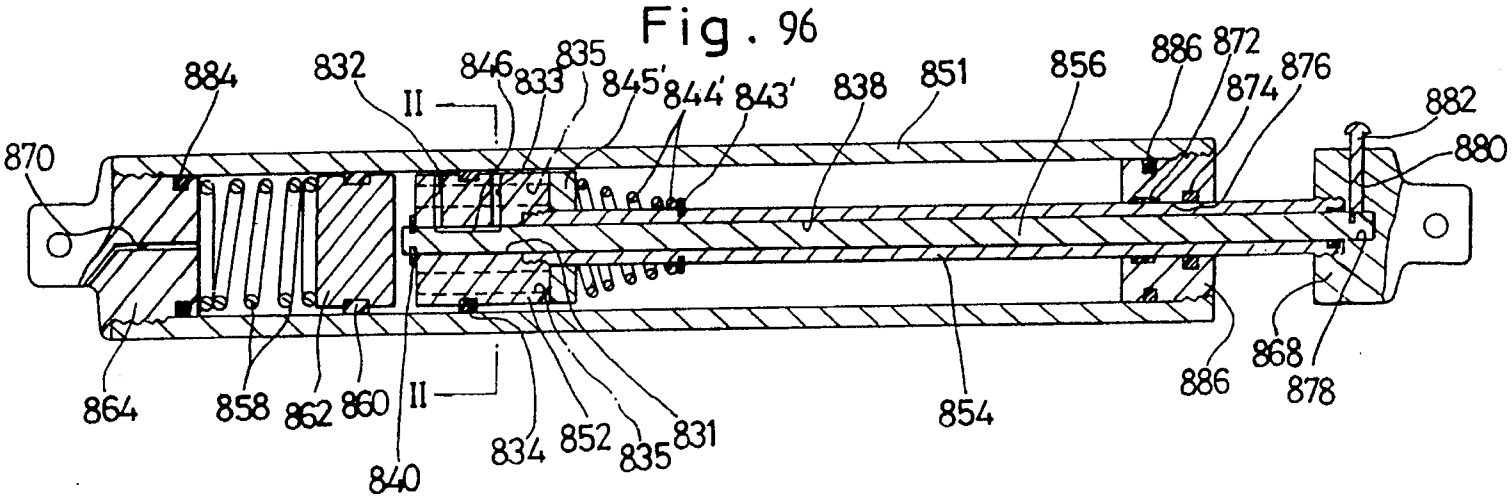
Figure 97:
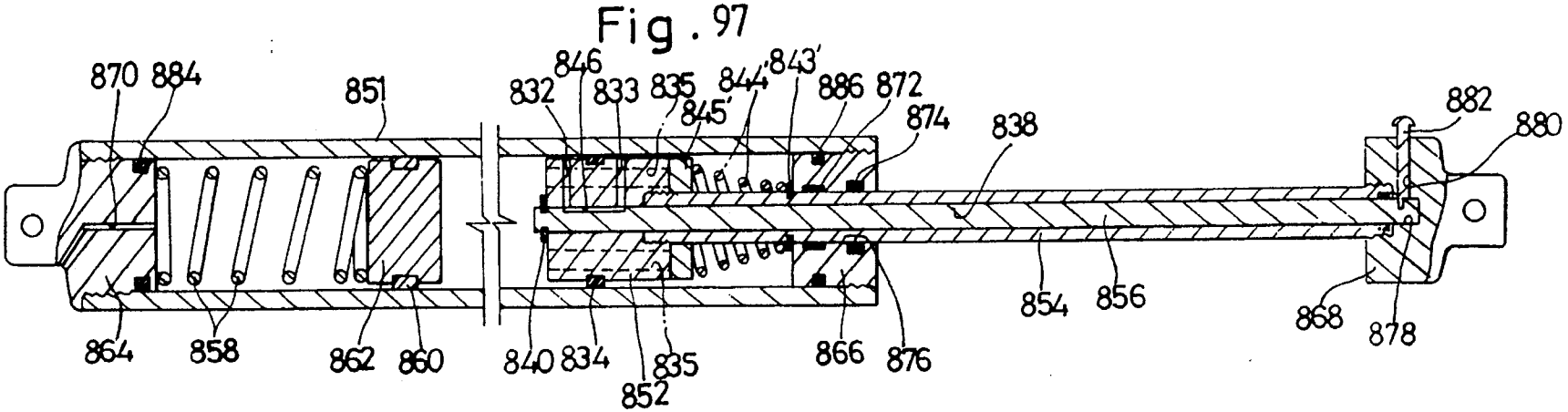
Figure 98:
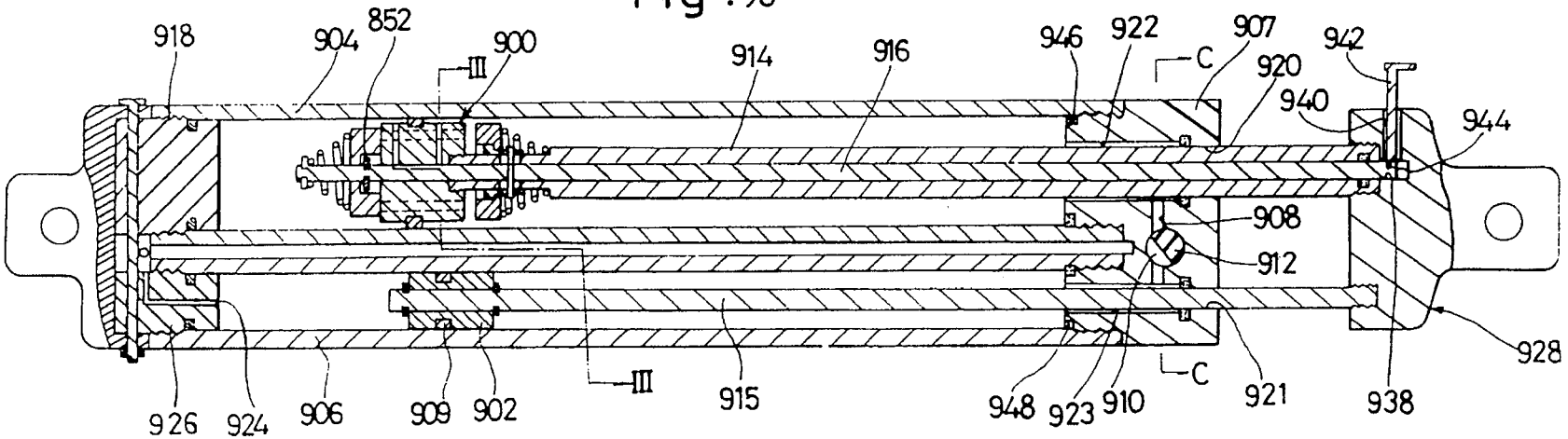
FIG. 98 is a sectional view of another embodiment of a load generator of this invention.
Figure 100:
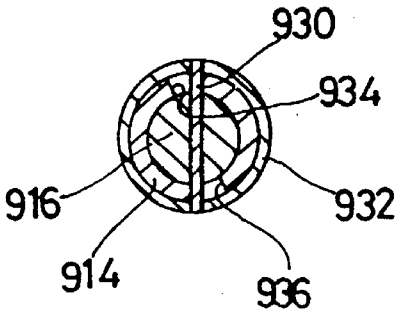
FIG. 100 is a sectional view of the load generator taken along the section line B—B of FIG. 99.

Referring to FIGS. 96 and 97, there is illustrated another device with a construction modified from the above-mentioned embodiment.

As shown in FIGS. 96 and 97, the device comprises a cylinder tube 851 in which a piston 852 is slidably disposed. A piston rod 854 is threadedly coupled at its front end to the rear end of piston 852. The piston 852 and the piston rod 854 have axial throughout holes 831 and 838, respectively, through which an adjusting rod 856 extends axially to rotate. To both ends of the cylinder tube 851, end members 864 and 866 are threadedly coupled, respectively. In the cylinder tube 851, a reciprocating block 862 is slidably disposed between the front end member 864 and the piston 852. Between the front end member 864 and the reciprocating block 862, a compression spring 858 is disposed to urge the reciprocating block 862 backwardly, namely, toward the piston 852. A seal ring 860 is fitted around the outer circumferential surface of reciprocating block 862.

The front end member 864 has an air communication port 870 for communicating a space defined between the front end member 864 and the reciprocating block 862 in the cylinder tube 851, with external, so that the space is maintained under atmosphere pressure. The rear end member 866 has a throughout hole 876 through which the piston rod 854 moves reciprocally and is protruded backwardly. To provide a seal at the throughout hole 876, a pair of spaced seal rings 872 and 874 are disposed around the inner circumferential surface of rear end member 866. To the protruded rear end of piston rod 854, an adjusting block 868 is threadedly coupled which has an axial hole 878 for receiving the protruded rear end of adjusting rod 856.

The adjusting block 868 is also provided with a sector-shaped radial operating hole 880 communicating with the axial hole 878. In the operating hole 880, an operating lever 882 is received which is coupled to the rear end of adjusting rod 854.

The reference numerals 884 and 886 denote seal rings fitted around outer circumferential surfaces of end members 864 and 866, respectively.

The device of this embodiment is exclusively used where a control in load force is required when a stretching operation is carried out. When the device moves from the retracted state shown in FIG. 96 to the stretched state shown in FIG. 97, the operating medium contained in a rear chamber defined between the piston 852 and the rear end member 866 in the cylinder tube 851 is forced to flow into a front chamber defined between the piston 852 and the reciprocating block 862, through the radial communicating passage 833, axial communication adjusting groove 846 and radial communicating passage 832. At this time, it is possible to control the load force, by properly adjusting the communication area of axial communication adjusting groove 846 according to the rotation of the adjusting rod 856 caused by the adjustment of operating lever 882 along the sector-shaped operating hole 880, as shown in FIGS. 89 to 91.

Since the cross-section of the rear chamber is smaller than the cross-section of the front chamber in that the piston rod 854 is disposed throughout the axial length of the rear chamber, the chambers are different from each other in terms of the volume per length. This difference is offset by a backward movement of the reciprocating block 862 caused by the urging force of compression spring 858. Thus, the stretching operating is smoothly carried out.

On the other hand, when the device moves from the stretched state shown in FIG. 97 to the retracted state shown in FIG. 96, the operating medium contained in the front chamber exerts a pressure in the axial communicating passages 835 of piston 852 and urge backwardly the valve seat 845' at the rear ends of axial communicating passages 835, against the force of compression spring 844', thereby causing the axial communicating passages 835 to be opened at their rear ends. Accordingly, a main part of the operating medium from the front chamber can be allowed to flow through the opened axial communicating passages 835 into the rear chamber, so that the device returns to the state shown in FIG. 96 without any considerable resistance. The reciprocating block 862 also returns to its original position, against the force of compression spring 858.

As apparent from the above description, the device of this embodiment enables the control in load force, only when a stretching operation is carried out.

Referring to FIGS. 98 to 101, there is illustrated a control device with a construction modified from those of the above-mentioned embodiments.

In this embodiment, the device is of a double cylinder construction which comprises a pair of cylinders 904 and 906 disposed axially in parallel to each other and fixedly mounted together to a cylinder block 907. A piston 900 is slidably disposed in the cylinder 904. The piston 900 has a central throughout hole 831, a pair of axially spaced radial communicating passages 832 and 833 communicating with the central throughout hole 831, a piston ring 834 fitted around the outer circumferential surface of the piston 900, and a plurality of axial communicating passages 835, as in the above-mentioned embodiments. To the rear end of piston 900, a piston rod 914 is threadedly coupled. Through the central throughout hole 831 of piston 900, an adjusting rod 916 extends axially. The adjusting rod 916 also extends through the piston rod 914. In the cylinder 906, a piston 902 is slidably disposed which has a piston ring 909 fitted around its outer circumferential surface. A piston rod 914 is coupled to the piston 902.

An end member 918 is threadedly coupled to the front end of cylinder 904 to close the same end. Another end member 926 is threadedly coupled to the front end of cylinder 906 to close the same end. Differently from the end member 918, the end member 926 has an air communication port 924 for communicating a space defined between the end member 926 and the piston 902 in the cylinder 906, with external, so that the space is maintained under atmosphere pressure. The other ends of cylinders 904 and 906 are closed by the cylinder block 907 threadedly coupled thereto.

Figure 99:
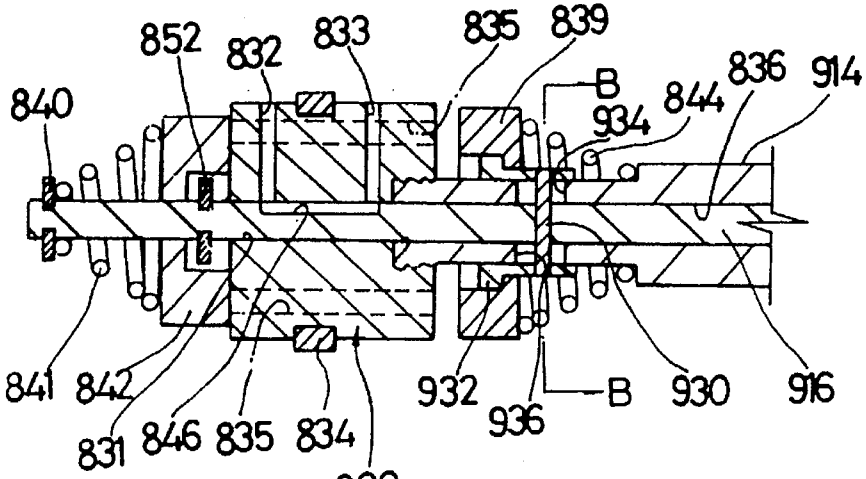
FIG. 99 is an enlarged sectional view of the load generator of FIG. 98.
Figure 101:
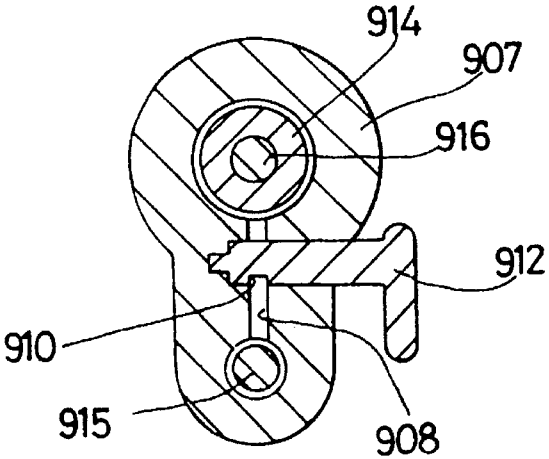
FIG. 101 is a sectional view of the load generator taken along the section line C—C of FIG. 98.

The piston rod 914 which is threadedly coupled at its front end to the piston 900 has an axial throughout hole 836 through which the adjusting rod 916 extends axially. At the front end of piston rod 914, a valve is disposed which serves to open and close the rear ends of axial communicating passages 835 formed in the piston 900. The piston rod 914 is provided at its front end with a smaller diameter portion for fitting the valve therearound and a pair of radially aligned holes 934 and 936 communicating with the throughout hole 836, as shown in FIG. 99. Each of the holes 934 and 936 has a predetermined axial length and a predetermined peripheral length. The valve comprises a sliding member 932 slidably fitted around the smaller diameter portion of piston rod 914 and provided at its front end with an engaging portion. The sliding member 932 is also fixedly mounted to a protruding pin 930 which is fixed to the adjusting rod 916 and protruded through the holes 934 and 936 of piston rod 914. With this construction, the sliding member 932 slides axially along the smaller diameter portion of piston rod 914 as the protruding pin 930 moves axially in the holes 934 and 936 by the axial movement of adjusting rod 916. By the provision of holes 934 and 936 having the predetermined axial length and the predetermined peripheral length, the axial and rotational movements of adjusting rod 916 and thus the movements of sliding member 932 are carried out without any interference with the piston rod 914. The valve also comprises a valve seat 839 slidably fitted around the sliding member 932 and provided at its rear end with an engaging portion selectively engagable with the engaging portion of sliding member 932, and a compression spring 844 disposed around the smaller diameter portion of piston rod 914 and adapted to urge always the valve seat 839 forwardly, namely, toward the direction of closing the rear ends of axial communicating passages 835 of the piston 900. The compression spring 844 also urges always the valve seat 839 such that the engaging portion of valve seat 839 is engaged with the engaging portion with the sliding member 932.

The adjusting rod 916 which extends axially through throughout holes 831 and 836 of the piston 900 and piston rod 914 has a front end protruded forwardly beyond the front end of piston 900. The adjusting rod 916 also has a communication adjusting groove 846 formed axially at a portion of the circumferential surface of the adjusting rod portion axially extending between the radial communicating passages 832 and 833.

At the front end of adjusting rod 916, another valve is disposed which serves to open and close the front ends of axial communicating passages 935 of the piston 900. The valve comprises a snap ring 840, a compression spring 841, a valve seat 842 and a snap ring 852. These elements of the valve are the same as those of the previous embodiment, and thus their detailed description is omitted.

The cylinder block 907 has a pair of throughout holes 920 and 921 through which the piston rods 914 and 915 extend backwardly beyond the cylinder block 907. The throughout holes 920 and 921 has large diameter portions for providing annular communicating passages 922 and 923 around the portions of piston rods 914 and 915 disposed in the cylinder block 907. The cylinder block 907 also has a communicating passage 908 communicating at both ends thereof with the annular communicating passages 922 and 923 to communicate the interiors of cylinders 904 and 906 with each other.

An adjusting lever 912 is fitted in the cylinder block 907 and provided with a communication adjusting groove 910 which is selectively aligned with the communicating passage 908 according to the rotational adjustment of adjusting lever 912, to open the communicating passage 908. The adjusting lever 912 can adjust the opening of the communicating passage 908.

Figure 92:
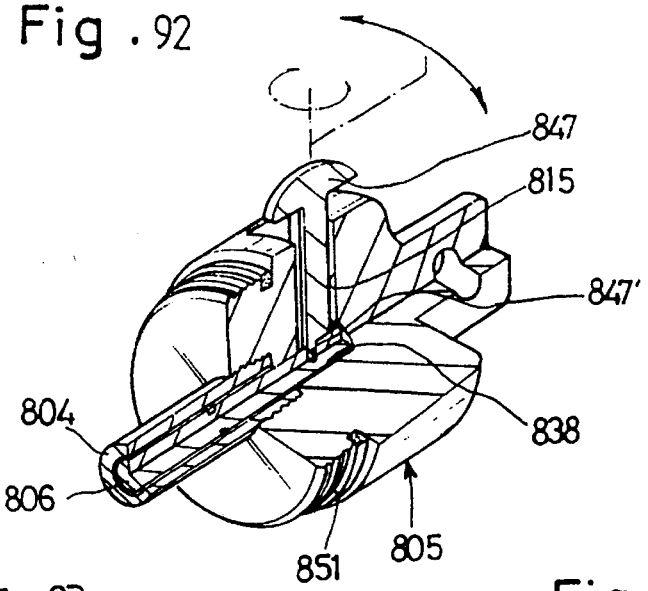

A fixed block 928 is threadedly coupled to the rear ends of piston rods 914 and 915 protruded backwardly beyond the cylinder block 907. The block 928 has an axial hole 938 receiving the rear end of adjusting rod 916 which is protruded backwardly beyond the rear end of piston rod 914. The block 928 also has a sector-shaped operating hole 940 extending radially and communicating with the axial hole 938. To the rear end of adjusting rod 916 received in the axial hole 938 of block 928, an operating lever 942 is connected which is received in the sector-shaped operating hole 940 of block 928. The operating lever 942 is provided at its lower end with an eccentric shaft, namely a cam shaft 944 received in a cam groove (denoted by no reference numeral) formed at the rear end of adjusting rod 916. In the same manner as in the previous embodiment, the operating lever 942 can rotate and move along the sector-shaped operating hole 940 to carry out rotating and camming operations causing the adjusting rod 916 to rotate and axially move. As the operating lever 942 moves along the sector-shaped operating hole 940, the adjusting rod 916 rotates to adjust the communication area of the axial communication adjusting groove 946 communicating with the communicating passages 832 and 833 of piston 900, in the same manner as shown in FIGS. 90 to 92. By this adjustment, it is possible to control the flow rate of operating medium flowing between operating medium chambers defined in the cylinder 904 at both sides of the piston 900, during the reciprocating movement of piston 900. On the other hand, the rotation of operating lever 942 causes the adjusting rod 916 to move forwardly or backwardly along the axial throughout holes 831 and 836. By forward movement of adjusting rod 916, the valve seat 839 comes into contact with the facing rear end surface of piston 900 and thus closes the rear ends of axial communicating passages 835. At this time, the valve seat 842 moves forwardly away from the facing front end surface of piston 900 and thus opens the front ends of axial communicating passages 835. On the other hand, the backward movement of adjusting rod 916 causes the valve seat 842 to come into contact with the facing front end surface of piston 900 and thus closes the front ends of axial communicating passages 835. At this time, the valve seat 839 moves backwardly away from the facing rear end surface of piston 900 and thus opens the rear ends of axial communicating passages 835.

Now, the operations of the above-mentioned construction will be described.

Where a control in load force is required when the pistons 900 and 902 fixed to the block 928 by means of the piston rods 914 and 915 are pulled backwardly from the cylinders 904 and 906 fixed to the cylinder block 907, to move to their stretched positions, the operating lever 916 is first rotationally adjusted to be positioned at its front position shown in FIG. 93. At the front position, the adjusting rod 916 is maintained as having been forwardly moved along the axial throughout holes 831 and 836. At this time, the valve seat 839 is in contact with the facing rear end surface of piston 900 to close the rear ends of axial communicating passages 835, while the valve seat 842 is spaced apart from the facing front end surface of piston 900 to open the front ends of axial communicating passages 835.

As the pistons 900 and 902 are pulled relatively to the cylinders 904 and 906 under the above-mentioned condition, the internal operating medium contained in a rear operating medium chamber defined in the cylinder 904 at the rear side of piston 900 is forced to flow into a front operating medium chamber defined in the cylinder 904 at the rear side of piston 900 via the radial communicating passages 833, the axial communication adjusting groove 846 and the radial communicating passage 832. Simultaneously, the internal operating medium contained in an operating medium chamber defined in the cylinder 906 is forced to flow into the rear operating medium chamber of cylinder 904 via the annular communicating passage 923, the communicating passage 908, the communication adjusting groove 910 and the annular communicating passage 922. The flow rate of the operating medium in the cylinder 904 can be adjusted by controlling the communication area of the axial communication adjusting groove 846 in the same manner as shown in FIGS. 89 to 91. This control can be achieved by rotating the adjusting rod 916 according to the movement of operating lever 942 along the sector-shaped operating hole 940. The flow rate of the operating medium flowing from the cylinder 906 to the cylinder 904 can be adjusted by controlling the communication area of the axial communication adjusting groove 910. This control can be achieved by rotating the adjusting lever 912. By adjusting both the operating lever 942 and the adjusting lever 912, it is possible to achieve more precise and uniform control of load force.

On the other hand, when the pistons 900 and 902 are pushed forwardly into the cylinders 904 and 906 to return to their original retracted positions under the above-mentioned condition, the operating medium contained in the front operating medium chamber of cylinder 904 exerts a pressure in the axial communicating passages 835 and urge backwardly the valve seat 839 at the rear ends of axial communicating passages 835, against the force of compression spring 844, thereby causing the axial communicating passages 835 to be opened at their rear ends. Accordingly, the operating medium from the front operating medium chamber can be allowed to flow through the opened axial communicating passages 835 into the rear operating medium chamber of cylinder 904. The operating medium is also allowed to flow into the rear operating medium chamber of cylinder 904 through the still opened radial communicating passage 832, axial communication adjusting groove 846 and radial communicating passage 833. However, the flow rate of operating medium in the latter case is very small and a main part of the operating medium flows into the rear operating medium chamber of cylinder 904 through the axial communicating passages 835. As a result, the flowing of operating medium can be easily carried out, so that the return of pistons 900 and 902 can be easily achieved with few load. Simultaneously with the flowing of operating medium in the cylinder 904, the operating medium contained in the rear operating medium chamber of cylinder 904 is forced to flow into the cylinder 906. The flow rate of operating medium flowing from the cylinder 904 to the cylinder 906 can be controlled by rotating properly the adjusting lever 912, so that the control of load force can be partially achieved during the return operation.

Of course, when the communicating passage 908 is shut off by the adjustment of adjusting lever 912, a braking effect can be obtained during the reciprocating movements of pistons 900 and 902. Since the space defined in the cylinder 906 between the piston 902 and the end member 926 is maintained under atmosphere pressure, by virtue of the air communication port 924 provided at the end member 926, the reciprocating movements of piston 902 and thus piston 900 are carried out without any interference.

Where the control in load force is required during when the pistons 900 and 902 are pushed forwardly into the cylinders 904 and 906 to return to their retracted positions, the axial communicating passages 835 are closed at their front ends to permit the operating medium in the front operating medium chamber of cylinder 904 to flow into the rear operating medium chamber of cylinder 904 through the radial communicating passage 832, axial communication adjusting groove 846 and radial communicating passage 833. The closing of axial communicating passages 835 is achieved by rotating the operating lever 942 from the position shown in FIG. 93 via the position shown in FIG. 94 to the position shown in FIG. 95 through an angle of 180°. That is, the rotation of operating lever 942 causes the adjusting rod 916 to move backwardly along the axial throughout holes 831 and 836, so that the valve seat 842 comes into contact with the facing front end surface of piston 900 and thus closes the front ends of axial communicating passage 835. At this time, the valve seat 839 is spaced apart from the facing rear end surface of piston 900. Under this condition, as the pistons 900 and 902 are pushed forwardly into the cylinders 904 and 906 to return to their retracted positions respectively, the operating medium in the front operating medium chamber of cylinder 904 flows into the rear operating medium chamber of cylinder 904 totally through the radial communicating passage 832, axial communication adjusting groove 846 and radial communicating passage 833. Simultaneously with the flowing of operating medium in the cylinder 904, the operating medium contained in the rear operating medium chamber of cylinder 904 flows into the cylinder 906, via the annular communicating passage 922, the communicating passage 908, the communication adjusting groove 910 and the annular communicating passage 923.

The flow rate of the operating medium in the cylinder 904 can be adjusted by controlling the communication area of the axial communication adjusting groove 846. This control can be achieved by rotating the adjusting rod 916 according to the movement of operating lever 942 along the sector-shaped operating hole 940. Simultaneously, the flow rate of operating medium flowing from the cylinder 904 to the cylinder 906 can be controlled by rotating properly the adjusting lever 912 and thus adjusting the communication area of the communication adjusting groove 910. By adjusting the operating lever 942 and the adjusting lever 912 simultaneously, therefore, it is possible to achieve more precise and uniform control of load force during the compressing operation.

On the other hand, when the pistons 900 and 902 are pulled again from the cylinders 904 and 906 to move to their stretched positions under the condition that the axial communicating passages 835 are still closed at their front ends, the operating medium contained in the rear operating medium chamber of cylinder 904 exerts a pressure in the axial communicating passages 835 and urge forwardly the valve seta 842 at the front ends of axial communicating passages 835, against the force of compression spring 841, thereby causing the axial communicating passages 835 to be opened at their front ends. Accordingly, a main part of the operating medium from the rear operating medium chamber of cylinder 904 can be allowed to flow through the opened axial communicating passages 835 into the front operating medium chamber of cylinder 904, although a very small part of the operating medium passes through the radial communicating passage 833, axial communication adjusting groove 846 and radial communicating passage 832. As a result, the flowing of operating medium in the cylinder 904 can be easily carried out. Simultaneously with the flowing of operating medium in the cylinder 904, the operating medium contained in the cylinder 906 flows into the rear operating medium chamber of cylinder 904. By controlling the flow rate of operating medium flowing from the cylinder 906 to the cylinder 904 with a rotation of the adjusting lever 912, the control of load force can be partially achieved during the stretching operation.

Of course, when the communicating passage 908 is shut off by the adjustment of adjusting lever 912, a braking effect can be obtained during the stretching movements of pistons 900 and 902.

Where the devices shown in FIGS. 87 to 95 and FIGS. 98 to 101 are applied as hydraulic cylinder type load generators to exercise devices, they can be used in a combined manner, for achieving upward, downward, frontward, backward, inward and outward exercises. On the other hand, the device shown in FIGS. 96 and 97 can be independently used.

As described above, the present invention provides an exercise device which is provided with a body support unit, an exercise loading unit and a leg support unit or the body support unit, the exercise loading unit and a knee support unit, and optionally provided with a reaction restraining member and a back plate support member and develops and conditions muscles by multidirectional exercises, i.e., upward, downward, frontward, backward, inward and outward exercises, for the upper and lower body. Particularly, this device easily efficiently provides a simple walking exercise of legs as well as a calf muscle exercise according to an ankle exercise, a thigh muscle exercise according to a knee exercise, an abdominal muscle exercise according to the thigh muscle exercise and etc. Furthermore, the exercise loading unit of this invention can be easily located at various positions corresponding to several kinds of exercises.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. In an exercise device for performing an exercise in a desired direction comprising body support means, said body support means being adapted for supporting the body of the user and including a seat plate, a back plate and a leg unit, an improvement comprising:

exercise loading means comprising:

a lever for transmitting an exercise load;

a turning support for causing said lever to turn in the same direction as that of the exercise, said turning support being provided at an end of said lever and rotatably supporting said lever; and a load generator for generating said exercise load, said load generator being provided at an end part of said lever;

leg support means for supporting the legs of the user, said leg supporting means cooperating with said exercise loading means and having a foothold unit; and wherein said leg support means comprises:

a connection unit being provided between a front end of said lever and said foothold unit; and a foothold support unit being provided at a front part of said seat plate of the body support means and being adapted for sliding said foothold unit thereon.

2. In an exercise device for performing an exercise in a desired direction comprising body support means, said body support means being adapted for supporting the body of the user and including a seat plate, a back plate and a leg unit, an improvement comprising:

exercise loading means comprising:

a lever for transmitting an exercise load;

a turning support for causing said lever to turn in the same direction as that of the exercise, said turning support being provided at an end of said lever and rotatably supporting said lever; and a load generator for generating said exercise load, said load generator being provided at an end part of said lever;

leg support means for supporting the legs of the user, said leg supporting means cooperating with said exercise loading means and having a foothold unit; and wherein said leg support means further comprises:

a knee support unit being mounted on a front end of said lever of the exercise loading means; and a connection unit being provided between said knee support unit and said foothold unit.

3. In an exercise device for performing an exercise in a desired direction comprising body support means, said body support means being adapted for supporting the body of the user and including a seat plate, a back plate and a leg unit, an improvement comprising:

exercise loading means comprising:

a lever for transmitting an exercise load;

a turning support for causing said lever to turn in the same direction as that of the exercise, said turning support being provided at an end of said lever and rotatably supporting said lever; and a load generator for generating said exercise load, said load generator being provided at an end part of said lever;

leg support means for supporting the legs of the user, said leg supporting means cooperating with said exercise loading means and having a foothold unit; and wherein said leg support means further comprises:

a knee support unit being mounted on a front end of said lever of the exercise loading means;

a connection unit being provided between said knee support unit and said foothold unit; and a foothold support unit being provided at a front part of said seat plate of the body support means and being adapted for sliding said foothold unit thereon.

4. An exercise device according to claim 1 or 3, wherein said leg support means further comprises a foothold support member for supporting said foothold support unit, said foothold support member being provided under said foothold support unit.

5. An exercise device according to any one of claims 1 to 3, wherein said connection unit is a rod.

6. An exercise device according to any one of claims 1 to 3, wherein said connection unit is a belt type unit which is connected through an idle roller being mounted on a front end of said seat plate.

7. An exercise device according to either claim 2 or claim 3, wherein said knee support unit is a rod being rotatably mounted on said lever of the exercise loading means.

8. In an exercise device for performing an exercise in a desired direction comprising body support means, said body support means being adapted for supporting the body of the user and including a seat plate, a back plate and a leg unit, an improvement comprising:

exercise loading means comprising:

a lever for transmitting an exercise load;

a turning support for causing said lever to turn in the same direction as that of the exercise, said turning support being provided at an end of said lever and rotatably supporting said lever; and a load generator for generating said exercise load, said load generator being provided at an end part of said lever;

leg support means for supporting the legs of the user, said leg supporting means cooperating with said exercise loading means and having a foothold unit; and wherein said exercise device further comprises:

an extendable rod being received in a front end of a lower frame of said seat plate; and a seesaw mechanism being provided at a front end of said extendable rod.

9. In an exercise device for performing an exercise in a desired direction comprising body support means, said body support means being adapted for supporting the body of the user and including a seat plate, a back plate and a leg unit, an improvement comprising:

exercise loading means comprising:

a lever for transmitting an exercise load;

a turning support for causing said lever to turn in the same direction as that of the exercise, said turning support being provided at an end of said lever and rotatably supporting said lever; and a load generator for generating said exercise load, said load generator being provided at an end part of said lever;

leg support means for supporting the legs of the user, said leg supporting means cooperating with said exercise loading means and having a foothold unit; and wherein said body support means further comprises a back plate support unit, said back plate support unit comprising a pair of auxiliary legs being provided in order to cooperate with a link of a cross-shaped link mechanism at a lower part of a lower frame of said seat plate.

10. In an exercise device for performing an exercise in a desired direction comprising body support means, said body support means being adapted for supporting the body of the user and including a seat plate, a back plate and a leg unit, an improvement comprising:

exercise loading means comprising:

a lever for transmitting an exercise load;

a turning support for causing said lever to turn in the same direction as that of the exercise, said turning support being provided at an end of said lever and rotatably supporting said lever; and a load generator for generating said exercise load, said load generator being provided at an end part of said lever;

leg support means for supporting the legs of the user, said leg supporting means cooperating with said exercise loading means and having a foothold unit; and wherein said lever is coupled at its rear end to an upper end of said turning support, so as to pivot upwards and downwards; said load generator is connected between a support bar provided at said turning support and a front end of said lever, so as to move angularly in upward and downward directions; said turning support has at its rear end a pivot pin; said exercise loading means further comprises a support rod coupled with said turning support by said pivot pin, so that a construction including said lever, said turning support and said load generator is maintained in upward and downward directions or leftward or rightward horizontal directions, by said pivot pin.

11. An exercise device according to claim 10, wherein said pivot pin has a rectangular direction conversion fixing portion and a threaded portion to which a nut is coupled; said support rod has a circular throughout hole and a rectangular throughout hole for receiving said pivot pin such that said rectangular direction conversion fixing portion of said pivot pin is fitted in said rectangular throughout hole, whereby said construction including said lever, said turning support and said load generator is maintained in upward and downward directions or leftward and rightward horizontal directions.

12. In an exercise device for performing an exercise in a desired direction comprising body support means, said body support means being adapted for supporting the body of the user and including a seat plate, a back plate and a leg unit, an improvement comprising:

exercise loading means comprising:

a lever for transmitting an exercise load;

a turning support for causing said lever to turn in the same direction as that of the exercise, said turning support being provided at an end of said lever and rotatably supporting said lever; and a load generator for generating said exercise load, said load generator being provided at an end part of said lever;

leg support means for supporting the legs of the user, said leg supporting means cooperating with said exercise loading means and having a foothold unit; and wherein said exercise loading means further comprises:

a support rod provided at its middle portion with a step and at its lower portion with a lock groove;

a fixing member adapted to support said support rod and provided with a coupling hole for receiving said support rod; and a lock member mounted to a portion of said fixing member and adapted to lock a raised position of said support rod.

13. An exercise device according to claim 12, wherein said exercise loading means further comprises a rotatable member fitted in said fixing member and having a rectangular throughout hole at its central portion, a step at its upper portion and a coupling groove at its lower portion and said fixing member has, at its upper portion, angle adjusting grooves for receiving said angle adjusting protrusion of said rotatable member selectively, so that said horizontal angle of said lever can be changed according to said engaged position of said angle adjusting protrusion of said rotatable member.

* * * * *